US007578334B2

(12) United States Patent
Smith et al.

(10) Patent No.: US 7,578,334 B2
(45) Date of Patent: Aug. 25, 2009

(54) CONTROL SYSTEM FOR ARCHITECTURAL COVERINGS WITH REVERSIBLE DRIVE AND SINGLE OPERATING ELEMENT

(75) Inventors: Stephen P. Smith, Denver, CO (US); James L. Miller, Henderson, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 316 days.

(21) Appl. No.: 11/420,274

(22) Filed: May 25, 2006

(65) Prior Publication Data

US 2006/0272783 A1 Dec. 7, 2006

Related U.S. Application Data

(60) Provisional application No. 60/687,506, filed on Jun. 3, 2005.

(51) Int. Cl.
*A47G 5/02* (2006.01)

(52) U.S. Cl. ..... 160/319; 160/121.1; 160/84.05

(58) Field of Classification Search ..... 160/84.05, 160/121.1, 319, 320, 168.1 R, 178.1 R, 173 R, 160/170, 193; 242/394, 395, 564.2
See application file for complete search history.

(56) References Cited

U.S. PATENT DOCUMENTS 2,732,010 A * 1/1956 Griesser ..... 160/170
4,347,885 A * 9/1982 von Knorring et al. ..... 160/242
4,492,261 A * 1/1985 Chong ..... 160/319
5,890,529 A * 4/1999 Haarer ..... 160/319
6,129,131 A * 10/2000 Colson ..... 160/84.02
7,128,126 B2 * 10/2006 Smith et al. ..... 160/319
7,341,091 B2 * 3/2008 Nien et al. ..... 160/170
7,360,574 B2 * 4/2008 Maumi et al. ..... 160/170
2004/0226663 A1 11/2004 Smith et al.
2006/0048904 A1 * 3/2006 Gruner ..... 160/84.05
2006/0191650 A1 * 8/2006 Takebayashi ..... 160/320

* cited by examiner

*Primary Examiner*—Blair M. Johnson
(74) *Attorney, Agent, or Firm*—Dorsey & Whitney LLP

(57) ABSTRACT

The present invention provides for retractable coverings for architectural openings utilizing a control system having a single operating element allowing a user to move a retractable covering between extended and retracted positions by imparting a repetitive motion to the operating element. The control system may include an input assembly, a transmission, and an output assembly cooperatively engaging to convert linear movement of the operating element into rotational movement of a head roller in the required direction to provide movement of the covering in the desired direction and distance. The input assembly may convert linear movement of the operating element into rotational movement imparted to the transmission. The input assembly may also engage the transmission to effect the direction of rotational output from the transmission. The transmission imparts rotational movement to the output assembly, which interfaces with the head roller to rotate the head roller and to provide a braking feature.

25 Claims, 46 Drawing Sheets

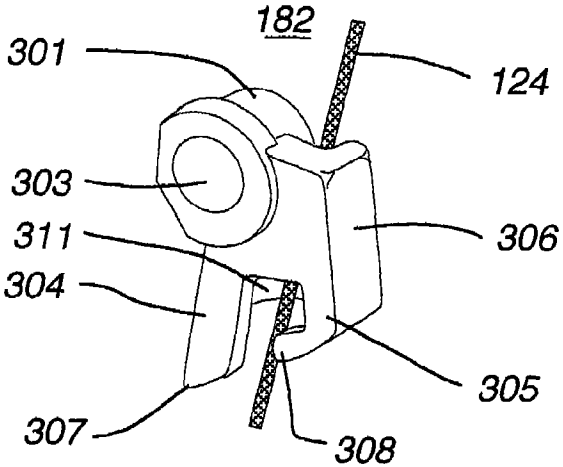
Fig. 5S
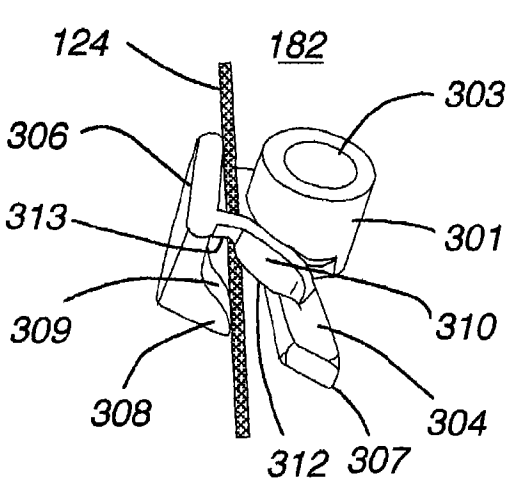
Fig. 5U
Fig. 5T
Fig. 5V

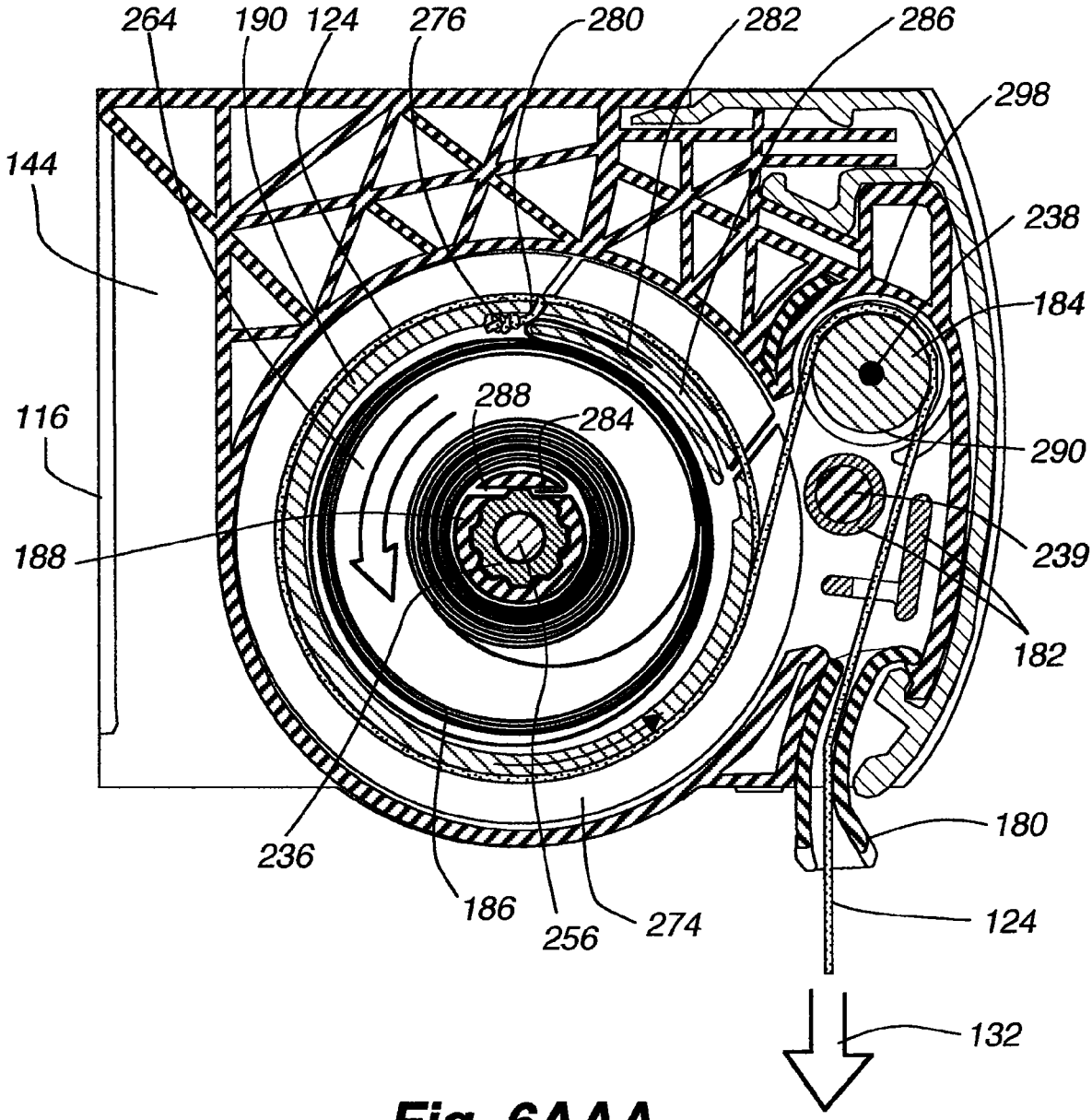
Fig. 6AAA

Fig. 6BBB

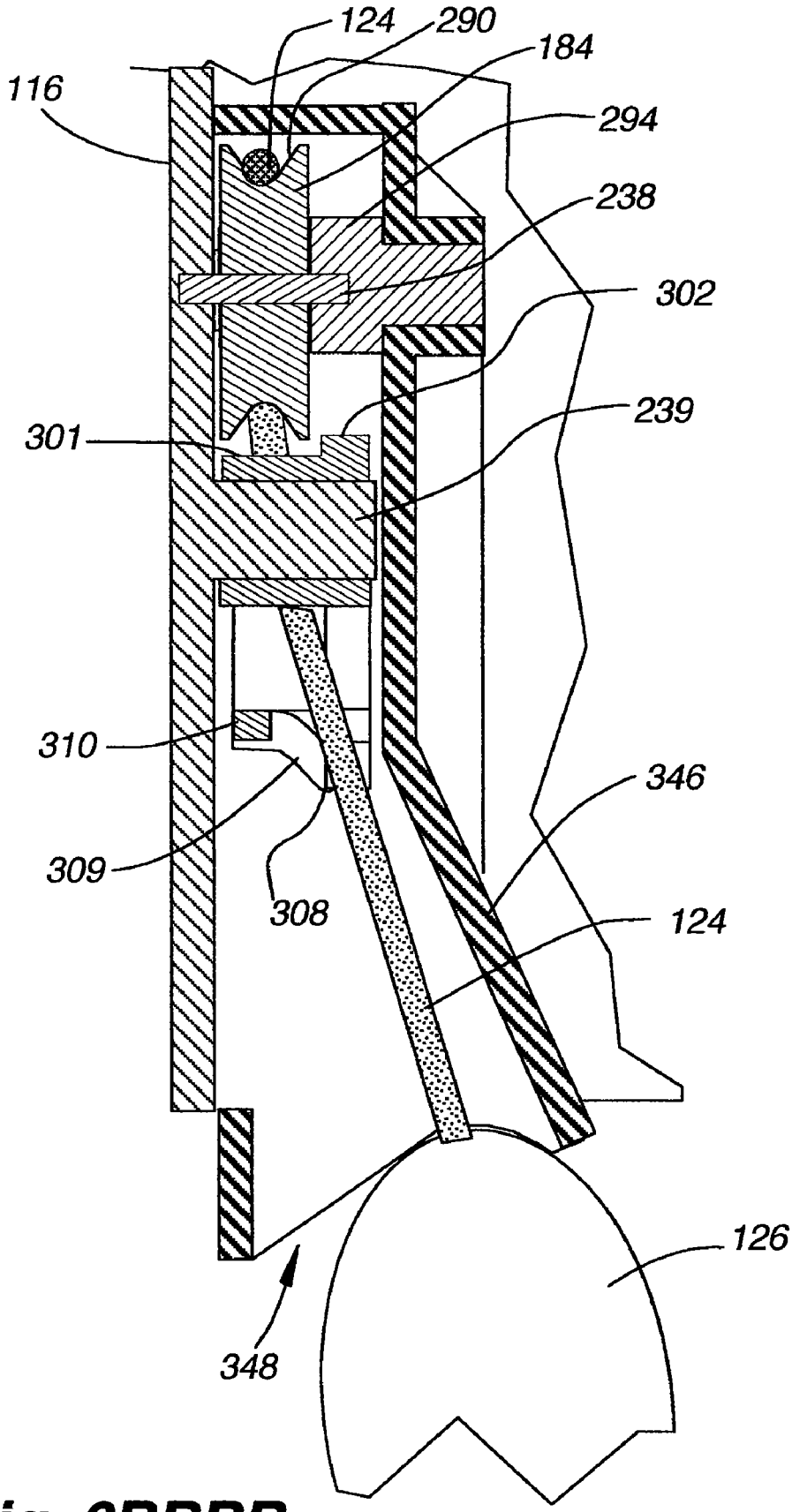
Fig. 6BBBB

Fig. 9AAAA

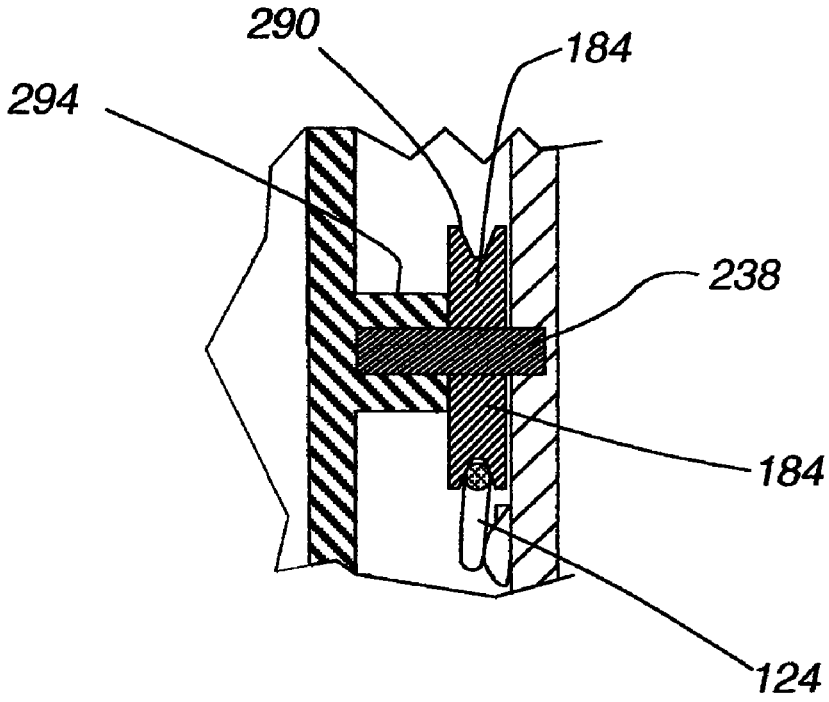
Fig. 9AAAA
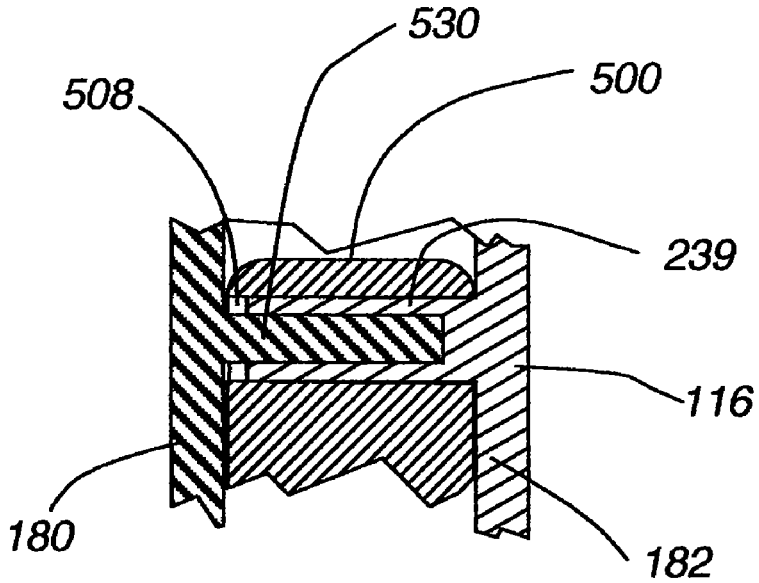
Fig. 9AAA

CONTROL SYSTEM FOR ARCHITECTURAL COVERINGS WITH REVERSIBLE DRIVE AND SINGLE OPERATING ELEMENT

CROSS-REFERENCE TO RELATED APPLICATIONS

The present application claims the benefit under 35 U.S.C. § 119(e) to U.S. Provisional Patent Application No. 60/687,506 ("the '506 application"), which was filed on Jun. 3, 2005 and entitled "Control System For Architectural Coverings With Reversible Drive And Single Operating Element." The '506 application is incorporated by reference into the present application in its entirety.

FIELD OF THE INVENTION

The present invention relates to retractable coverings for architectural openings. More particularly, the present invention relates to operating systems for controlling retractable coverings for architectural openings using a single operating element.

BACKGROUND OF THE INVENTION

Operating systems utilized in window coverings for architectural openings, such as shade and blind assemblies, are commonly used. Conventional shade and blind assemblies typically comprise a head rail, bottom rail, and slats or a covering disposed there between. Generally, a control system for raising and lowering such blinds or shades are installed in the head rail and may include an operating element, such as a cord, for lowering or raising the blinds or shades. The operating element is typically connected to pulleys or drums within the head rail, which when activated by a user, lift the bottom rail or lower the bottom rail via cords attached to the bottom rail. The operating element may be a continuous loop so as to present to the user a convenient method for operating the shade or blind. Other control systems may have a plurality of operating elements that are not in a loop so as to present the user a choice of one of the operating elements to raise or lower the blind. Other control systems, such as the cord lock system, may employ a single operating element that is not in a loop, is used to both raise and lower the blind, and is locked into place by a pivoting lock that directly engages and binds the cord (i.e., operating element).

Whether the control system utilizes a single looped type operating element or a plurality of operating elements, the operator must choose which direction to pull the loop or which operating element to activate in order to move the architectural covering in a desired direction. This can be especially confusing if the operating elements are tangled.

Inherent in the loop operating element and cord lock systems is the problem of having a very long operating element with which to operate the system. Often, a greater length of operating element is necessary to raise or lower the shade or blind due to the longer drop of the shade or blind. A greater length of the operating element or the use of a looped cord present a strangulation hazard to children who may become entangled in the operating element.

U.S. patent application Ser. No. 10/791,645, which was filed Mar. 1, 2004 and is hereby incorporated in its entirety into the present application, discloses a novel control system that addresses many of the aforementioned problems associated with window covering operating systems. However, said control system is not configured such that it is compatible with every operating system for a window covering. Also, improvements in operational smoothness and dependability would be beneficial.

There is a need in the art for a control system offering improved operational smoothness and dependability while addressing the aforementioned challenges related to moving window coverings. There is also a need in the art for a method of using and making such a control system.

BRIEF SUMMARY OF THE INVENTION

The present invention, in one embodiment, is a control system for a roller tube equipped retractable covering for architectural openings. The control system employs a single operating element (i.e., cord, cable, chain, etc.) that is retractable. To lower the covering, the operating element is repeatedly pulled/extended in a first downward direction/path, the control system automatically retracting the operating element after each pull/extension. To raise the covering, the operating element is repeatedly pulled/extended in a second downward direction/path, the control system automatically retracting the operating element after each pull/extension.

The present invention provides for retractable coverings for architectural openings utilizing a control system having a single operating element allowing a user to move a retractable covering for architectural openings between extended and retracted positions by imparting a repetitive motion to the operating element. When the retractable covering is vertically disposed, a user can raise or lower the retractable covering by imparting a repetitive up and down motion to the pull cord.

In one aspect of the present invention, a covering for an architectural opening includes a head rail assembly, at least one sheet of fabric, and a head roller rotatably supported by the head rail assembly and adapted to extend or retract the at least one sheet upon rotation of the head roller in a first direction or a second direction. A control system is connected with the head rail assembly and is adapted to rotate the head roller in the first direction and the second direction. The control system includes an input assembly, a reversible transmission, and an output assembly. The input assembly includes a single operating element and is operative to convert linear motion of the operating element into rotational motion of a first motion transfer element. The transmission is operative to translate rotation of the first motion transfer element into rotation of a second motion transfer element in either of two desired output rotational directions. The output assembly is operatively engaged with the second motion transfer element to rotate the head roller. A pull force applied in a first pull direction/path imparted on the single operating element causes the head roller to rotate in the first direction, and the pull force applied in a second pull direction/path imparted on the single operating element causes the head roller to rotate in the second direction.

In another form of the present invention, the input assembly includes a single operating element and is operative to convert linear motion of the operating element into rotational motion of a first motion transfer element. The transmission is operative to translate rotation of the first motion transfer element in the first direction into rotation of a second motion transfer element through at least one planet gear rotatably connected with a planet carrier. The output assembly is operatively engaged with the second motion transfer element to rotate the head roller. The input assembly includes a braking element adapted to brake the planet carrier to cause rotation of the second motion transfer element in the second direction, and the input assembly is adapted to release the planet carrier to cause rotation of the second motion transfer element in the first direction.

In yet another form of the present invention, the input assembly includes a single operating element and is operative to convert linear motion of the operating element into rotational motion of a first motion transfer element. The transmission is operative to translate rotation of the first motion transfer element in the first direction into rotation of a second motion transfer element though a planetary gear set configured to selectively operate in a first configuration and a second configuration. The output assembly is operatively engaged with the second motion transfer element to rotate the head roller. The first configuration provides a first mechanical advantage and causes the second motion transfer element to rotate at a first speed. The second configuration provides a second mechanical advantage and causes the second motion transfer element to rotate at a second speed.

In still another form of the present invention, the input assembly includes a single operating element and is operative to convert linear motion of the operating element into rotational motion of a first motion transfer element. The transmission is operative to translate rotation of the first motion transfer element into rotation of a second motion transfer element through a clutch and at least one third gear. The output assembly operatively engaged with the second motion transfer element to rotate the head roller. Rotation of the first motion transfer element in the first direction engages the least one third gear to activate the clutch to cause rotation of the second motion transfer element in the first direction. The clutch is configured to allow rotation of the second motion transfer element in the first direction and second direction when the clutch is deactivated.

In still another form of the present invention, the input assembly includes a single operating element and is operative to convert linear motion of the operating element into rotational motion of a first motion transfer element. The transmission operative to translate rotation of the first motion transfer element into rotation of a second motion transfer element. The output assembly is operatively engaged with the second motion transfer element to rotate the head roller. The input assembly is configured to engage the transmission to cause the head roller to rotate in the first direction when the operating element travels in a first path through the input assembly, and is configured to engage the transmission to cause the head roller to rotate in a the second direction when the operating element travels in a second path through the input assembly.

In still another form of the present invention, the input assembly includes a single operating element and is operative to convert linear motion of the operating element into rotational motion of a first motion transfer element. The transmission is operative to translate rotation of the first motion transfer element into rotation of a second motion transfer element. The output assembly operatively engaged with the second motion transfer element to rotate the head roller. A pull force applied in a first pull direction imparted on the single operating element causes the head roller to rotate in the first direction. The input assembly is operative to allow a change in direction of the pull force on the single operating element while the head roller is rotating in the first direction without reversing rotation of the head roller.

In still another form of the present invention, the input assembly is operative to convert linear motion of an operating element into rotational motion of a first motion transfer element. The transmission operative to translate rotation of the first motion transfer element into rotation of a second motion transfer element through at least a third gear rotatably connected with a planet carrier. The output assembly operatively engaged with the second motion transfer element to rotate the head roller. The input assembly includes a shift arm having a pawl adapted to engage ratchet teeth on the planet carrier when a pull force in a first pull direction is imparted on the single operating element. The input assembly is also configured to automatically retract the single operating element into the head rail assembly and disengage the pawl from the ratchet teeth when no pull force is applied to the single operating element.

The present invention, in one embodiment, is an input assembly for a control system adapted to selectively extend and retract a covering for an architectural opening. The control system has a transmission configured to receive a rotational input in a first rotational direction and selectively provide a rotational output in the first rotational direction or in a second rotational direction. The input assembly comprises an operating element, a spool, a biasing element, a pulley and a shift arm. The spool is rotatably mounted on a first axle and adapted to storably receive the operating element. The biasing element is coupled to the spool and adapted to cause the spool to retract the operating element from an extended state onto the spool. The pulley is rotatably mounted on a second axle and adapted to receive the operating element. The shift arm is pivotally mounted on a third axle and includes a pawl tooth and a first surface for engaging the operating element. The operating element extends from the spool, about the pulley and adjacent the first surface of the shift arm. Displacement of the operating element in a first direction brings the operating element into contact with the first surface and causes the shift arm to pivot such that the pawl tooth is prevented from engaging the transmission. Displacement of the operating element in a second direction allows the shift arm to pivot such that the pawl tooth engages the transmission.

In one embodiment, the shift arm further includes a second surface for engaging the operating element. Displacement of the operating element in the second direction brings the operating element into contact with the second surface and causes the shift arm to pivot such that the pawl tooth engages the transmission.

In one embodiment, pawl tooth engagement with the transmission causes the transmission to provide rotational output in the second rotational direction. Failure of the pawl tooth to engage with the transmission causes the transmission to provide rotational output in the first rotational direction.

The present invention, in one embodiment, is an input assembly for a control system adapted to selectively extend and retract a covering for an architectural opening. The input assembly includes a transmission, a pulley, a shift arm and an operating element. The transmission is rotationally mounted on a first axle and includes a spool. The pulley is rotationally mounted on a second axle. The shift arm is pivotally mounted on a third axle and includes a pawl tooth. The operating element retractably extends from the spool, about the pulley and adjacent the shift arm. Extending the operating element from the spool in an extending direction provides the transmission with a rotational input in a first rotational direction.

The present invention, in one embodiment, is a method of selectively extending and retracting a covering for an architectural opening. The method includes: a routing an operating element from a spool, about a pulley and adjacent a shift arm, wherein the spool drives a transmission rotationally mounted on a first axle, the pulley is rotationally mounted on a second axle, and the shift arm includes a pawl tooth for engaging the transmission and is privotally mounted on a third axle; and extending the operating element in an extension direction to create a rotational input for the transmission in a first rotational direction.

The features, utilities, and advantages of various embodiments of the invention will be apparent from the following more particular description of embodiments of the invention as illustrated in the accompanying drawings and defined in the appended claims.

BRIEF DESCRIPTION OF THE DRAWINGS

FIG. 5C' is an exploded isometric view of a transmission for the control system according to one embodiment of the present invention.

FIG. 5S is a front left-side isometric view of the shift arm depicted in FIG. 5D, wherein the operating cord has engaged a first cord engagement surface.

FIG. 5T is a front left-side isometric view of the shift arm depicted in FIG. 5D, wherein the operating cord has engaged a second cord engagement surface.

FIG. 5U is a bottom right-side isometric view of the shift arm depicted in FIG. 5D, wherein the operating cord has engaged a first cord engagement surface.

FIG. 5V is a bottom right-side isometric view of the shift arm depicted in FIG. 5D, wherein the operating cord has engaged a second cord engagement surface.

FIG. 6AA is the view shown in FIG. 6A without an operating cord and clock spring.

FIG. 6AAA is the view shown in FIG. 6A wherein the operation cord has been pulled from the cord spool.

FIG. 6BB is a cross-sectional view of the control system depicted in FIG. 6B, taken along line 6BB-6BB.

FIG. 6BBB is a cross-sectional view of the control system depicted in FIG. 6BB, taken along line 6BBB-6BBB.

FIG. 6BBBB is a view of the control system depicted in FIG. 6BB showing an operating cord placed in a parked position.

FIG. 7AA is a cross-sectional view of the control system depicted in FIG. 7A, taken along line 7AA-7AA.

FIG. 7AAA is a cross-sectional view of the control system depicted in FIG. 7AA, taken along line 7AAA-7AAA.

FIG. 9AA is a cross-sectional view of the control system depicted in FIG. 9A taken along line 9AA-9AA.

FIG. 9AAA is a cross-sectional view of the third end cap shaft depicted in FIG. 9A and taken along line 9AAA-9AAA.

FIG. 9AAAA is a cross-sectional view of the second end cap shaft depicted in FIG. 9AA and taken along line 9AAAA-9AAAA.

FIG. 9AAAAA is a cross-sectional view of the shift arm depicted in FIG. 9AA and taken along line 9AAAAA-9AAAAA.

FIG. 10AA is a cross-sectional view of the control system depicted in FIG. 10A taken along line 10AA-10AA.

FIG. 10AAA is a cross-sectional view of the shift arm depicted in FIG. 10AA taken along line 10AAA-10AAA.

FIG. 10BB is a cross-sectional view of the shift arm depicted in FIG. 10B taken along line 10BB-10BB.

FIG. 12AA is a cross-sectional view of the control system depicted in FIG. 12A taken along line 12AA-12AA.

FIG. 12AAA is a cross-sectional view of the shift arm depicted in FIG. 12A taken along line 12AAA-12AAA.

FIG. 13AA is a cross-sectional view of the control system depicted in FIG. 13A taken along line 13AA-13AA.

FIG. 13AAA is a cross-sectional view of the shift arm depicted in FIG. 13A taken along line 13AAA-13AAA.

FIG. 13BB is a cross-sectional view of the shift arm depicted in FIG. 13B taken along line 13BB-13BB.

DETAILED DESCRIPTION OF THE INVENTION

I. Discussion of First Embodiment a. General Overview of First Embodiment

Retractable coverings for architectural openings are well known in the art. Such retractable coverings are generally movable between extended and retracted positions. When such coverings are vertically oriented, they are moveable between raised and lowered positions. Retractable coverings may also include vanes or slats, which are typically movable or tiltable between open and closed positions. A head rail typically houses a control system to allow a user to move the retractable covering between retracted and extended positions. As such, the retractable covering may be suspended from the head rail, and may include a bottom rail with vanes or slats disposed between the head rail and the bottom rail. The control system may include an operating element, such as a pull cord, to allow a user to operate the control system. Operation of the control system causes the retractable covering to move.

The present invention provides for a control system having a single operating element allowing a user to move the retractable covering between extended and retracted positions by imparting a repetitive motion to the operating element. For example, when the retractable covering is vertically disposed, a user can raise or lower the retractable covering by imparting a repetitive up and down motion to the pull cord. While the present invention is described below in connection with a covering of the type shown in FIG. 1, it is to be appreciated that the present invention is applicable to other types of devices for covering architectural openings.

b. Covering

Figure 1:
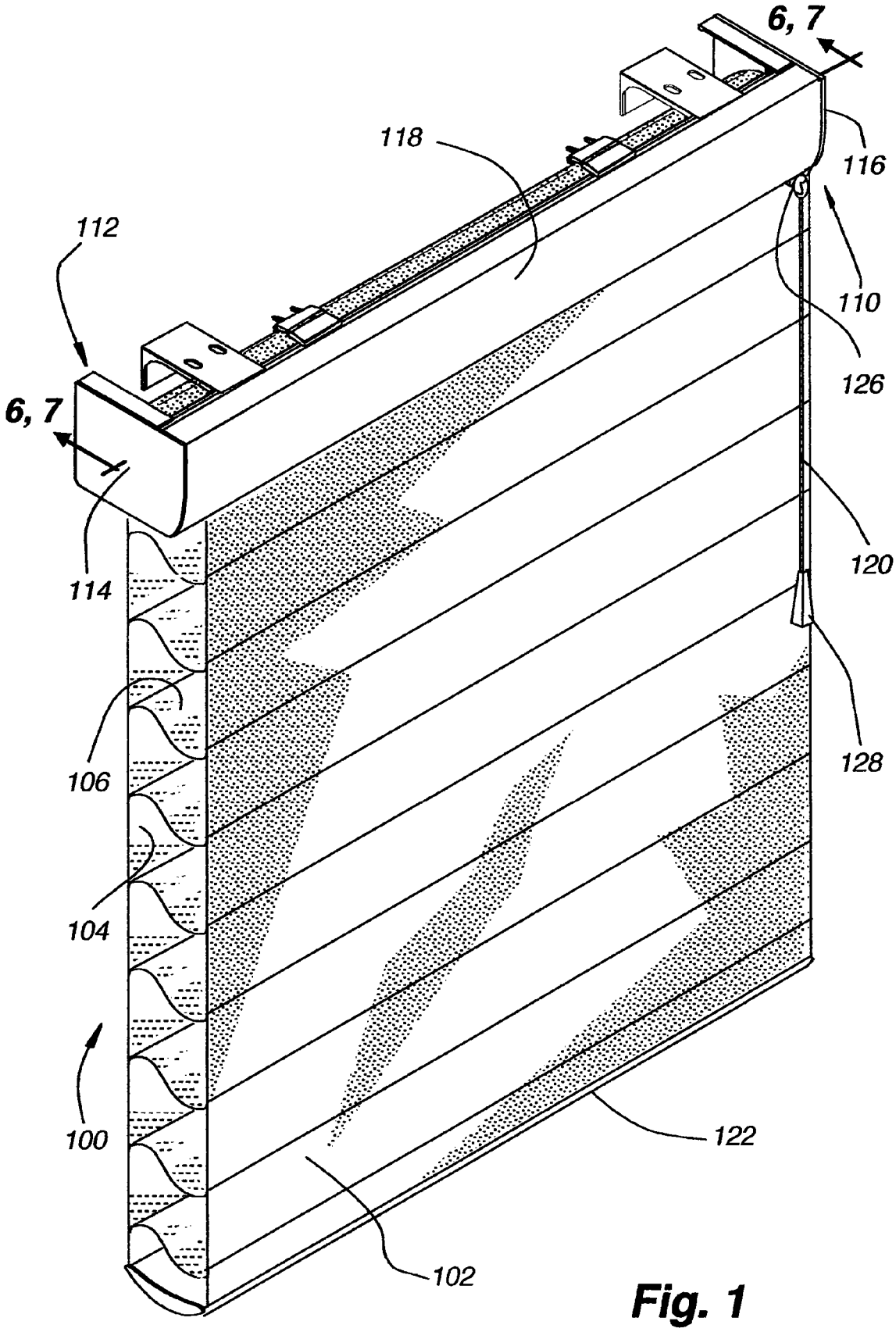
FIG. 1 is an isometric view of a covering for an architectural opening utilizing the present invention.
Figure 6:
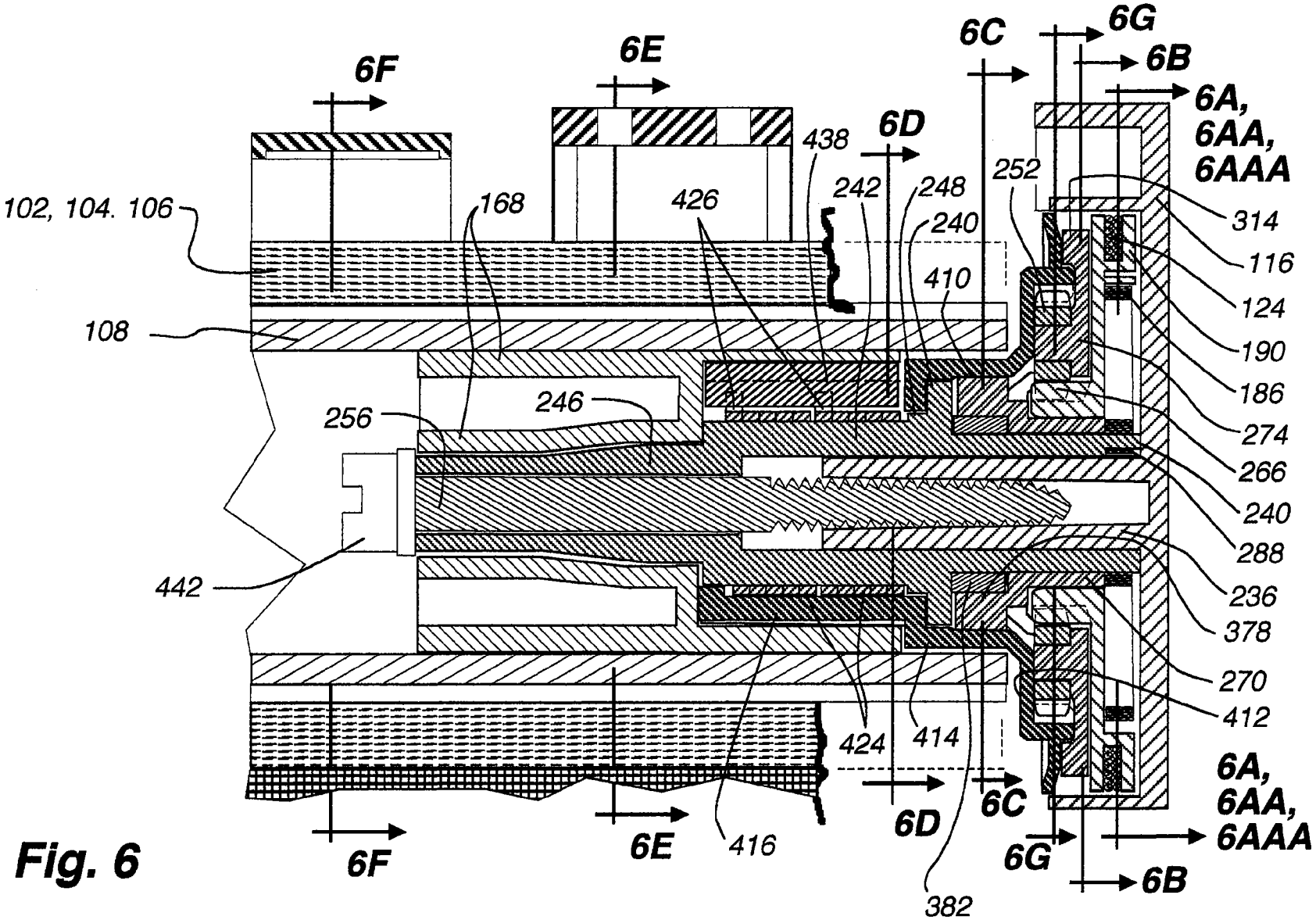
FIG. 6 is a cross-sectional view of the control system depicted in FIGS. 1 and 4 engaged to lower the covering, taken along line 6-6.
Figure 6A:
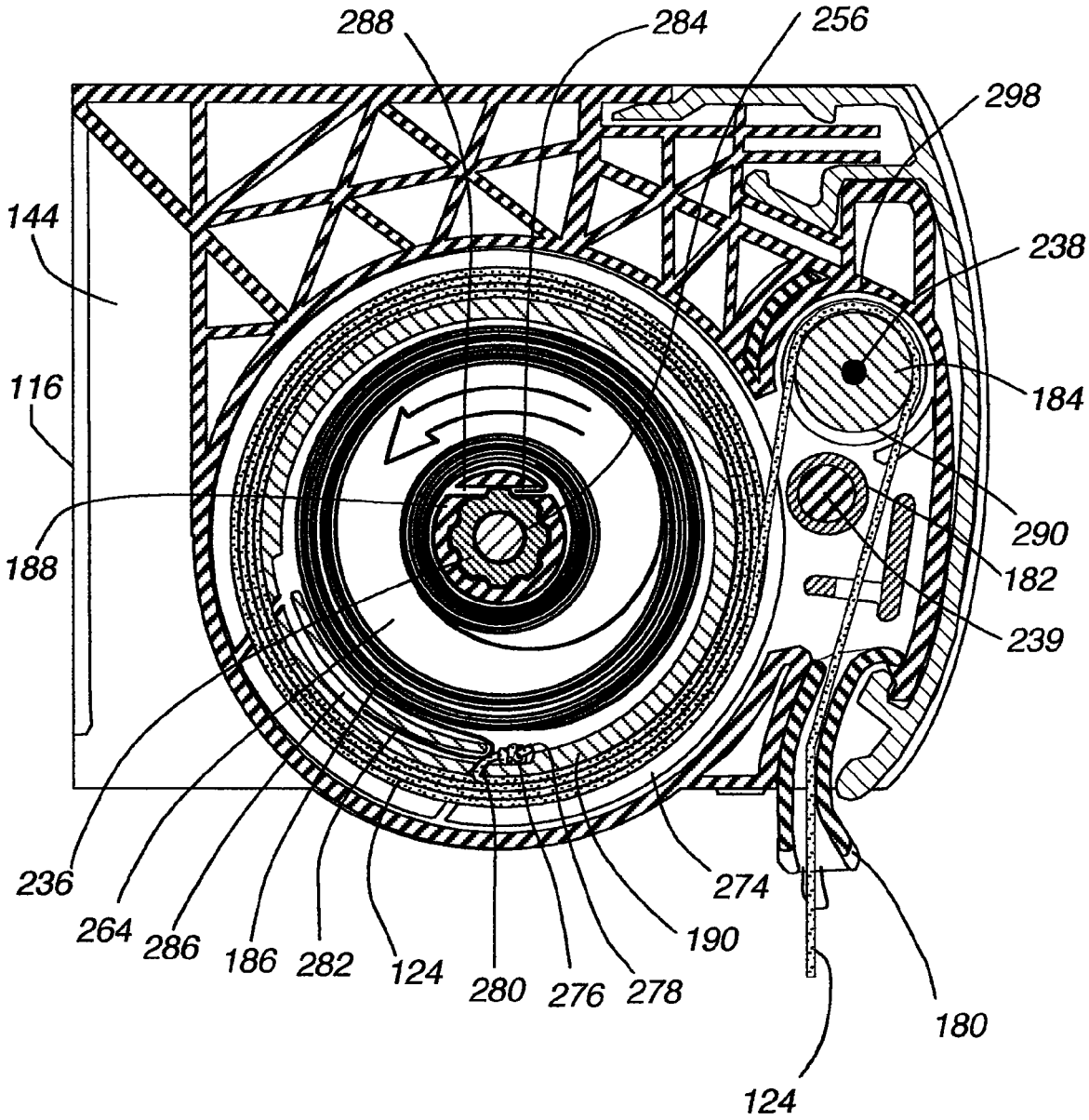
FIG. 6A is a cross-sectional view of the control system depicted in FIG. 6, taken along line 6A-6A.
Figure 6A:
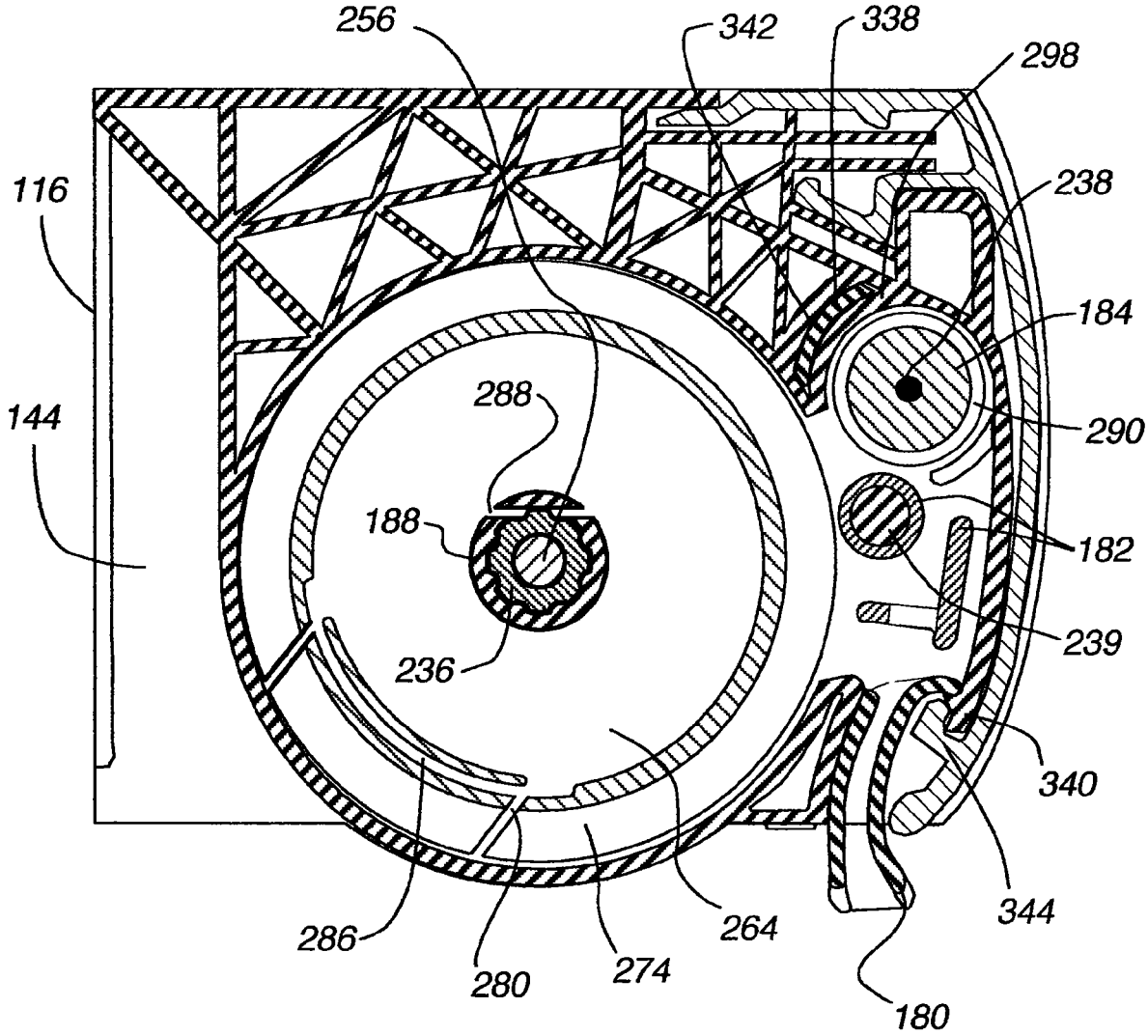
Figure 6B:
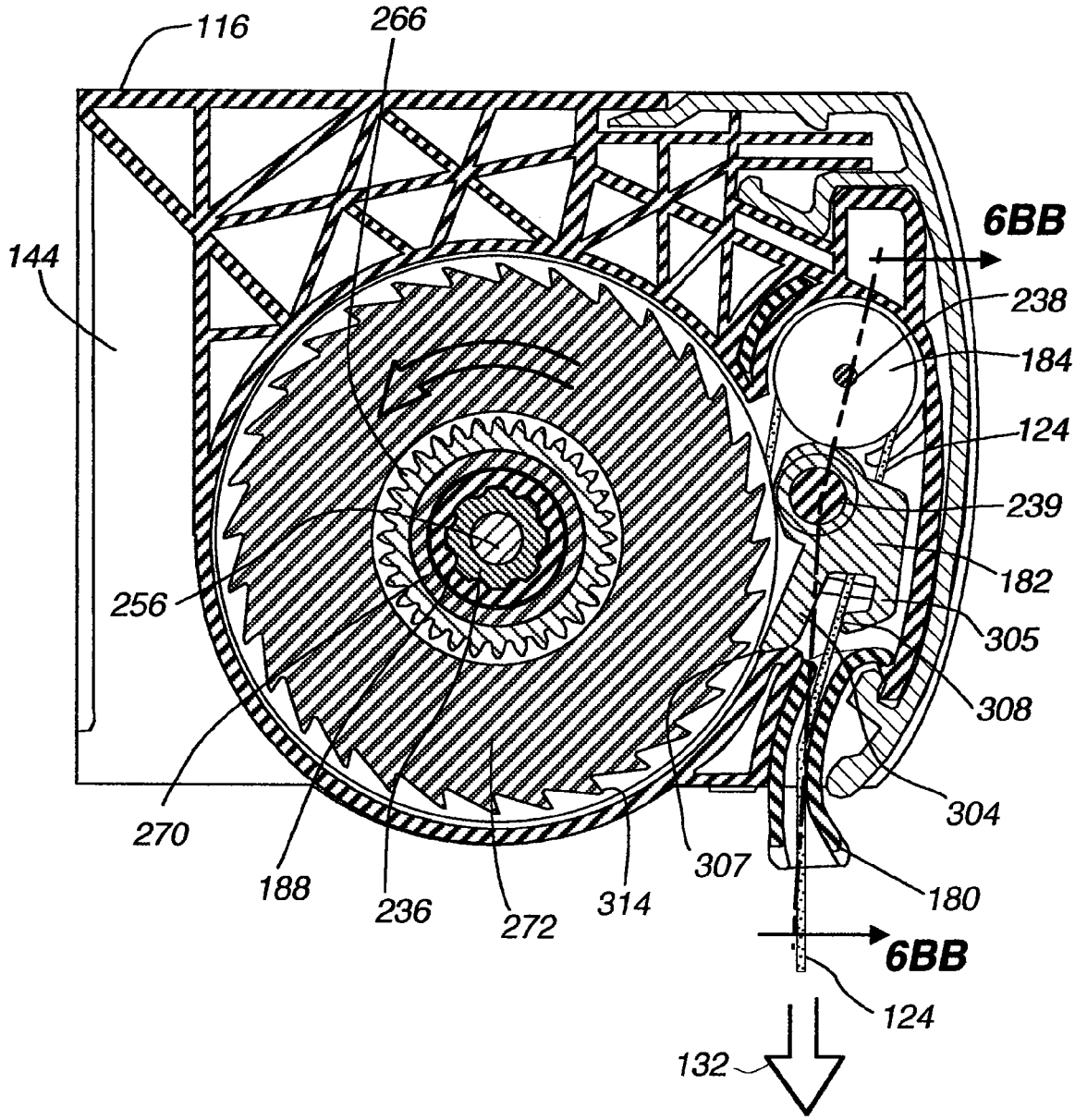
FIG. 6B is a cross-sectional view of the control system depicted in FIG. 6, taken along line 6B-6B.
Figure 6B:
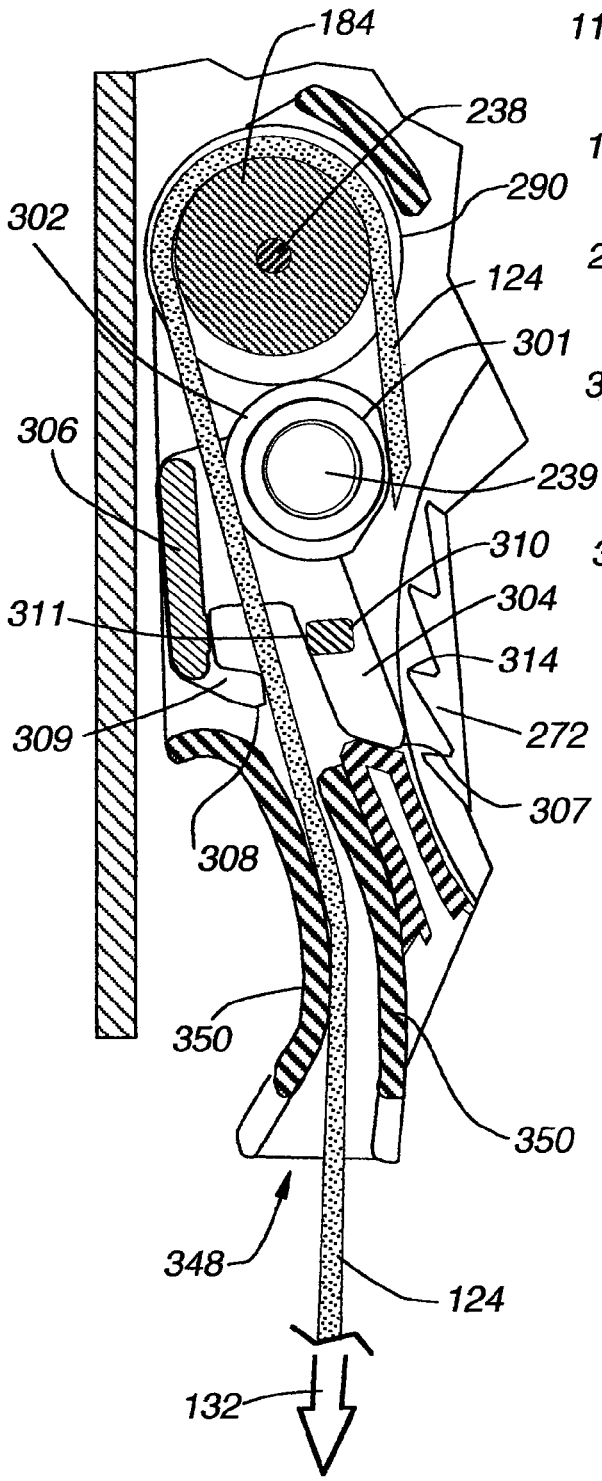
Figure 6B:
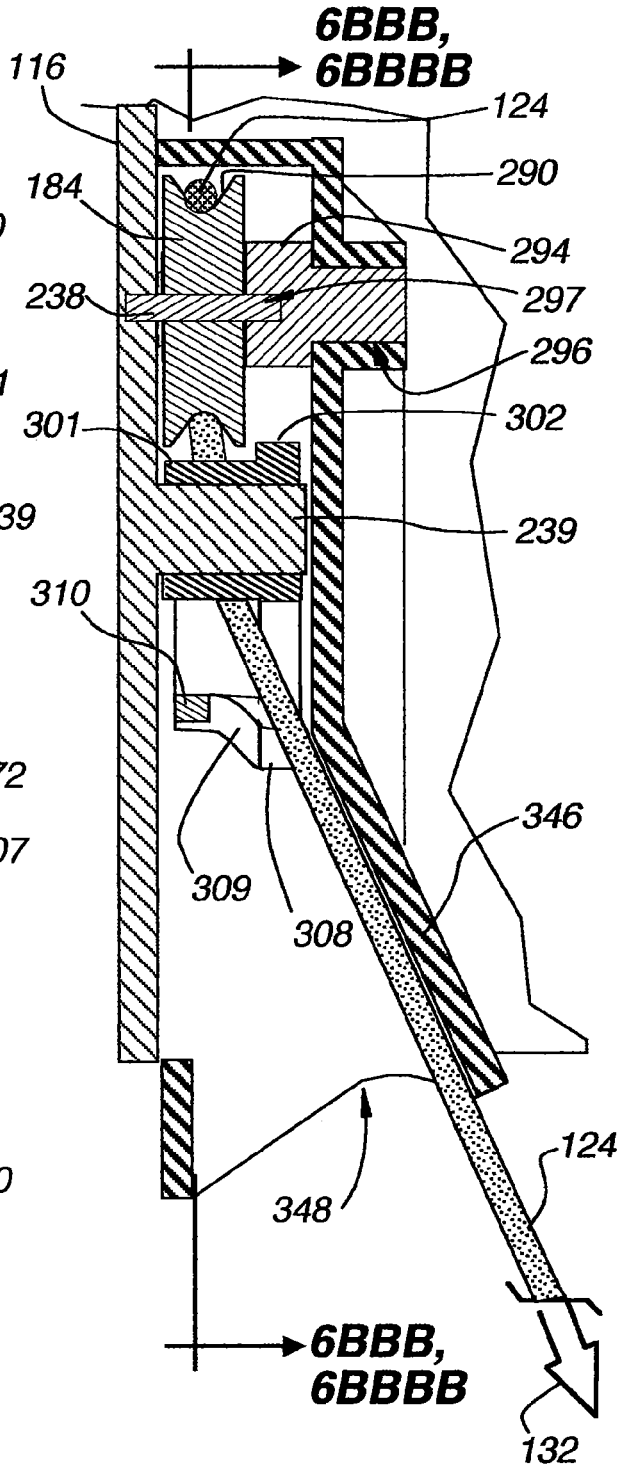
Figure 6C:
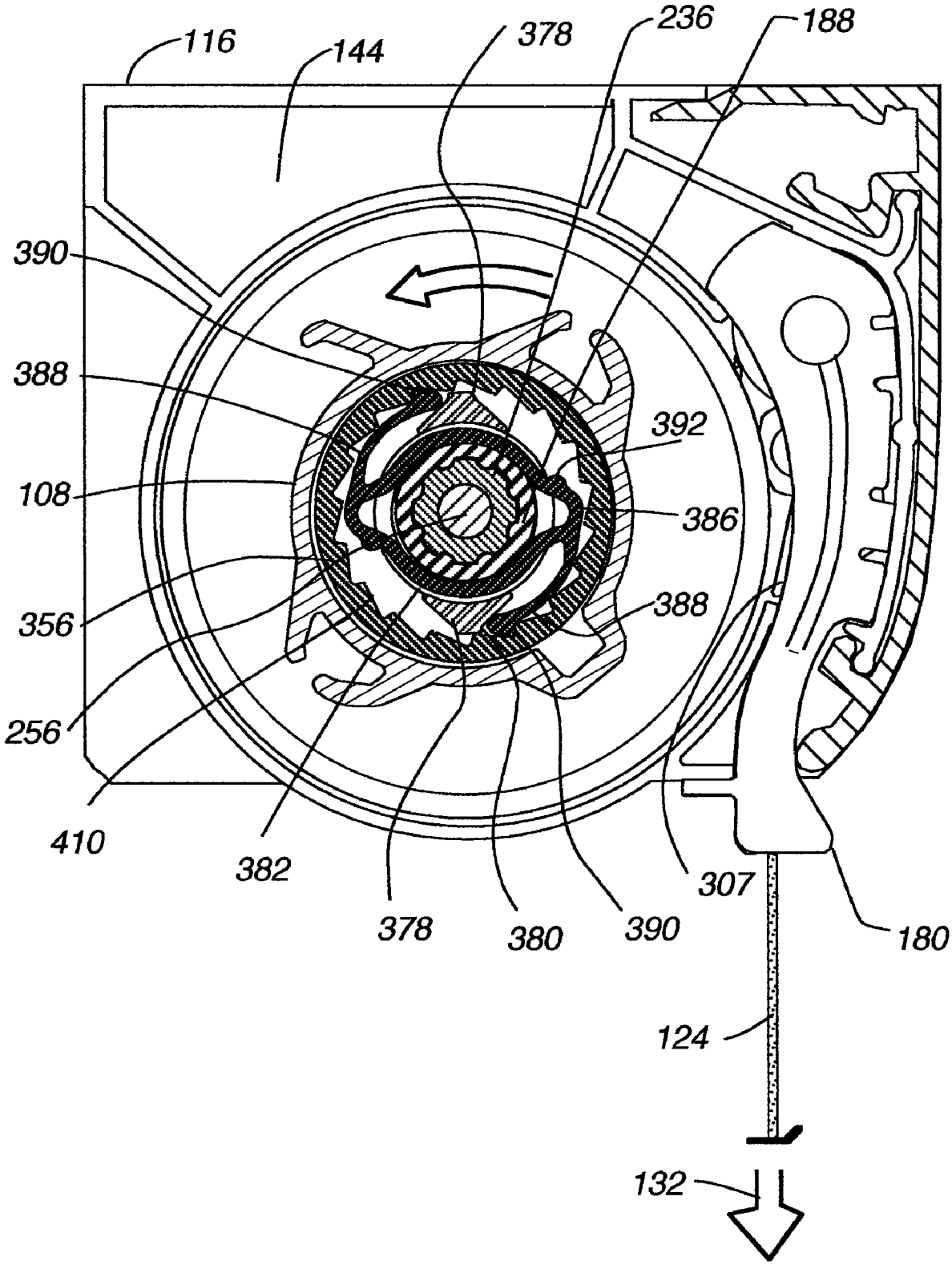
FIG. 6C is a cross-sectional view of the control system depicted in FIG. 6, taken along line 6C-6C.
Figure 6D:
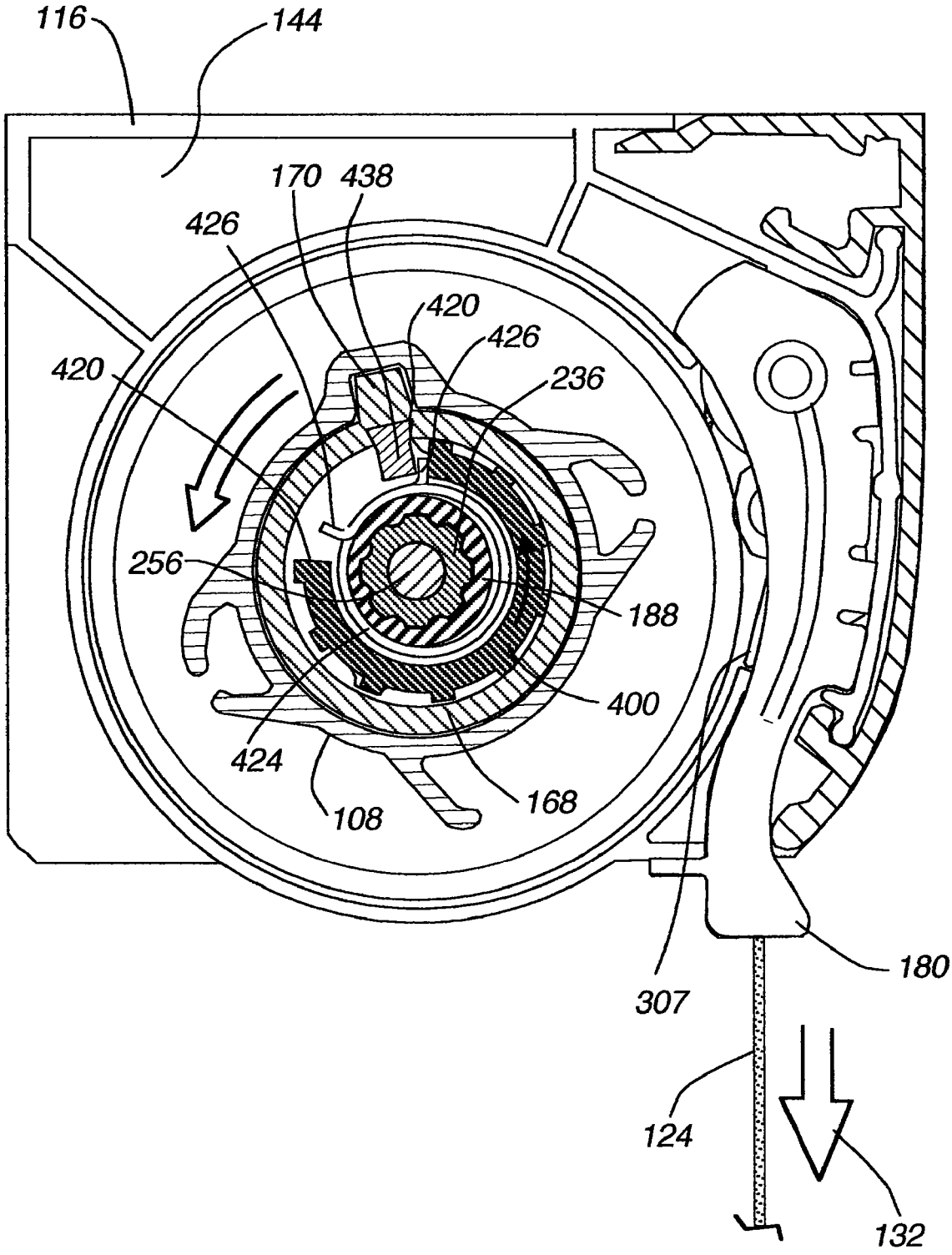
FIG. 6D is a cross-sectional view of the control system depicted in FIG. 6, taken along line 6D-6D.

As shown in FIG. 1, the covering 100 includes a vertical first fabric sheet 102 parallel to a vertical second fabric sheet 104 which are interconnected by a plurality of horizontal spaced flexible fabric vanes 106. The covering 100 shown in FIG. 1 is also provided with a light control feature. The light control feature is affected through motion of the first sheet 102 relative to the second sheet 104 in a direction perpendicular to the fabric vanes 106. Relative motion between the first sheet and the second sheet changes the angle of the vanes, which in turn, controls the amount of light admitted through the covering. The covering may be configured to react in different ways in response to being lowered or raised. For example, the covering 100 shown in FIG. 1 opens (i.e. vanes are orthogonal to the first sheet and the second sheet) only when the covering is in a fully extended or lowered position, as shown in FIG. 6F. At any position, other than the fully extended position, the covering 100 is in a closed condition with the first fabric sheet 102 and the second fabric sheet 104 being movable vertically together and in close proximity being separated only by the vanes 106 which are disposed in flat substantially coplanar relationship between the sheets, as shown in FIG. 6E.

Figure 3:
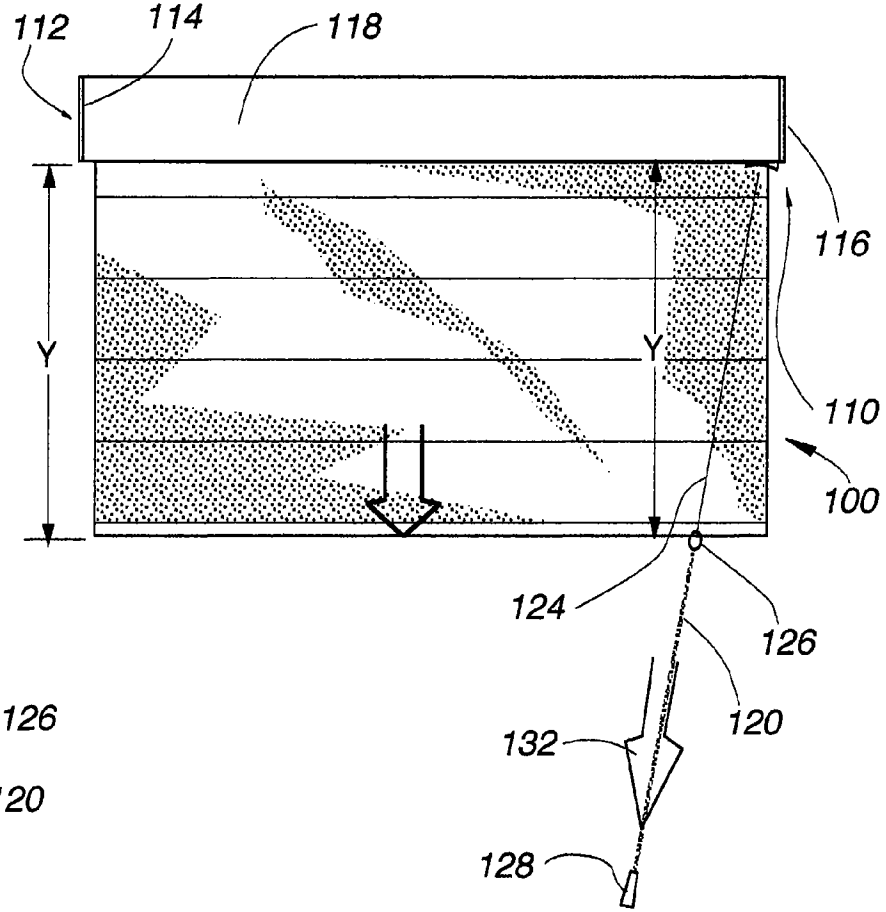
FIG. 3 is a front elevation view of the covering illustrating operation of the present invention to lower the covering.
Figure 2:
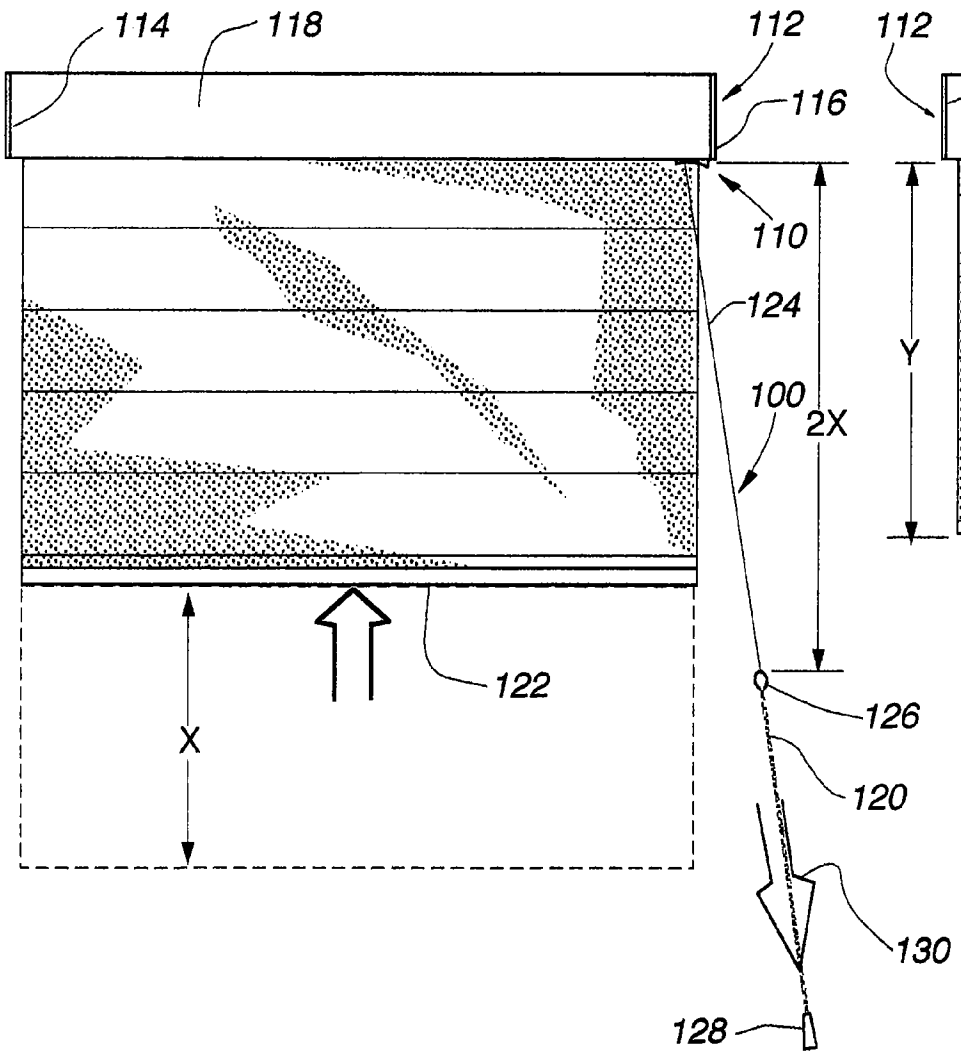
FIG. 2 is a front elevation view of the covering illustrating operation of the present invention to raise the covering.
Figure 5A:
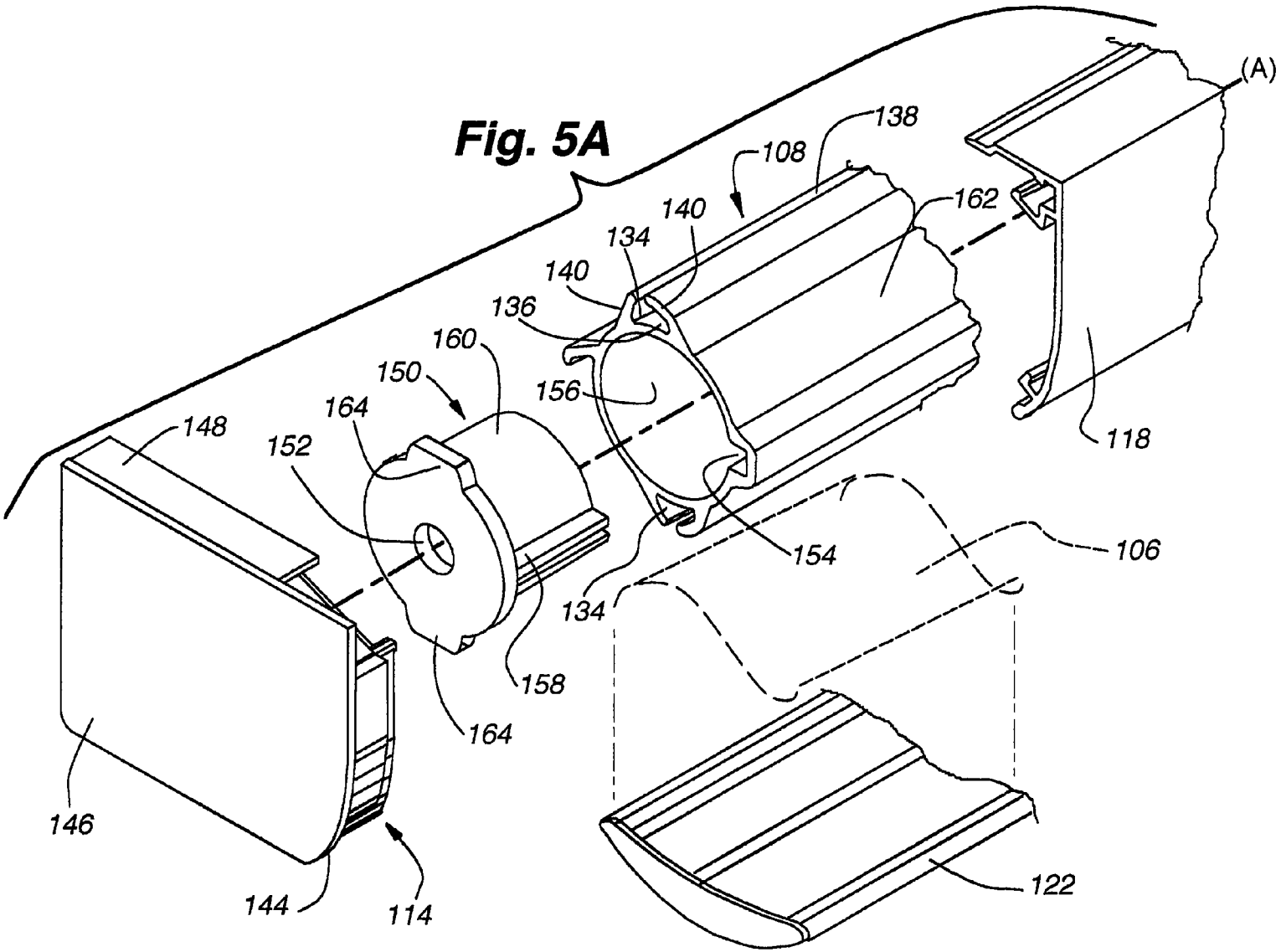
FIG. 5A is an exploded isometric view of a left end portion of a head rail assembly.
Figure 5B:
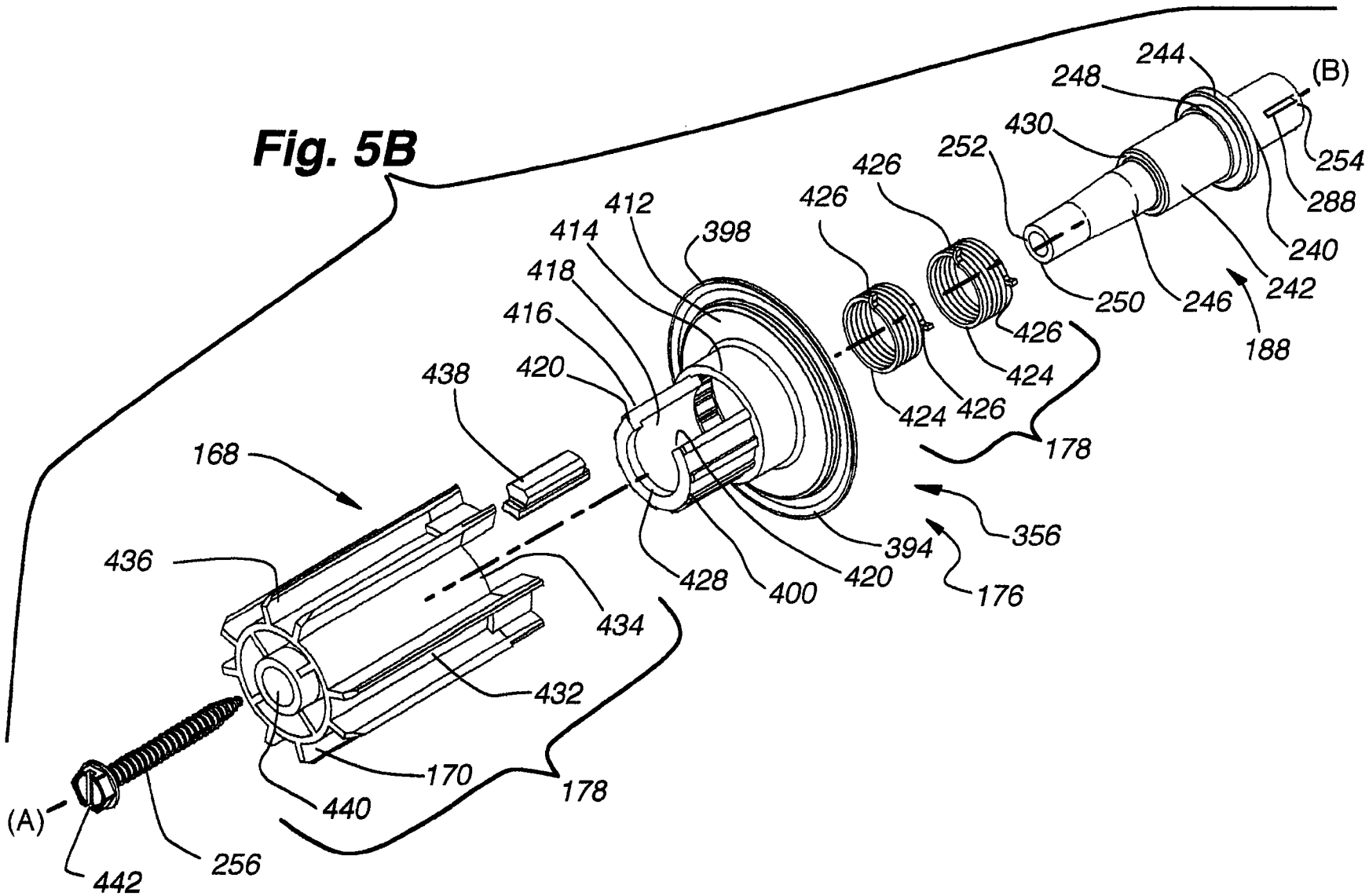
FIG. 5B is an exploded isometric view of the output assembly for the control system according to one embodiment of the present invention.
Figure 5C:
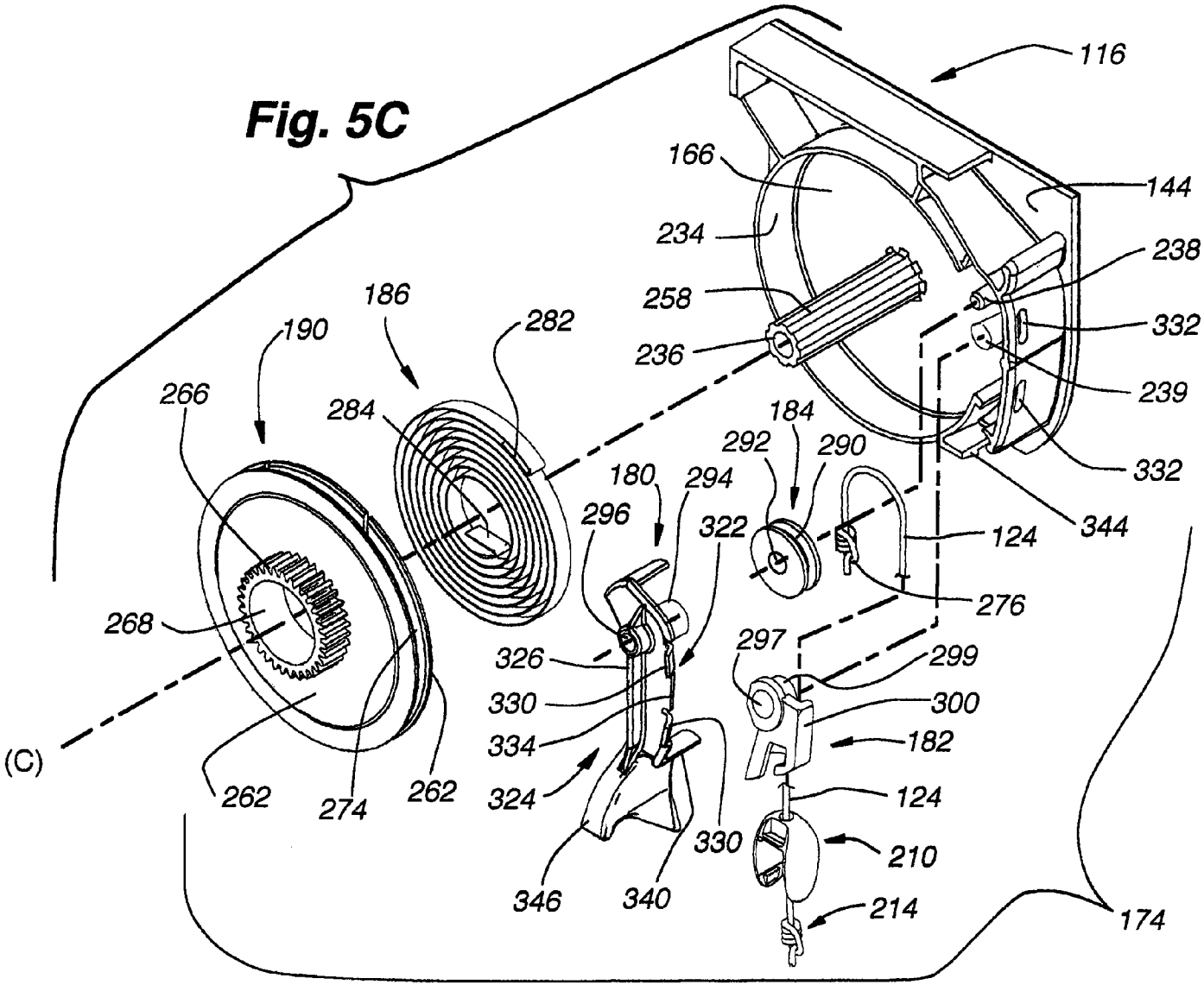
FIG. 5C is an exploded isometric view of an input assembly for the control system according to one embodiment of the present invention.
Figure 5C:
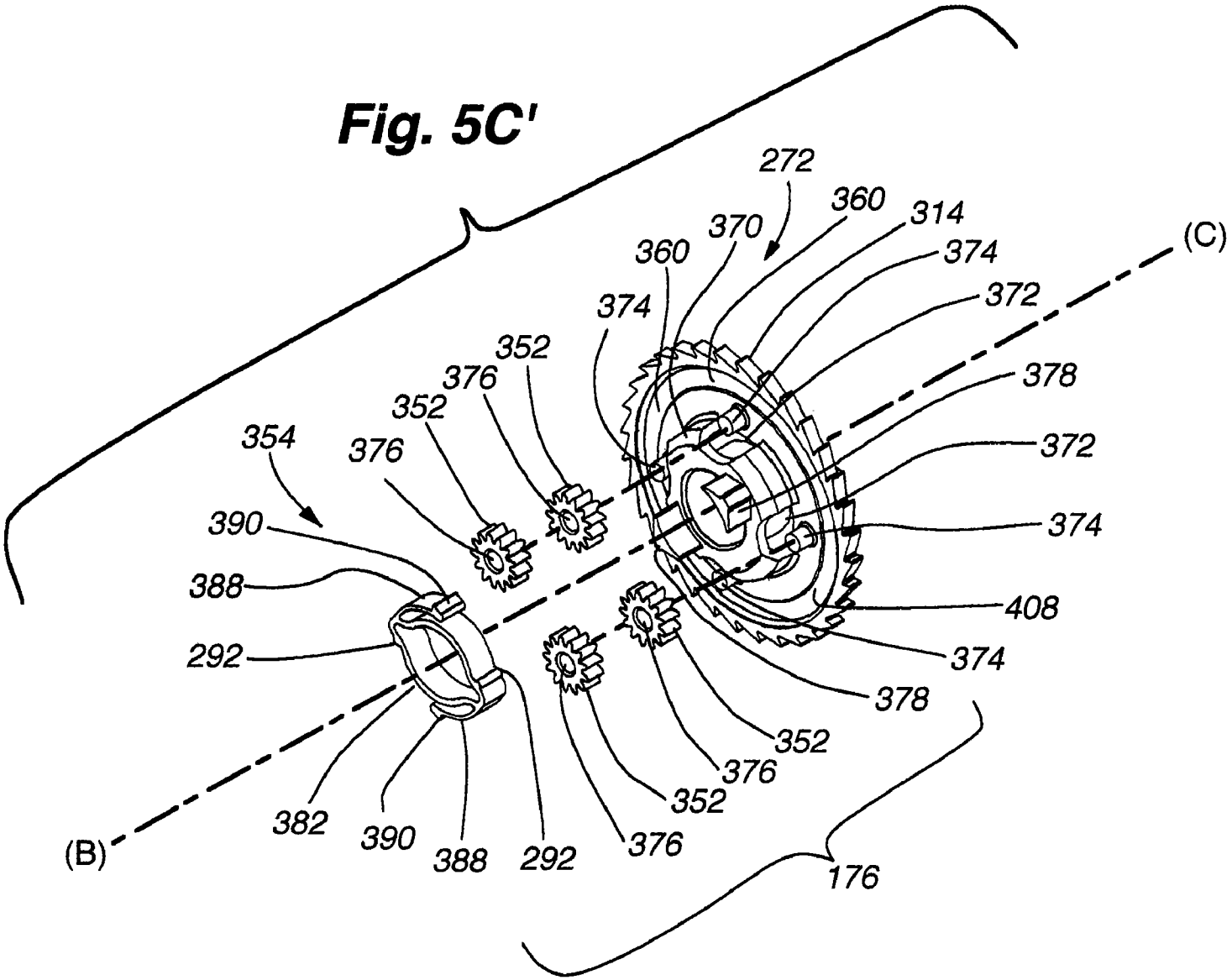
Figure 5M:
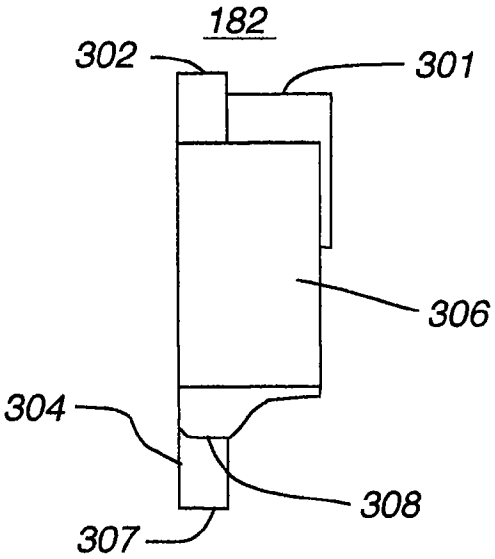
FIG. 5M is a front elevation of the shift arm depicted in FIG. 5D.
Figure 5E:
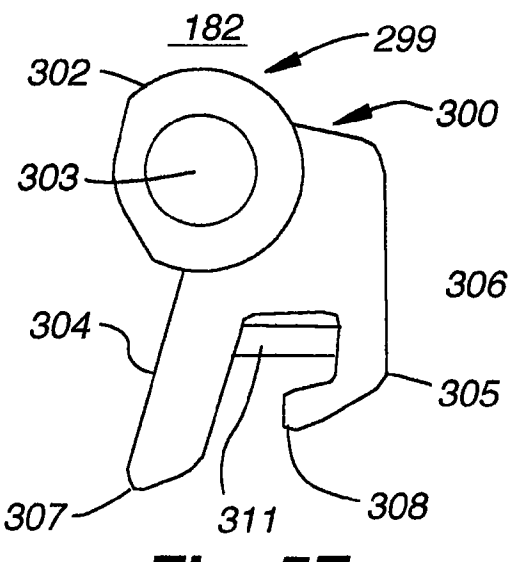
FIG. 5E is a left side elevation of the shift arm depicted in FIG. 5D.
Figure 5D:
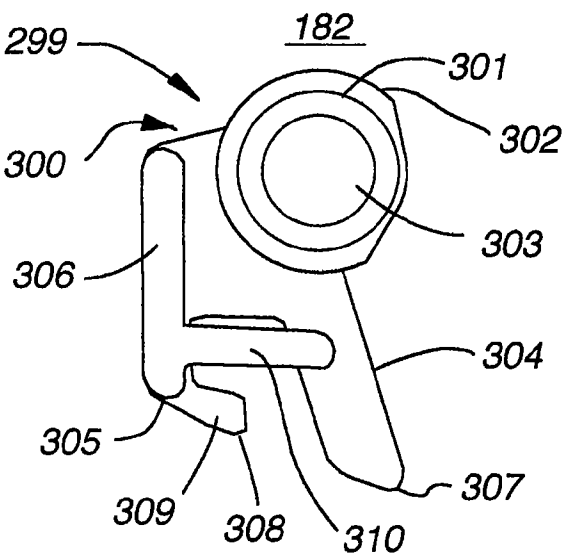
FIG. 5D is a right side elevation of a shift arm used in the control system depicted in FIG. 5C.
Figure 5N:
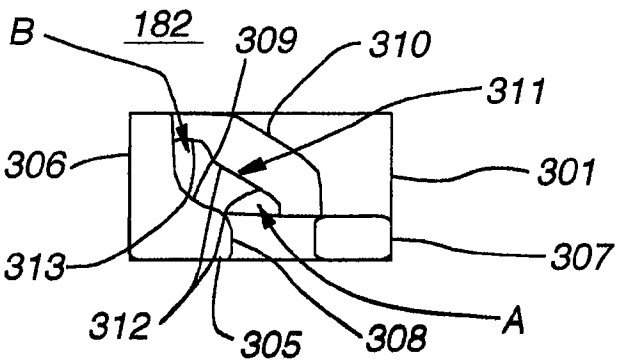
FIG. 5N is a bottom plan view of the shift arm depicted in FIG. 5D.
Figure 5H:
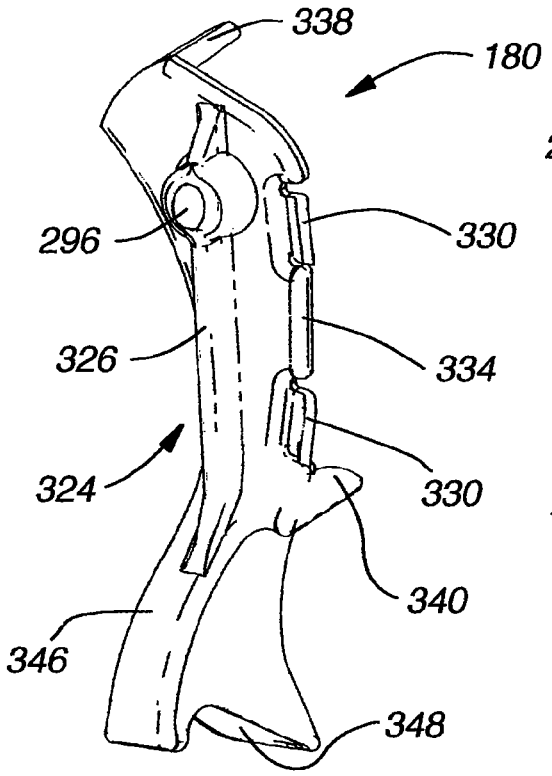
FIG. 5H is an isometric view of left side of a cord guide arm.
Figure 5G:
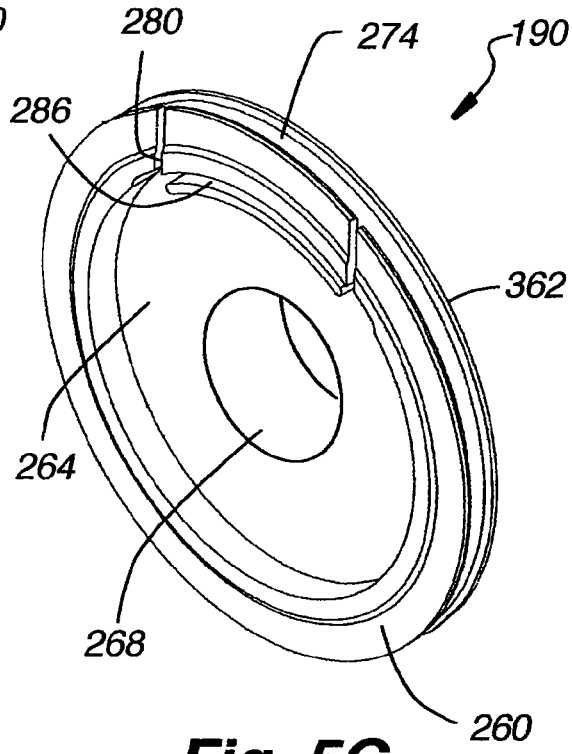
FIG. 5G is a rear right-side isometric view of a cord spool used in the control system depicted in FIG. 5C.
Figure 5F:
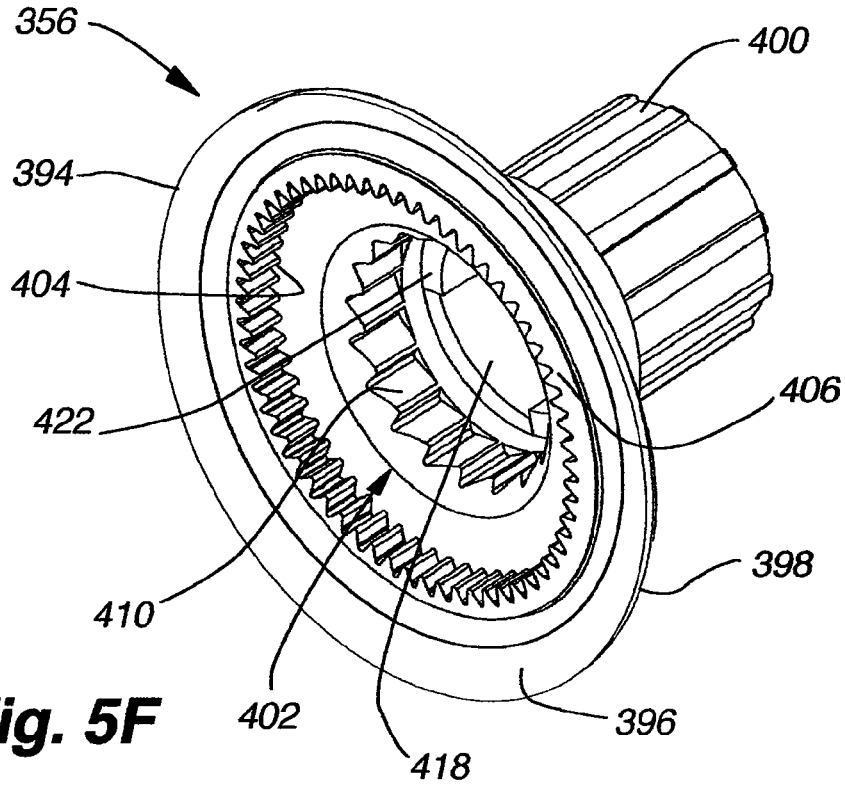
FIG. 5F is a rear right-side isometric view of a ring gear used in the control system depicted in FIG. 5B.
Figure 5J:
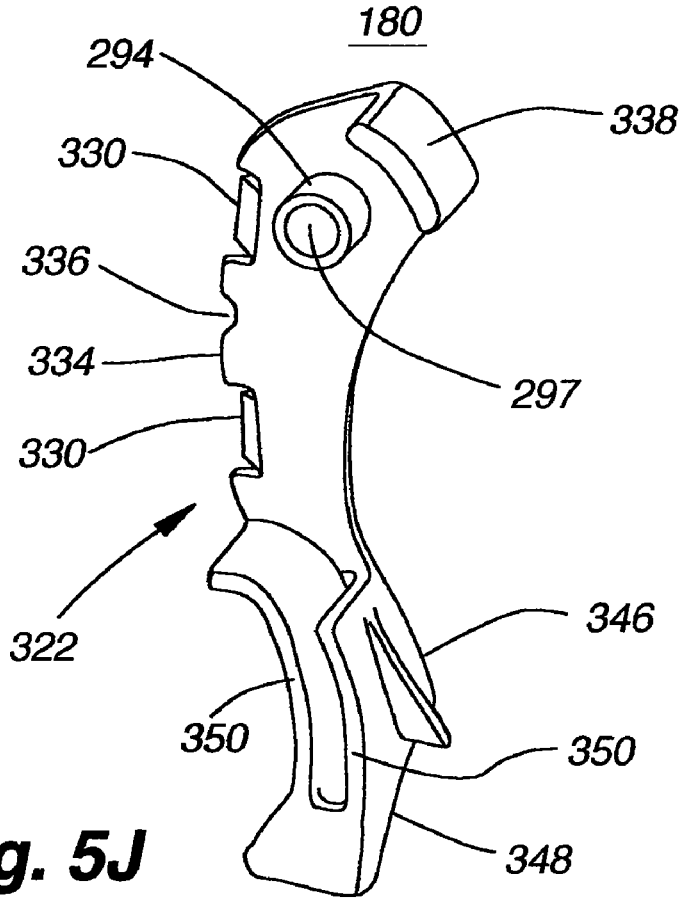
FIG. 5J is an isometric view of a right side of a cord guide arm.
Figure 5L:
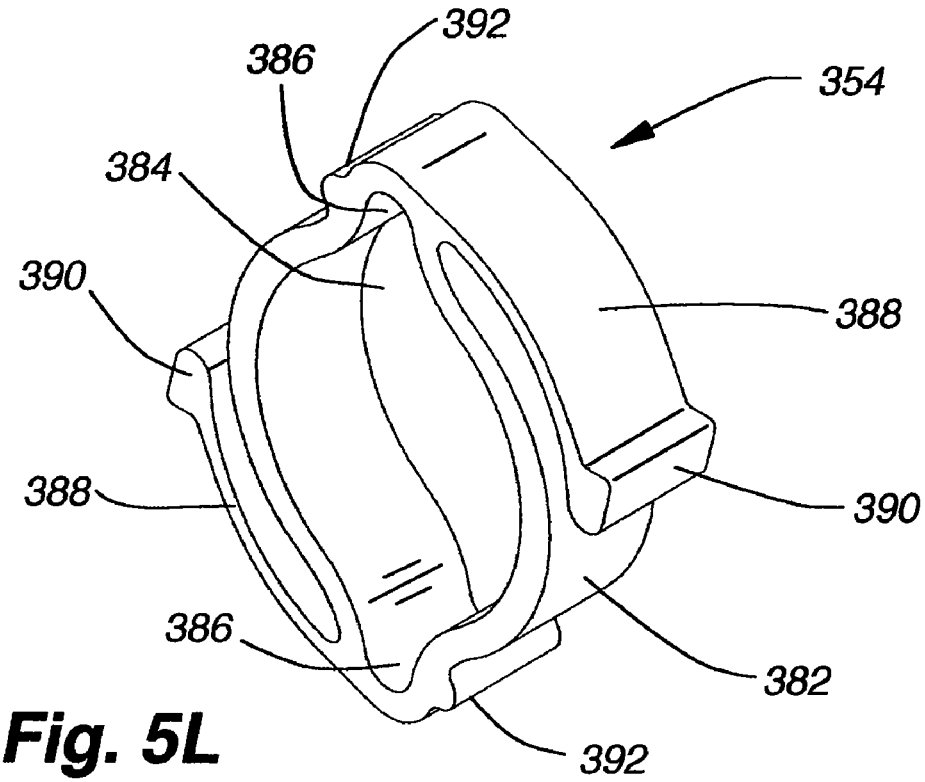
FIG. 5L is an isometric view of a spider.
Figure 5K:
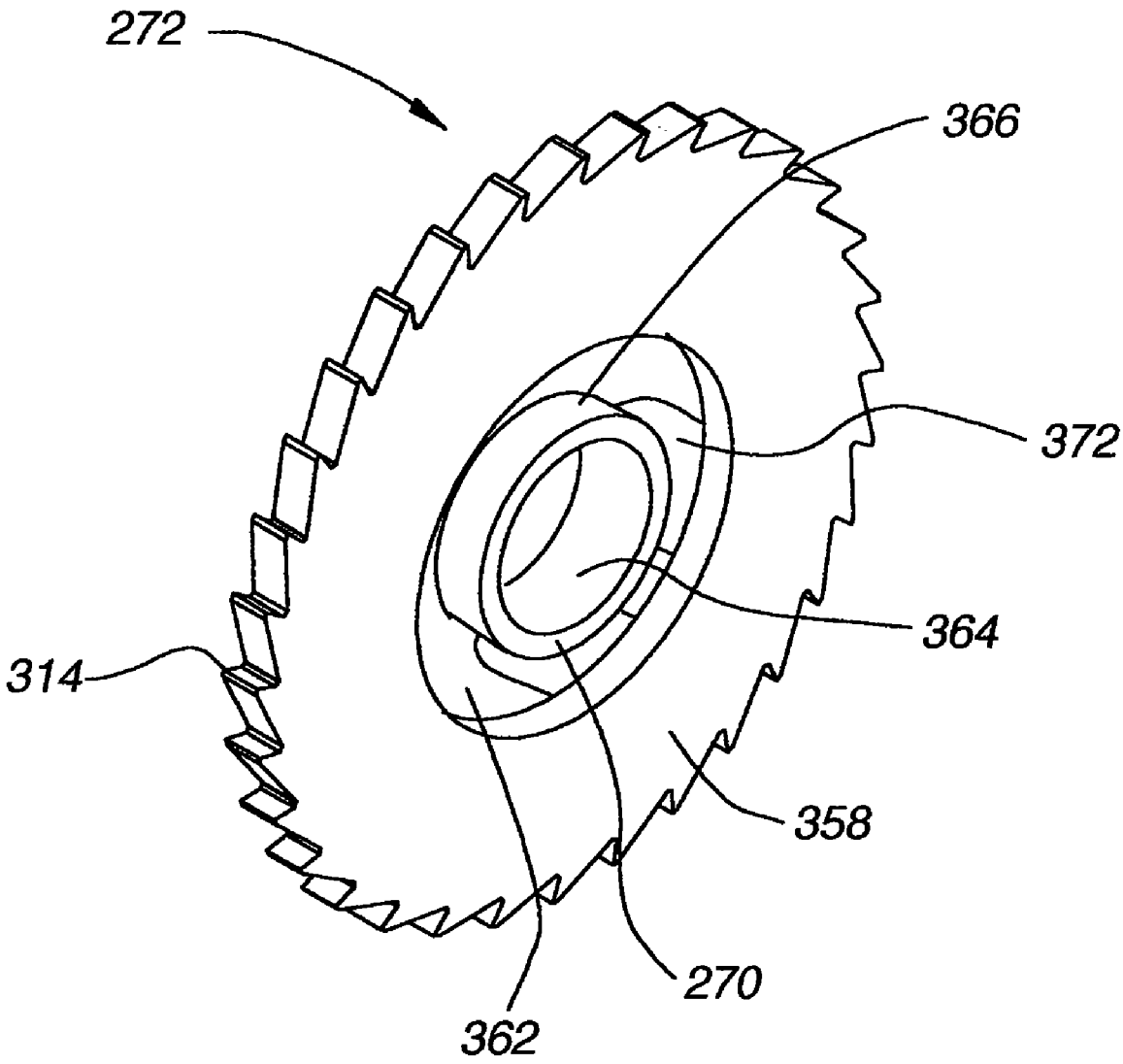
FIG. 5K is a front right-side isometric view showing a first side of a planet carrier.
Figure 5O:
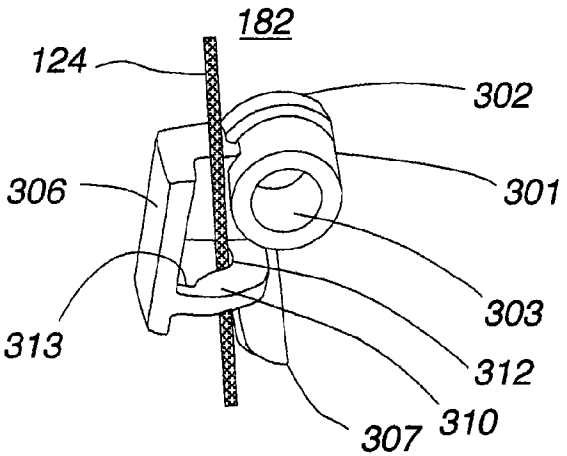
FIG. 5O is a front right-side isometric view of the shift arm depicted in FIG. 5D, wherein the operating cord has engaged a first cord engagement surface.
Figure 5Q:
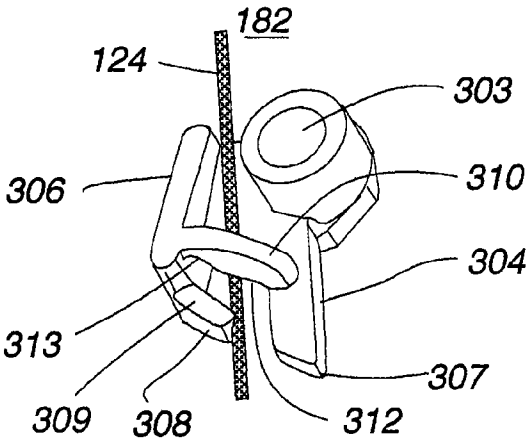
FIG. 5Q is a rear right-side isometric view of the shift arm depicted in FIG. 5D, wherein the operating cord has engaged a first cord engagement surface.
Figure 5P:
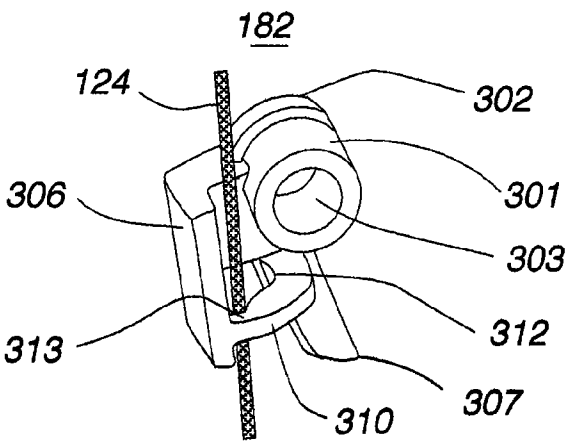
FIG. 5P is a front right-side isometric view of the shift arm depicted in FIG. 5D, wherein the operating cord has engaged a second cord engagement surface.
Figure 5R:
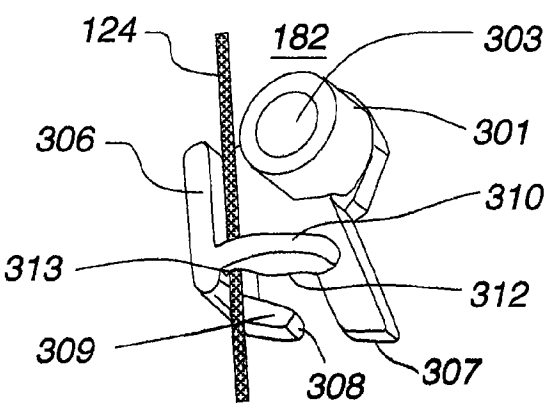
FIG. 5R is a rear right-side isometric view of the shift arm depicted in FIG. 5D, wherein the operating cord has engaged a second cord engagement surface.
Figure 6E:
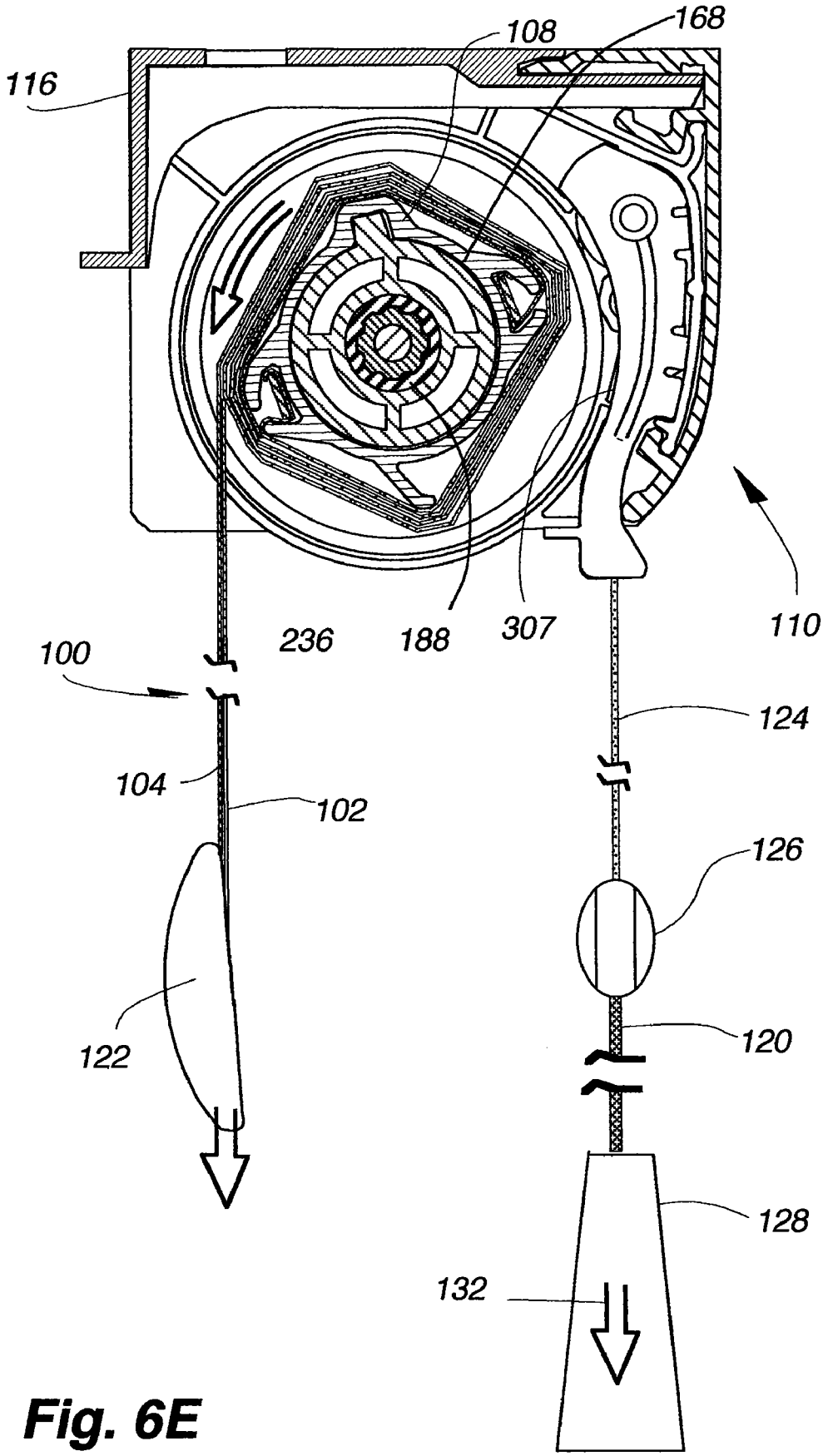
FIG. 6E is a cross-sectional view of the control system depicted in FIG. 6, taken along line 6E-6E illustrating operation of lowering the covering.
Figure 6F:
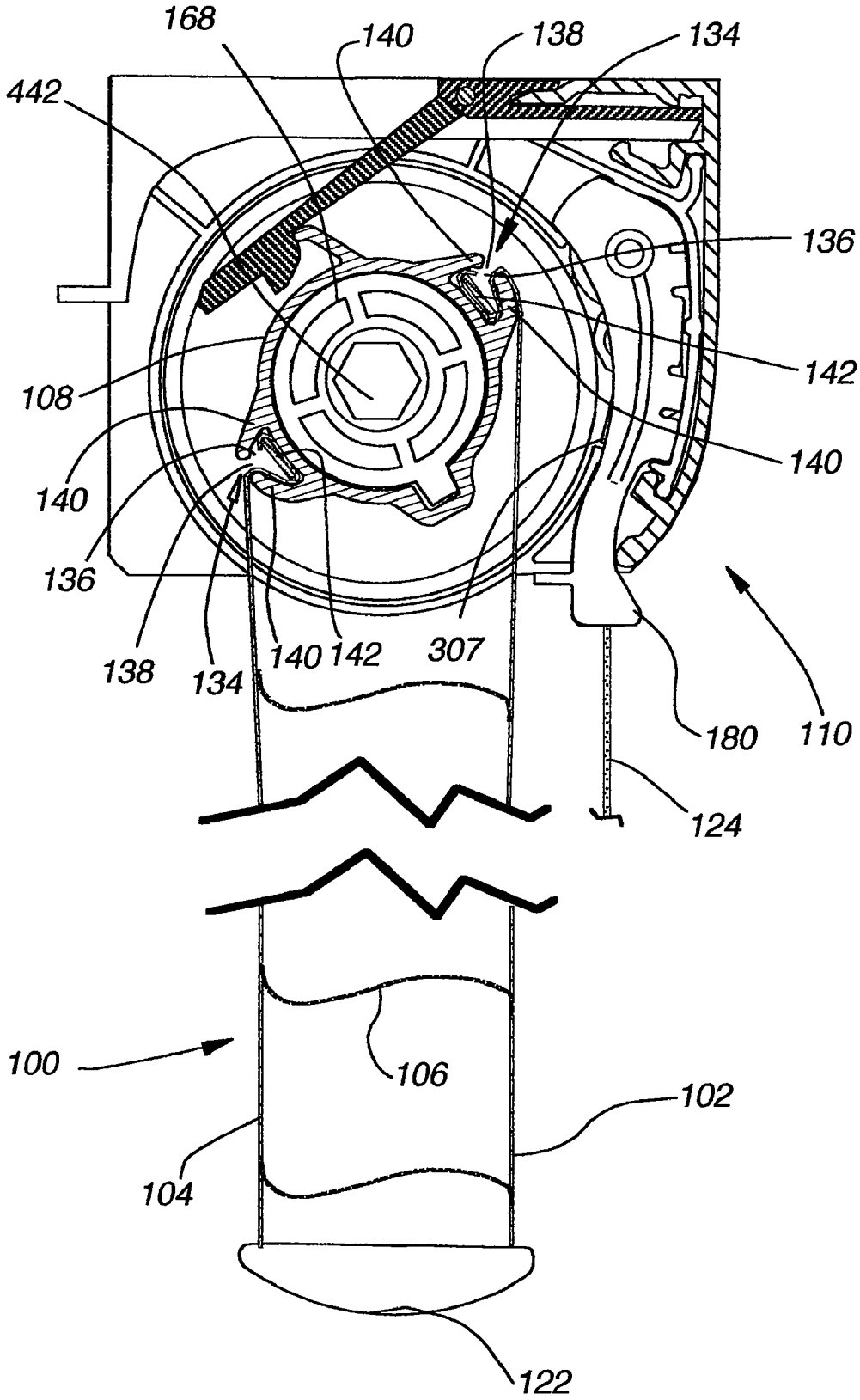
FIG. 6F is a cross-sectional view of the control system depicted in FIG. 6, taken along line 6F-6F showing the covering in a fully extended position.
Figure 6G:
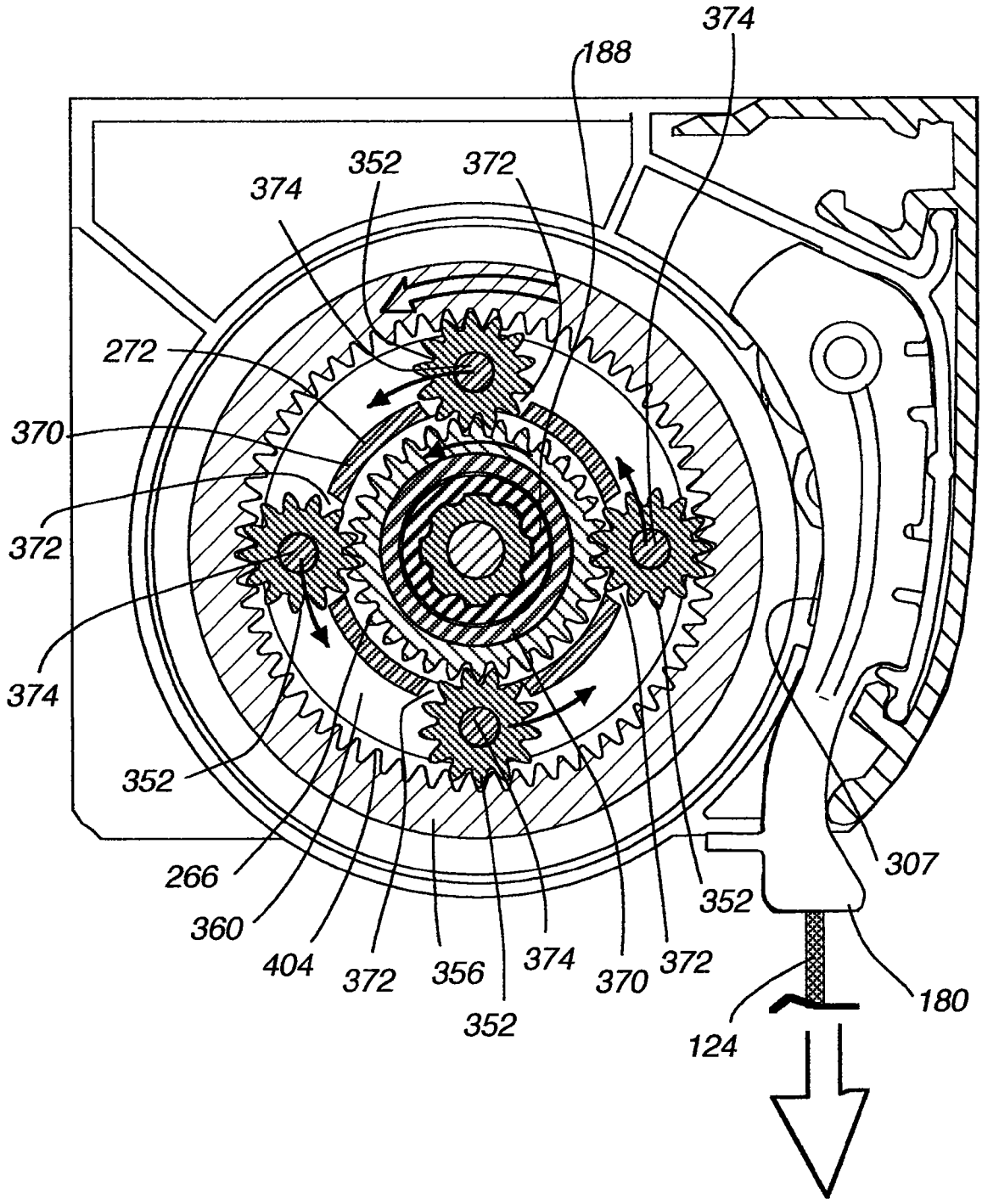
FIG. 6G is a cross-sectional view of the control system depicted in FIG. 6, taken along line 6G-6G.

As shown in FIGS. 6E and 6F, the first fabric sheet 102 and the second fabric sheet 104 are suspended from a head roller 108. As can be understood from FIGS. 1-5A, the head roller 108 is connected with a control system 110 and rotatably supported inside a head rail assembly 112. The head rail assembly 112 includes a left end cap 114 and a right end cap 116 connected with a front rail 118. A pull cord 120 is provided to allow a user to operate the control system 110 in order to raise or lower a bottom rail 122 of the covering 100. Operation of the control system 110 imparts rotational motion to the head roller 108, which in turn wraps the covering 100 onto the head roller 108 or unwraps the covering from the head roller, causing the bottom rail 122 to move up or down, respectively. As explained in more detail below, the pull cord 120 is connected to an operating cord 124 (see in FIGS. 2 and 3) through a stopper or coupler 126. Various types of stoppers or couplers 126 may be utilized. For example, the stopper or coupler 126 shown in FIGS. 2 and 3 is in the form of a releasable clasp 126. In another form, the stopper or coupler may be configured as a knot in the operating element. When the control system is not in use, the operating cord 124 is retracted inside the head rail assembly 112. A tassel 128 may be also provided to allow a user to more easily grasp the pull cord 120 when operating the control system 110.

c. Control System

Figure 7:
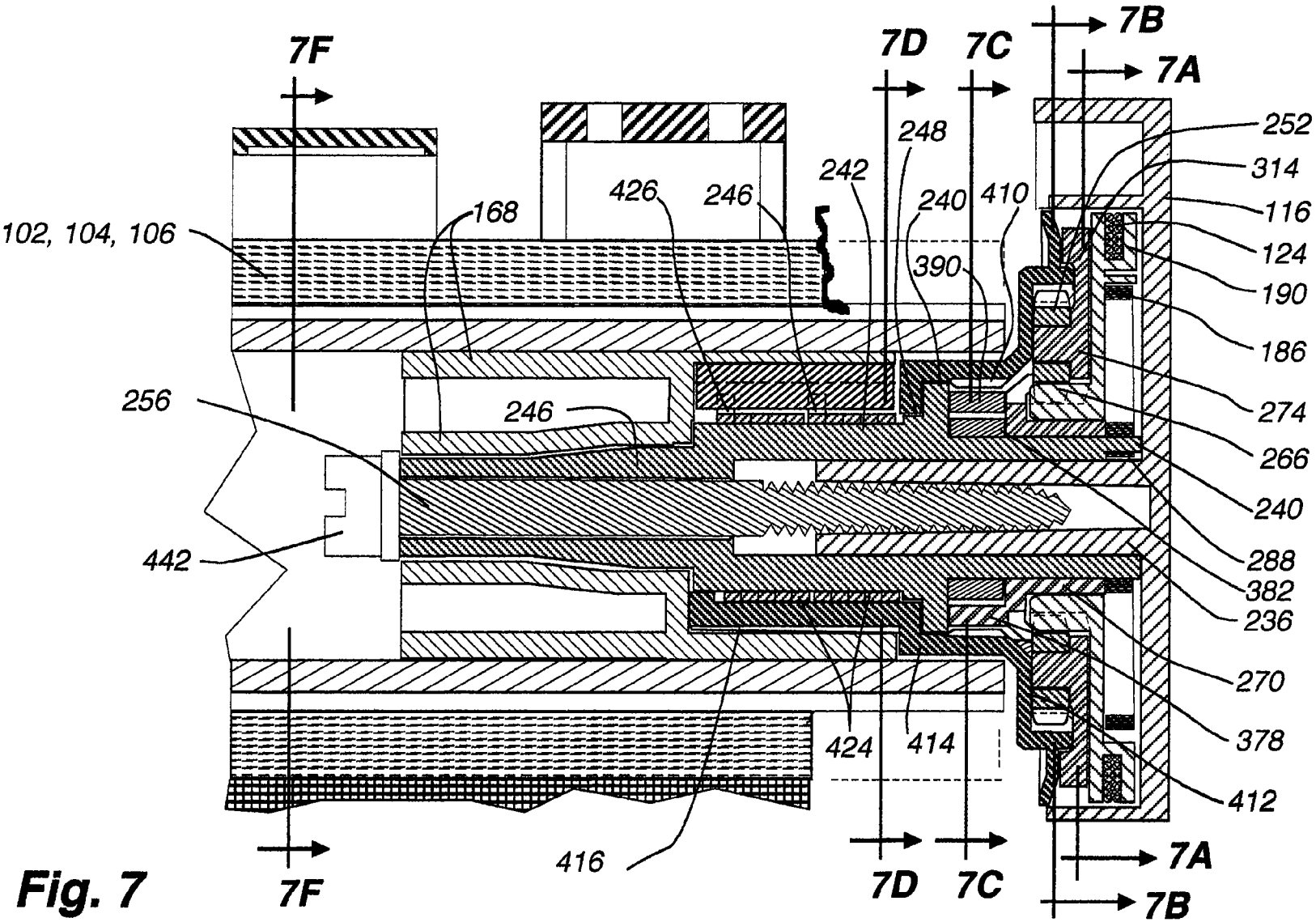
FIG. 7 is a cross-sectional view of the control system depicted in FIGS. 1 and 4 engaged to raise the window covering, taken along line 7-7.
Figure 7A:
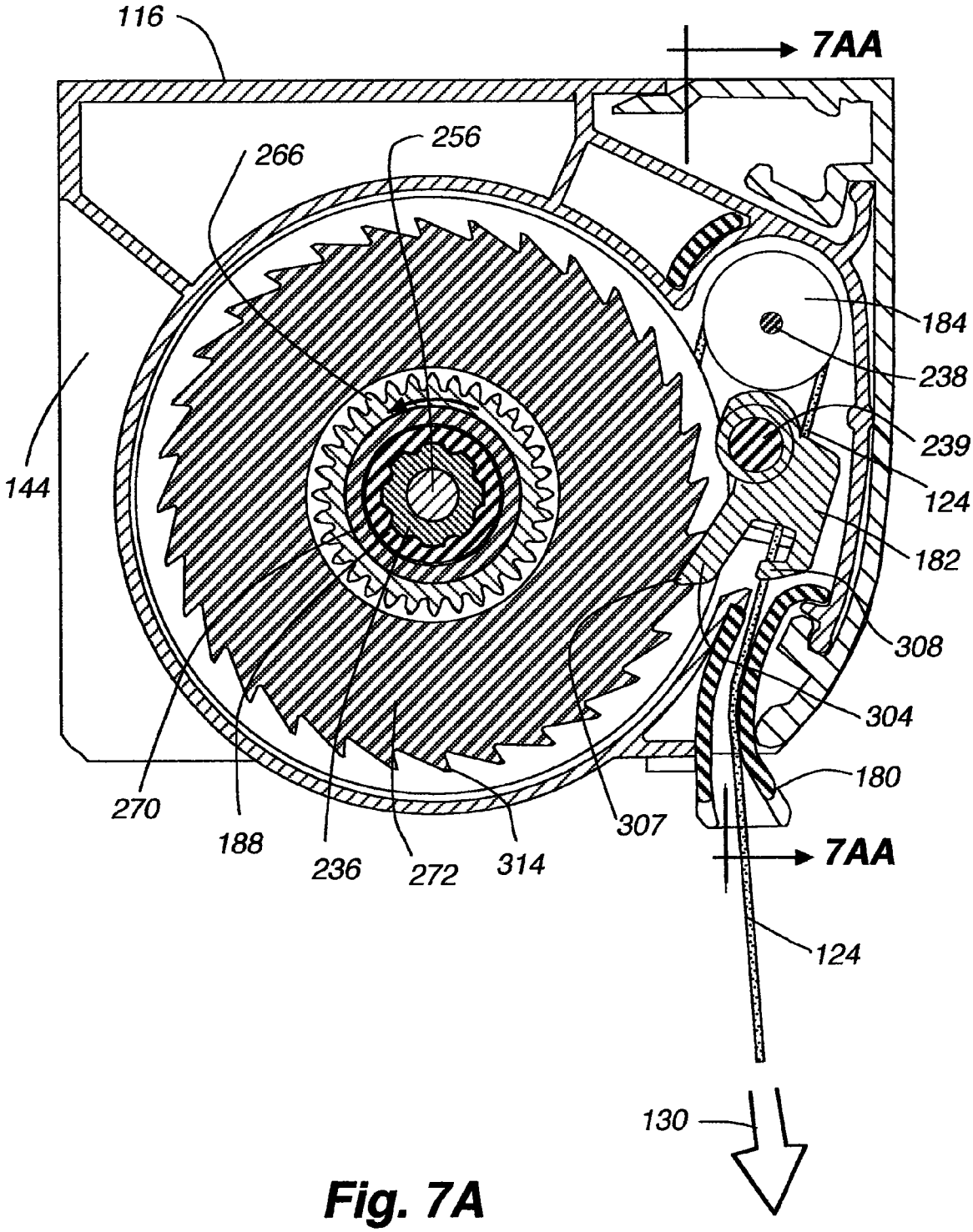
FIG. 7A is a cross-sectional view of the control system depicted in FIG. 7, taken along line 7A-7A.
Figure 7A:
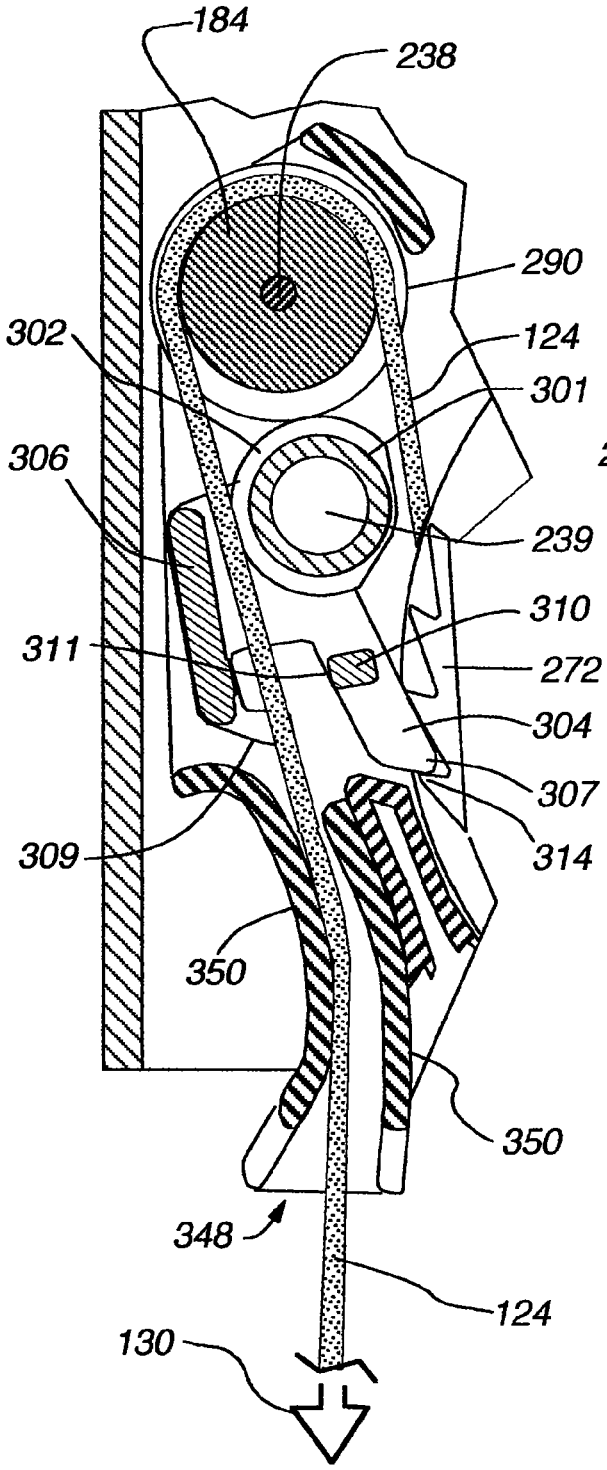
Figure 7A:
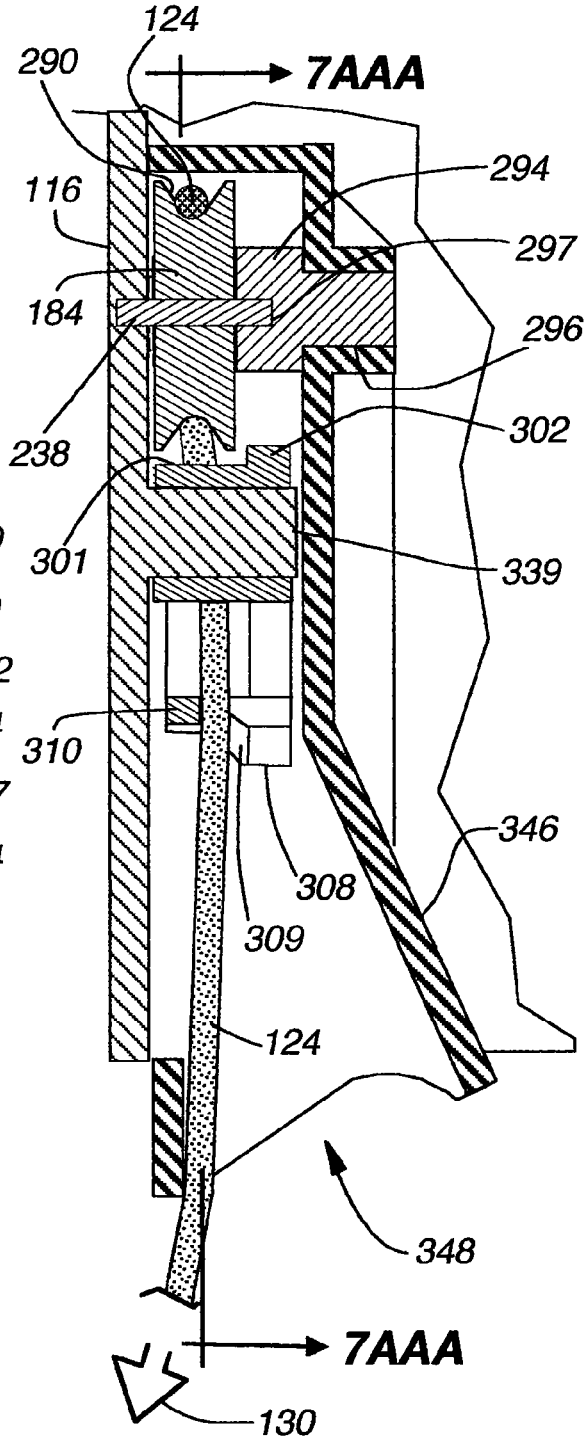
Figure 7B:
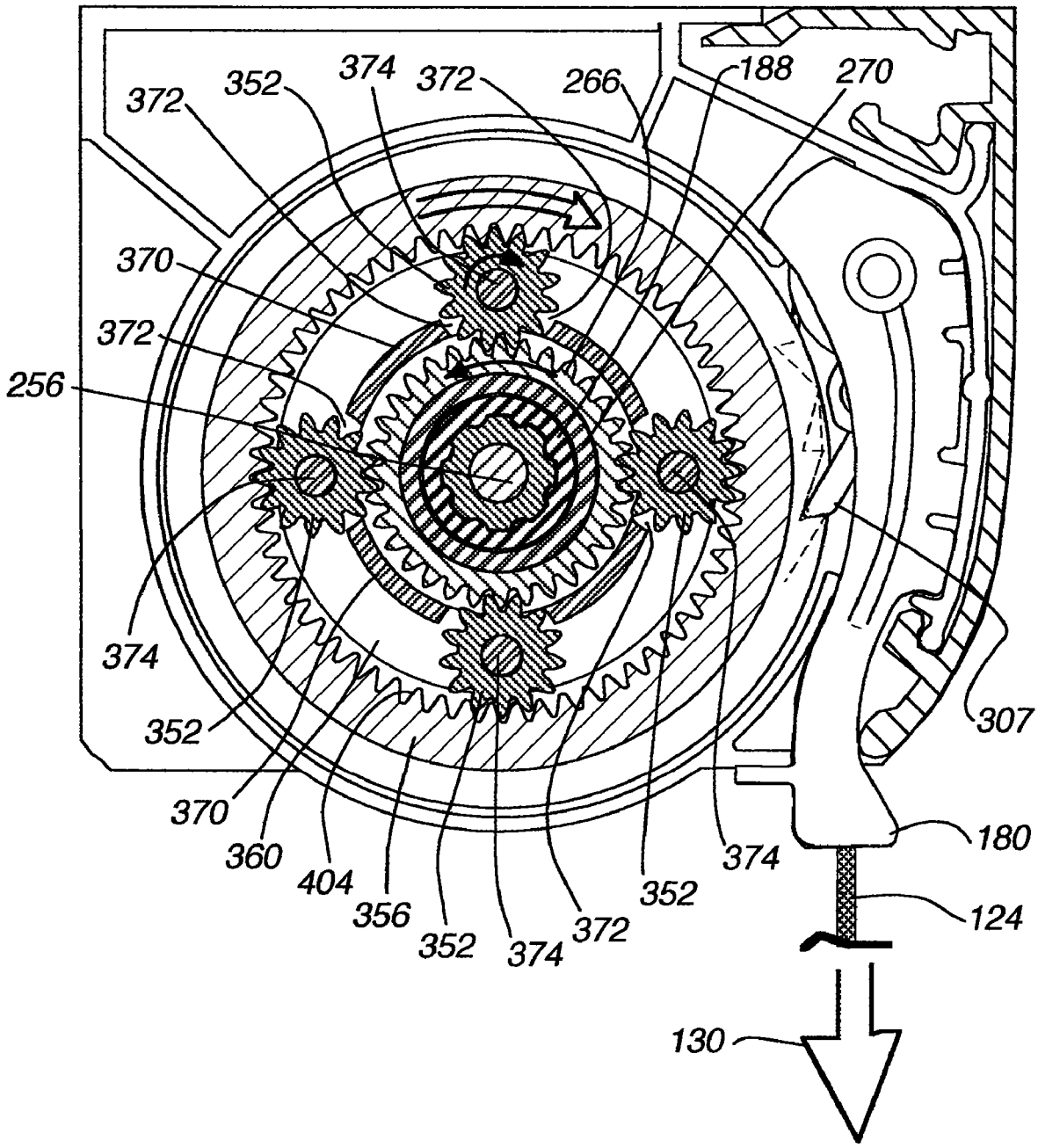
FIG. 7B is a cross-sectional view of the control system depicted in FIG. 7, taken along line 7B-7B.
Figure 7C:
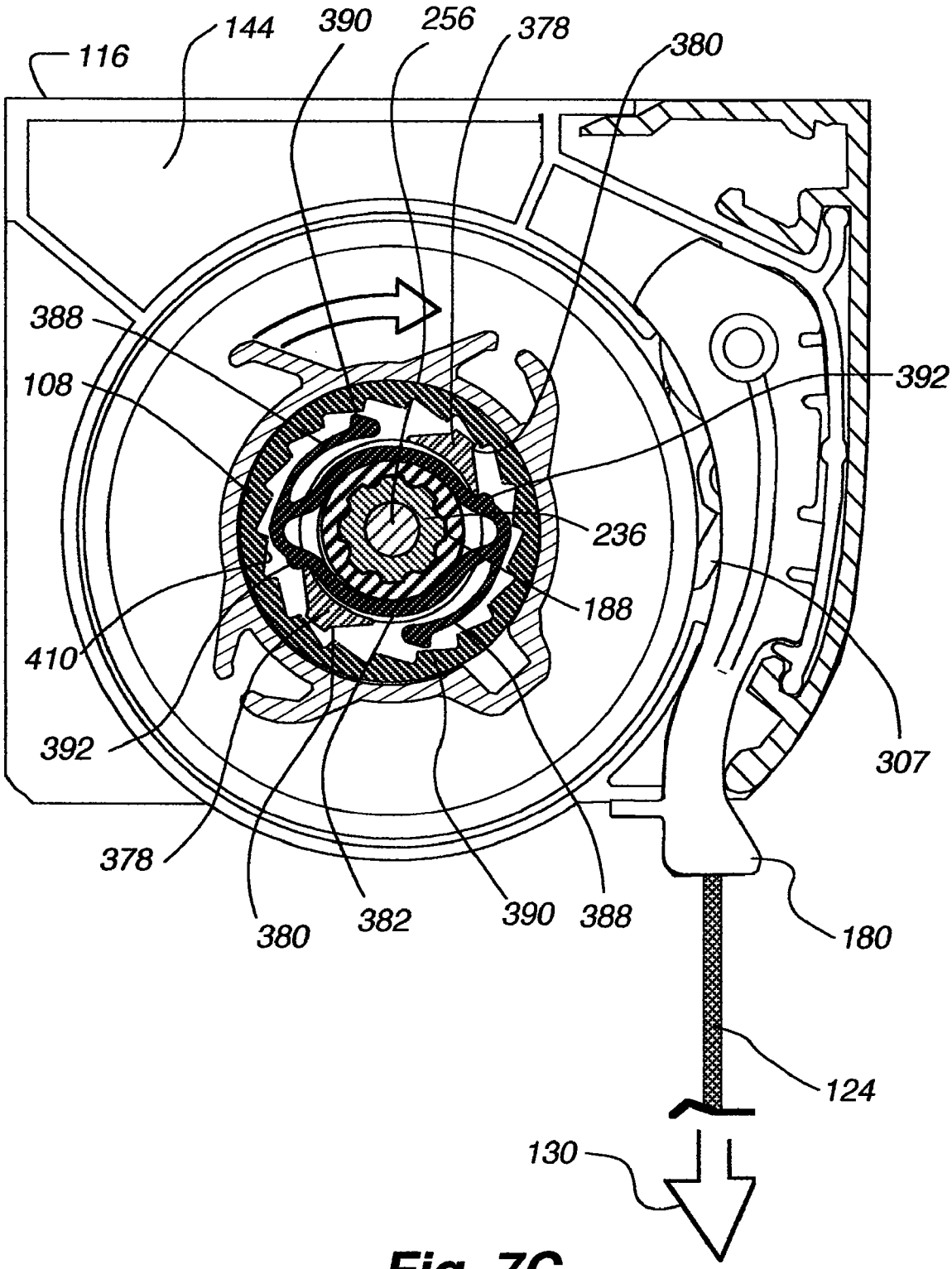
FIG. 7C is a cross-sectional view of the control system depicted in FIG. 7, taken along line 7C-7C.
Figure 7D:
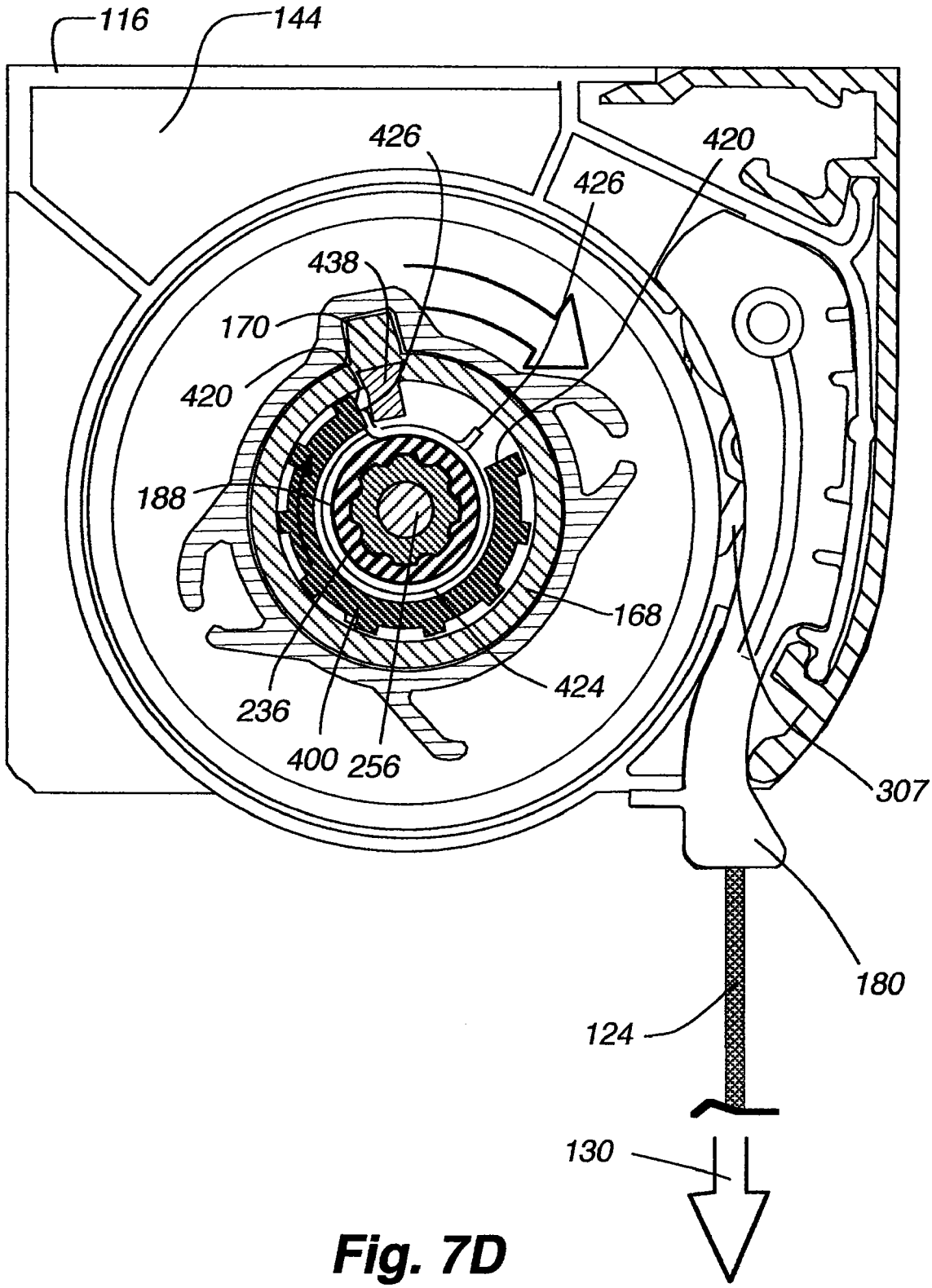
FIG. 7D is a cross-sectional view of the control system depicted in FIG. 7, taken along line 7D-7D.
Figure 7E:
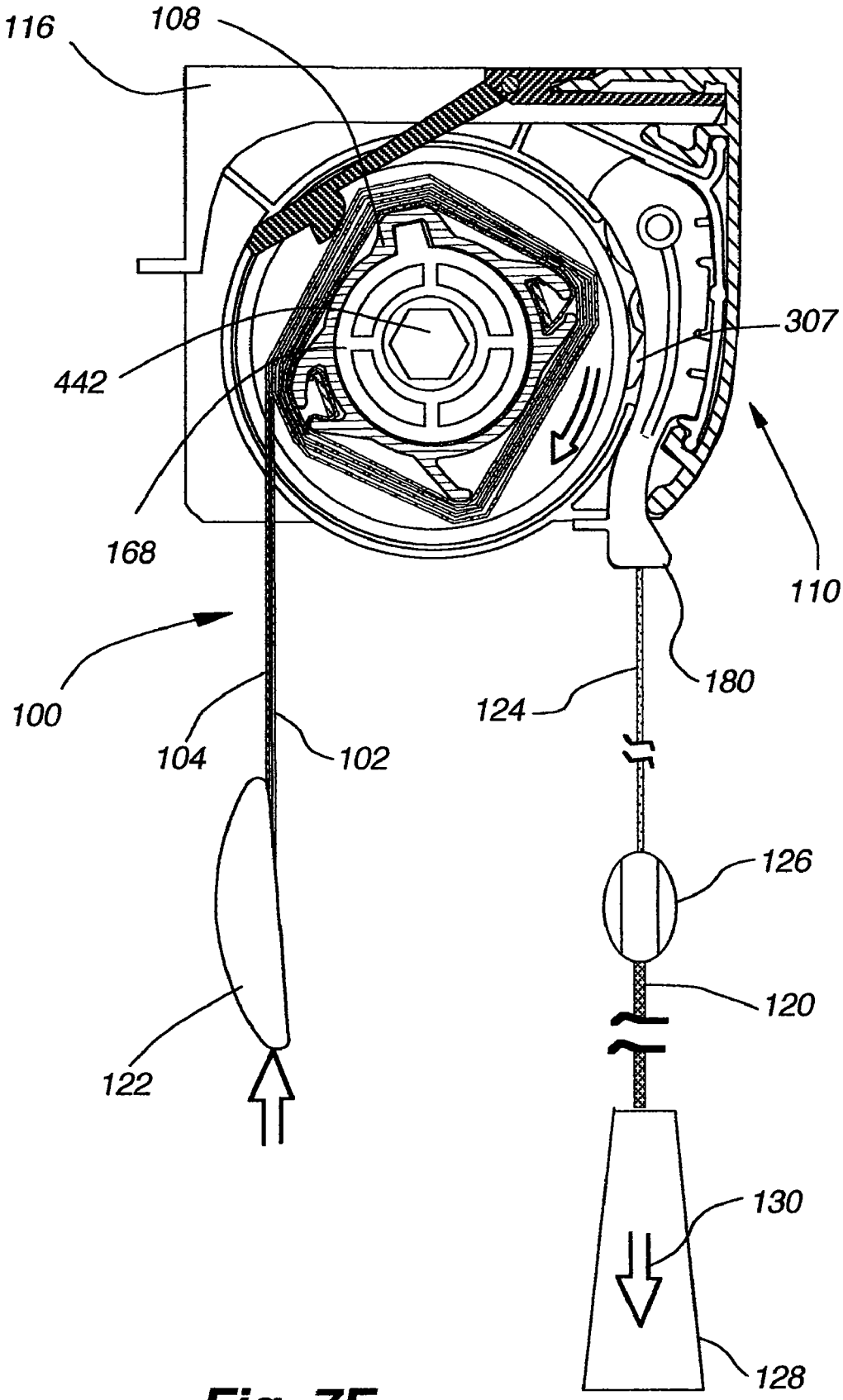
FIG. 7E is a cross-sectional view of the control system depicted in FIG. 7, taken along line 7E-7E illustrating operation of raising the covering.
Figure 7F:
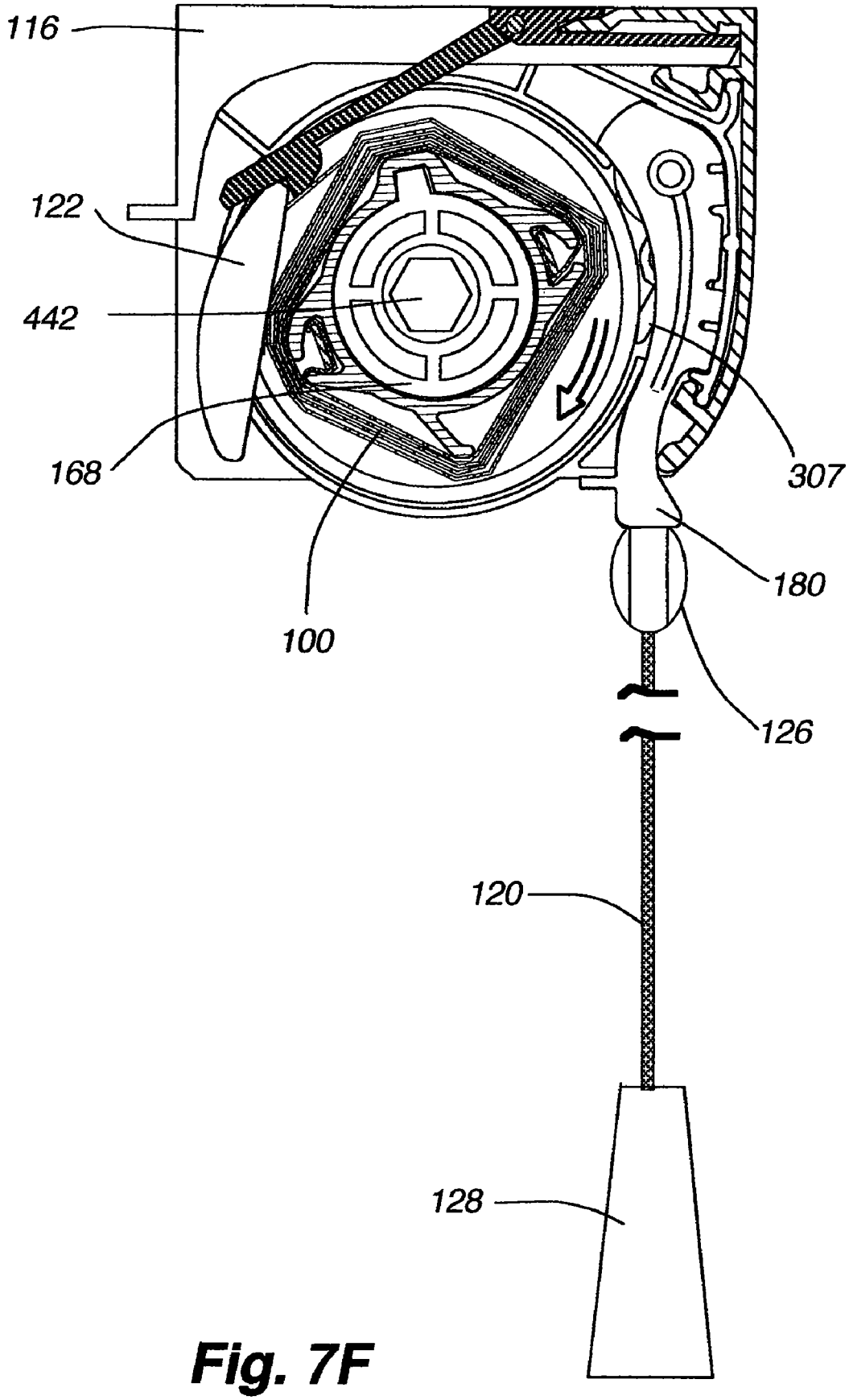
FIG. 7F is a view of the control system and covering depicted in FIG. 7E showing the covering in a fully retracted position.

FIGS. 2, 7E, and 7F illustrate how the control system 110 is operated to raise the covering 100, and FIGS. 3, 6E and 6F illustrate how the control system 110 is operated to lower the covering 100. Direction of movement of the covering, either upward or downward, is dictated by the generally downward direction in which the user pulls on the pull cord 120. More particularly, the downward direction in which the user pulls on the pull cord 120, which can be selectively angled, causes the control system 110 to engage and rotate the head roller 108 to either wrap or unwrap the covering 100, which causes the bottom rail 122 to move up or down, respectively. In addition, the control system 100 allows a user to repeatedly pull on the pull cord 120 in the same downward direction to place the covering in a desired position.

In a first embodiment, as shown in FIGS. 1-3, the control system 110 is located on the right end cap 116. However, in a second embodiment, the control system 110 is located on the left end cap 114. The following discussion of the subject invention will be made in reference to the first embodiment depicted in FIGS. 1-3, wherein the control system 110 is located on the right end cap 116. With respect to the second embodiment, wherein the control system 110 is located on the left end cap 114, those skilled in the art will understand that the configuration and operation of the second embodiment is identical to those of the first embodiment, except physical orientation and operational movement of the second embodiment are the mirror image of the physical orientation and operational movement of first embodiment.

In order to raise the covering 100, as shown in FIGS. 2, 7E, and 7F, a user grasps the pull cord 120 and pulls downwardly in a vertical direction with respect to the head rail assembly 112. The user may also pull downwardly in a slightly right angled diagonal direction to move the covering in the upward direction. As discussed in more detail below, by pulling downwardly either vertically or in the slightly right angled diagonal direction, both referred to as an upward operating pull direction 130, the control system 110 engages to rotate the head roller 108 in a direction to raise the covering 100. As the user pulls on the pull cord 120 in the upward operating pull direction 130, the operating cord 124 is pulled from the control system 110 housed in the head rail assembly 112. The distance a user may pull the pull cord 120 and operating cord 124 is limited by the length of the operating cord. Once the user releases the pull cord, the control system automatically retracts the operating cord back into the head rail assembly until the stopper or coupler 126 abuts the head rail assembly.

As shown in FIGS. 2, 7E, and 7F, the upward distance the bottom rail 122 moves is dictated by the distance the pull cord 120 and operating cord 124 are pulled, the rotational mechanical advantage provided by the control system 110, and the diameter of the head roller 108. The mechanical configuration of the control system 110 and the diameter of the head roller 108 combine to determine the upward distance the covering moves in response to a distance that the operating cord is pulled. As such, in one embodiment, the control system mechanical configuration and the head roller diameter combined to provide increased mechanical advantage and reduced speed when raising the covering and increased speed in the downward direction when operating force requirements are less. For example, as shown in FIG. 2, the control system configuration and the head roller diameter are such that they provide a 2:1 mechanical advantage. As a result, in order to move the covering an upward distance of "X," the operating cord 124 must be pulled a distance of "2X ." As can be understood by those skilled in the art, a wide range of other mechanical advantages are possible depending on the combination of the control system mechanical configuration and the head roller diameter.

Once the bottom rail 122 is raised to the desired position, the user may release the pull cord 120. Upon release of the pull cord, the operating cord is automatically retracted into the head rail assembly 112 by the control system 110. The control system also includes a braking feature to hold the covering in position once the user releases tension from the pull cord. If the user pulls the pull cord such that the operating cord is extended to its full length, and the bottom rail does not move the desired distance upward, the user can allow the operating cord to retract into the head rail and then pull again on the pull cord to continue raising the bottom rail 122. This process can be repeated until the bottom rail 122 has reached the desired position.

In order to lower the covering, as shown in FIGS. 3, 6E, and 6F, a user grasps the pull cord 120 and pulls downward in a slightly left angular diagonal direction to move the covering in the downward direction, also referred to as the downward operating pull direction 132. As discussed in more detail below, by pulling in the downward operating pull direction 132, the control system 110 engages to rotate the head roller 108 in a direction to lower the covering. As the user pulls on the pull cord in the downward operating pull direction 132, the operating cord 124 is pulled in unison from the control system 110 housed in the head rail assembly 112. The distance a user may pull the pull cord 120 and operating cord 124 is limited by the length of the operating cord, and the control system automatically retracts the operating cord back into the head rail assembly until the stopper or coupler 126 abuts the head rail assembly once the user releases the pull cord.

As shown in FIGS. 3, 6E, and 6F, the downward distance the bottom rail 122 moves is dictated by the distance the pull cord 120 and operating cord 124 are pulled, the mechanical advantage provided by the control system 110, and the diameter of the head roller 108. As similarly described above with reference to upward movement of the covering, the mechanical configuration of the control system 110 and the diameter of the head roller 108 combine to determine the downward distance the covering moves in response to a distance that the operating cord is pulled. For example, as shown in FIG. 3, the control system configuration and the head roller diameter are such that they provide a 1:1 mechanical advantage. As a result, in order to move the covering a downward distance of "Y," the operating cord 124 must be pulled a distance of "Y." As can be understood by those skilled in the art, a wide range of other mechanical advantages are possible depending on the combination of the control system mechanical configuration and the head roller diameter. Also, the present invention can be configured to provide identical or different mechanical advantages for upward and downward movement of the covering 100.

Once the bottom rail 122 is lowered to the desired position, the user may release the pull cord 120. Upon release of the pull cord, the operating cord 124 is automatically retracted into the head rail assembly 112 by the control system 110. The control system's braking feature mentioned above holds the covering in position once the user releases tension from the pull cord. If the user pulls the pull cord such that the operating cord is extended to its full length and the bottom rail does not move the desired distance downward, the user can allow the operating cord to retract into the head rail and then pull again on the pull cord to continue lowering the bottom rail. This process can be repeated until the bottom rail has reached a desired position.

d. Head Roller and Covering Connected Thereto

Figure 4:
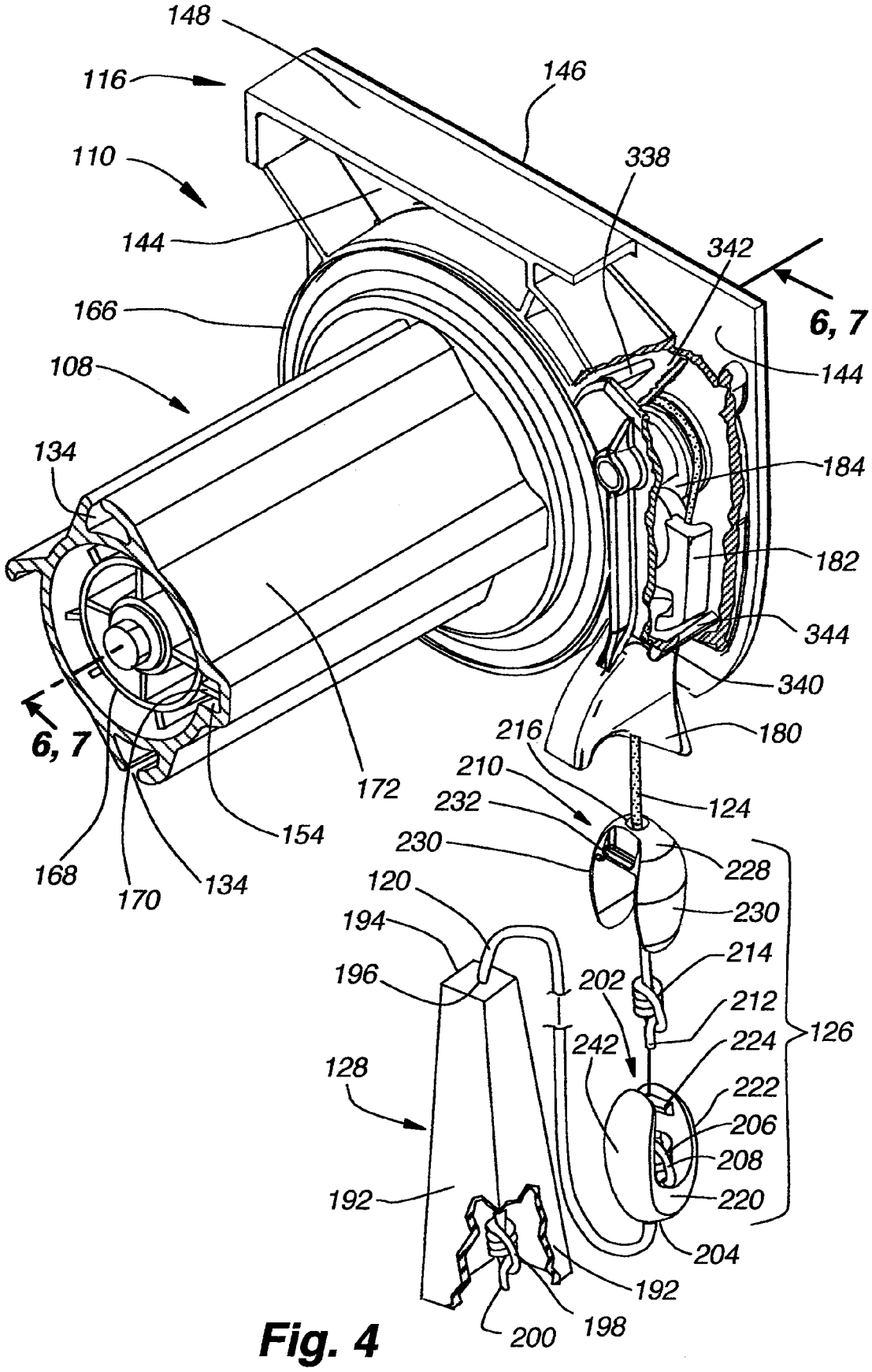
FIG. 4 is an isometric view of a control system for the covering according to one embodiment of the present invention mounted on a right end cap and connected with a head roller of the covering.

As previously mentioned, the covering 100 is connected with the head roller 108, and depending upon which direction the head roller rotates, the covering 100 is either wrapped onto the head roller 108 or unwrapped from the head roller 108. As shown in FIGS. 4, 5A, and 6F, the head roller 108 is hollow and generally tubular-shaped. The head roller is provided with two exterior channels 134.

As illustrated in FIG. 6F, each exterior channel 134 has a wide inner space 136 and a narrow opening 138 defined by opposing walls 140 on the outer surface of the head roller 108. Each exterior channel 134 extends longitudinally along the entire length of the head roller 108. The first fabric sheet 102 and the second fabric sheet 104 of the covering 100 are provided with flat strips 142 adapted to fit inside the wide inner spaces 136 of the exterior channels 134 and held in position by walls 140 of the exterior channels 134. The flat strips 142 can be made from stiff material, such as metal or plastic.

The first fabric sheet 102 and the second fabric sheet 104 are connected with the head roller 108 by sliding the flat strips 142 into the exterior channels 134 from either end of the head roller 108, such that the first fabric sheet 102 and the second fabric sheet 104 exit the exterior channels 134 through the narrow opening 138. It is to be appreciated that the head roller 108 and the covering 100 may utilize various configurations to connect the head roller with the covering. For example, other such configurations are described in U.S. Pat. No. 5,320,154, which is hereby incorporated in its entirety as if fully disclosed herein.

e. Head Rail Assembly

As shown in FIGS. 4 and 5A, the left end cap 114 and the right end cap 116 fasten to cut edges of the front rail 118. The left end cap 114 and the right end cap 116 also have an inner side 144 and outer side 146. Extended edges 148 extend perpendicularly from the inner sides 144 of the left end cap 114 and the right end cap 116 and are adapted to be press fit into slots located on the front rail 118. It is to be appreciated that extended edges may be configured differently for various shaped front rails. The head roller 108 is supported from the head rail assembly 112 (shown in FIG. 1) by the control system 110 connected with the right end cap 116 and a cylindrical extension 150 rotatably connected with the left end cap 114. Although the present invention is depicted and described with the control system connected with the right end cap, it is to be appreciated that the control system may also be connected with the left end cap in other arrangements of the invention.

f. Head Roller Support

Referring to FIG. 5A, the cylindrical extension 150 is supported on a rotatable left end cap shaft (not seen) extending from the inner side 144 of the left end cap 114 through an extension aperture 152 located in the cylindrical extension 150. A fastener (not shown) passing into the extension aperture 152 may be used to secure the cylindrical extension 150 to the left end cap shaft. As such, the cylindrical extension 150 can freely rotate either clockwise or counterclockwise. A longitudinal inner groove 154 is located on the inner wall 156 of the head roller 108 and extends the entire length of the head roller. Two longitudinal spaced ridges 158 on the exterior surface 160 of the cylindrical extension 150 are adapted to be received in the longitudinal inner groove 154 on a left end portion 162 of the head roller 108. As such, the cylindrical extension 150 rotates along with the head roller 108. The cylindrical extension 150 is also provided with two radially extending tabs 164 to prevent the flat strips 142 (see FIG. 6F) from moving longitudinally inside the exterior channels 134 on the head roller 108.

As shown in FIGS. 4, 5C and 5C', and discussed in more detail below, a circular recess 166 is located on the inner side 144 of the right end cap 116 for receiving a portion of the control system 110. As illustrated in FIGS. 4 and 5B, a rotator spool 168, as will be described in more detail later and having rotation controlled by the control system 110, includes a longitudinal fin 170 located on its exterior adapted to cooperatively engage the longitudinal inner groove 154 at a right end portion 172 of the head roller 108. As such, rotation of the rotator spool 168 causes the head roller 108 to rotate.

g. Control System Assembly Structure Overview

As can be understood from FIGS. 4, 5B, 5C and 5C', the control system 110 includes an input assembly 174, a transmission 176, and an output assembly 178 cooperatively engaging to convert linear movement of the pull cord 120 imparted by a user into rotational movement of the head roller 108 in the required direction to provide movement of the covering 100 in the desired direction and distance. The input assembly 174 converts linear movement of the pull cord 120 into rotational movement, which is imparted to the transmission 176. The input assembly 174 also engages the transmission 176 to effect the direction of rotational output from the transmission 176. The transmission 176, in turn, imparts rotational movement to the output assembly 178. The output assembly 178 interfaces with the head roller 108 to rotate the head roller in the direction dictated by the transmission 176 and to provide the braking feature that holds the head roller in position. It is to be appreciated that rotational movement transferred between the input assembly, the transmission, and output assembly may be accomplished with any suitable motion transfer elements, such as a gears and couplings. It is to be appreciated that the components described herein may be constructed from various materials. For example, some embodiments of the present invention utilize materials having the low flexible modulus characteristics of a thermoplastic elastomer polymer. Another embodiment utilizes high density polyethylene.

A detailed structural description of the input assembly 174 is provided below, followed by detailed descriptions of the transmission 176 and the output assembly 178. To assist in better understanding the structural details of the control system, reference is made throughout to the various figures depicting the control system in disassembled and assembled states. For instance, FIGS. 5B, 5C and 5C' show an exploded isometric view of the control system. FIG. 6 is a cross-sectional view of the assembled control system engaged to lower the window covering, taken along line 6-6 in FIGS. 1 and 4. FIGS. 6A-6G depict various cross sectional views taken along the length of the control system depicted in FIG. 6. FIG. 7 is a cross-sectional view of the assembled control system engaged to raise the covering, taken along line 7-7 in FIGS. 1 and 4. FIGS. 7A-7F depict various cross sectional views taken along the length of the control system depicted in FIG. 7. Descriptions of the rotations of various components of the control system (i.e. clockwise or counterclockwise) are always based on the reference point of looking toward the inner side 144 of the right end cap 116.

h. Input Assembly Overview

The structure and operation of the input assembly 174 will now be discussed in detail. As shown in FIGS. 4, 5B, 5C and 5C', the input assembly 174 includes the pull cord 120 connected with the operating cord 124 through the stopper or coupler 126, a cord guide arm 180, a shift arm 182, a cord pulley 184, a clock spring 186, an axle 188, and a cord spool 190, all cooperatively engaging to convert linear movement of the pull cord 120 into a rotational movement of the cord spool 190, which is imparted to the transmission 176. As discussed in more detail below, the operating cord 124 extends from the stopper or coupler 126 and passes through the cord guide arm 180, the shift arm 182, and the pulley 184 from where it is wrapped around the cord spool 190. As a user pulls on the pull cord 120 to move the covering 100 in the desired direction, the operating cord 124 is unwound from the cord spool 190. As will be described in detail later, after the user releases tension from the pull cord 120 and operating cord 124, the clock spring 186, cord spool 190, and axle 188 cooperatively engage to automatically wind the operating cord 124 back onto the cord spool 190. The operating cord 124 is automatically retracted to a point where the stopper or coupler 126 abuts the cord guide arm 180. Depending on whether the user pulls the pull cord in the upward operating pull direction 130 or the downward operating pull direction 132, the shift arm 182 pivots to engage the transmission 176, which dictates the direction in which the head roller 108 is rotated.

i. Tassel

As shown in FIG. 4, a tassel 128 may be connected with the pull cord 120 to allow a user to more easily grasp the pull cord when operating the control system 110. Various tassel configurations may be utilized. For example, the tassel 128 shown in FIG. 4 has four sides 192 sloping toward each other and connecting with a flat top surface 194 having a tassel cord aperture 196 located therein. The pull cord 120 extends from a first knot 198 located at a first end 200 of the pull cord 120 and from the inside of the tassel 128 through the tassel cord aperture 196. The first knot 198 is tied such that it is too large to pass through the tassel cord aperture 196. As such, the first knot 198 engages the flat top surface 194 from inside the tassel 128 in order to connect the tassel with the pull cord. The tassel 128 can be constructed from various types of materials, such as plastic or rubber. Depending on how much force the control system imparts on the pull cord when automatically retracting the operating cord, it may or may not be desirable to construct the tassel from a lightweight material. It is to be appreciated that the position of the tassel can be adjusted by simply moving the location of the first knot on the pull cord.

j. Releasable Clasp

As shown in FIG. 4, the stopper or coupler 126 may be in the form of the releasable clasp 126. As such, the pull cord 120 extends from the tassel 128 and connects with a first portion 202 of the releasable clasp 126. The pull cord passes 120 through a first clasp cord aperture 204 located in the bottom of the first portion 202 of the releasable clasp 126. A second knot 206 tied in a second end 208 of the pull cord 120 prevents the pull cord from passing back through the first clasp cord aperture 204, which acts to connect the pull cord to the first portion 202 of the releasable clasp 126.

The first portion 202 of the releasable clasp releasably connects with a second portion 210 of the releasable clasp 126. A first end 212 of the operating cord 124 is connected with the second portion 210 of the releasable clasp 126 by having a first knot 214 tied in the first end 212 of the operating cord 124 that is too large to pass through a second clasp cord aperture 216 located in the second portion 210 of the releasable clasp 126.

The first portion 202 of the releasable clasp 126 can be configured to separate from the second portion 210 of the releasable clasp 126 when excessive tension is applied to the pull cord 120. As such, the releasable clasp 126 can act to reduce strangulation hazards as well as protect the control system 110 from damage caused by pulling too hard on the pull cord 120.

As shown in FIG. 4, the first portion 202 of the releasable clasp 126 is a U-shaped member 202 having a base 220 with two arms 222 extending upward therefrom. The arms 222 of the first U-shaped member 202 are configured such that the arms 222 can deflect inwardly toward each other and outwardly away from each other. An inwardly extending tab 224 is located toward the end of each arm 222 on the first U-shaped member 202.

The second portion 210 of the releasable clasp 126 is also a second U-shaped member 210 having a base 228 with two arms 230 extending downwardly therefrom. Ledges 232 are also located on opposing sides of the base 228 of the second U-shaped member 210. The tabs 224 located on the arms 222 of the first U-shaped member 202 are adapted to cooperatively engage the ledges 232 on the base 228 of the second U-shaped member 210 to releasably connect the first portion 202 of the releasable clasp 126 with the second portion 210 of the releasable clasp 126.

In one form, the releasable clasp is configured such that the tabs 224 slope downward as they extend inwardly toward each other from the arms 220. The ledges 232 can also be configured to receive the downward sloping tabs 224. In this configuration, the tabs 224 interacting with the ledges 232 act to pull the arms 222 together in response to tension in the pull cord 120. As such, the releasable clasp acts to resist separation of the first portion 202 from the second portion 210 as the tension in the pull cord increases. The releasable clasp can further be constructed such that the first portion 202 will break at a predetermined tension in the pull cord. For example, in one embodiment, the first portion of the releasable clasp is constructed to break when the tension in the pull cord reaches 30 pounds.

In another form, the releasable clasp 126 is configured such that when excessive tension is applied to the pull cord 120, forces resulting from the tension exerted between the tabs 224 and the ledges 232 will cause the arms 222 of the first U-shaped member 218 to move outwardly away from each other until the tabs 224 disengage from the ledges 232, causing the first portion 202 to separate from the second portion 210 of the releasable clasp 126.

k. Spool/Input Assembly

The various elements of the input assembly 174 are supported by the right end cap 116. As shown in FIGS. 5C and 5C', the circular recess 166 is defined by a partially circular wall 234 extending from the inner side 144 of the right end cap 116. A first end cap shaft 236, a second end cap shaft 238, and a third end cap shaft 239 are integrally connected with and extend perpendicularly from the inner side 144 of the right end cap 116. As such, the first end cap shaft 236, the second end cap shaft 238, and the third end cap shaft 239 do not rotate.

As shown in FIG. 6BB, the cord guide arm 180 acts to provide outboard support for the second end cap shaft 238. Specifically, a cylindrical spacer 294 extends perpendicularly from the cord guide arm 180 and includes a cylindrical hole 297. The second end cap shaft 238 is received within the cylindrical hole 297 when the cord guide arm 180 is assembled onto the right end cap 16.

As discussed in more detail below, the assembly comprising the cord spool 190, the clock spring 186, and the axle 188 (see FIG. 5B) is rotatably supported by the first end cap shaft 236. The second end cap shaft 238 passes through the cylindrical hole 292 of the pulley 184 to rotatably support the pulley 184. The shift arm 182 is pivotably supported on the third end cap shaft 239.

Although a detailed structural description of the axle 188 follows, it should be noted that the axle 188 interfaces with the input assembly 174, the transmission 176, and the output assembly 178. As such, additional descriptions of the various functions performed by the axle will be described below separately as part of the detailed descriptions of the input assembly, the transmission, and the output assembly. It is to be appreciated that the axle 188 can be made from various suitable materials. For example, the axle in one embodiment of the present invention is made from a polycarbonate filed with a polymer such as PTFE or similar material.

As shown in FIG. 5B, the axle 188 may include a plurality of outer surfaces defined along its length by varying diameters. Each outer surface is directed to a function more particularly described below. The axle 188 shown in FIG. 5B includes a first surface 240, a second surface 242, a flange 244, and a third surface 246. The first surface is separated from the second surface 242 by the flange 244. The second surface is separated from the third surface 246 by a shoulder 430.

In some embodiments of the present invention, the first surface 240 may have a slightly smaller diameter than the second surface 242. For example, in one particular embodiment, the first surface has a diameter that is 0.081 inches less than the second diameter. A second surface spacer 248 is located where the second surface 242 and the flange 244 join. The third surface 246 may have a smaller diameter than the first surface 240 and the second surface 242, and may also be configured to taper to yet a smaller diameter until reaching a second end 250 of the axle 188.

As further illustrated in FIG. 5B, a passage 252 is located through the center of the axle 188. The passage opens through a first end 254 and the second end 250 of the axle 188. As can be understood from FIGS. 6 and 6AA, the passage 252 is grooved at the first end 254 and is adapted at the second end 250 to receive a fastener 256. As shown in FIGS. 5C, 5C' and 6AA, the outer surface of the first end cap shaft 236 is grooved to define a plurality of longitudinal ridges 258 extending radially from the circumference. The groove surface of the first end cap shaft 236 is adapted to cooperate with a correspondingly shaped grooved female opening in the first end 254 of the axle 188. As such, the longitudinal ridges 258 prevent the axle 188 from rotating relative to the first end cap shaft 236.

l. Cord Spool & Clock Spring Connection

The structural and cooperative relationship between the cord spool 190, the clock spring 186, the axle 188, the pulley 184, the shift arm 182, the cord guide arm 180, and the operating cord 124 of the input assembly 174 will now be described. As shown in FIGS. 5C, 5C' and 5G, the cord spool 190 is disc-shaped and includes a first side 260 and a second side 262. The first side 260 of the cord spool 190 includes a circular cavity 264 adapted to store the clock spring 186, and the second side 262 of the cord spool 190 includes a sun gear 266 integrally attached thereto. As such, the cord spool 190 and the sun gear 266 rotate together. An opening 268 is located in the center of the cord spool 190 and is adapted to accept a flange 270 integrally connected with a planet carrier 272 (see FIG. 5K), which is part of the transmission 176 discussed below. When assembled, the cord spool 190 is rotatably supported on the flange 270, which surrounds the first surface 240 of the axle 188.

As shown in FIGS. 5C, 5C' and 5G, the cord spool 190 includes a groove 274 in the outer circumference adapted to receive the operating cord 124 wound thereupon. As shown in FIG. 6A and discussed in more detail below, the operating cord 124 is wound clockwise (as viewed by looking toward the inner side 144 of the right end cap 116) onto the groove 274 of the cord spool 190. As such, when the operating cord 124 is unwound from the cord spool 190 (i.e. when a user pulls on the pull cord), the cord spool rotates counterclockwise.

As shown in FIG. 6A, a second knot 276 tied in a second end 278 of the operating cord 124 is located in the circular cavity 264. The operating cord 124 extends from the second knot 276 and passes through a cord notch 280 and into the groove 274. The second knot 276 prevents the operating cord 124 from slipping through the cord notch 280, thus connecting the second end 278 of the operating cord 124 to the cord spool 190.

As shown in FIGS. 5C, 5C', 5G, and 6A, the clock spring 186 is stored inside the circular cavity 264 of the cord spool 190. The clock spring functions to automatically retract the operating cord 124 onto the cord spool when tension is released from the pull cord 120. The clock spring 186 includes a first tang 282 located in the outer winding of the clock spring 186, and a second tang 284 located in the inner winding of the clock spring 186. The first tang 282 engages a first clock spring recess 286 located on the cord spool 190 to connect the clock spring with the cord spool. The second tang 284 engages a second clock spring recess 288 on the first surface 240 of the axle 188 to connect the clock spring with the axle.

When a user pulls on the pull cord 120, which in turn unwinds the operating cord 124 from the cord spool 190, the cord spool rotates counterclockwise. Because the clock spring 186 is fixed at the second tang 284 by the axle 188, the clock spring contracts from an expanded state as the cord spool rotates counterclockwise. As such, rotation of the cord spool coils the clock spring to the extent the operating cord is wound thereupon. When tension is released from the pull cord and operating cord, the cord spool is rotated clockwise by the expanding clock spring to rewind the operating cord back onto the cord spool. As can be understood from FIGS. 5C, 5C', 6 and 6A, when the control system 110 is assembled with its components, the axle 188 is inserted into opening 268 of the cord spool 190 and wound slightly to place a pre-load on the clock spring 186. This pre-load on the clock spring assures that some tension is always maintained on the operating cord when the system is not in use.

m. Operating Cord Path from Spool to Clasp

As shown in FIGS. 5C, 5C' and 6A, the operating cord 124 passes from the cord spool 190 to wrap clockwise partially around a groove 290 in the outer circumference of the pulley 184. From the pulley 184, the operating cord 124 exits the head rail assembly 112 through the cord guide arm 180.

As previously mentioned, the shift arm 182 is pivotally supported off the third end cap shaft 239, and the pulley 184 is rotatably supported off the second end cap shaft 238. The cord guide arm 180 acts to provide outboard support for the second end cap shaft 238. As shown in FIGS. 5C and 5C', the pulley 184 has a center opening 292 adapted to fit around the second end cap shaft 238.

When assembled, the pulley cooperates with the second end cap shaft to enable the pulley to freely rotate about the second end cap shaft. The shift arm cooperates with the third end cap shaft to enable the shift arm to freely pivot about the third end cap shaft. Thus, the third end cap shaft is a bearing surface for the shift arm opening, enabling the shift arm to freely pivot on the third end cap shaft. As mentioned above and as described in more detail below, the pivotal position of the shift arm determines whether the shift arm engages the transmission 176, which in turn, dictates the direction in which the head roller 108 is rotated.

As shown in FIG. 6A, the inner side 144 of the right end cap 116 includes a first cord barrier wall 298, which is a semicircular-shaped structure integral to the right end cap formed partially from the extended edges 148 (see FIG. 4). The first cord barrier wall 298 extends from the inner side of the right end cap. It will be appreciated that the outer circumferential edge of the pulley 184 is closely proximate to the first cord barrier wall 298, but does not engage it. The close proximity of the surfaces of the pulley and the first cord barrier wall is accomplished by the close tolerances between the placement of pulley 184 and the second end cap shaft 238. It is to be appreciated that the mounting of the pulley upon the second end cap shaft 238 places the outer circumferential edge of the pulley 184 closely proximate to the first cord barrier wall 298.

In one embodiment of the present invention, the outer circumferential edge of the pulley 184 is placed proximate to the first cord barrier wall 298 at a distance of less than 0.1 operating cord diameters. This close proximity prevents the operating cord 124 from escaping from the groove 290 of the pulley 184 and thereby becoming trapped between the pulley and the wall 298. Thus, as the operating cord 124 travels from the cord spool 190 over the pulley 184, the pulley is free to rotate, providing a low friction surface for the operating cord, but preventing the operating cord from becoming trapped between the remaining proximate elements.

n. Shift Arm

As shown in FIGS. 5C-5E and 5M-5V, the shift arm 182 includes a cylindrical portion 299 and a side wall portion 300, which perpendicularly intersects the outer circumferential surface 301 of the cylindrical portion 299 near the left end of the cylindrical portion 299. The cylindrical portion 299 includes a flange 302 and a cylindrical hole 303. The flange 302 perpendicularly extends from the outer circumferential surface 301 at the left end of the cylindrical portion 299. The cylindrical hole 303 extends through the cylindrical portion 299 and receives the third end cap shaft 239 such that the shift arm 182 may pivot about said shaft 239.

The side wall portion 299 includes a first leg 304, a second leg 305 and a wall section 306 perpendicularly extending from the forward edge of the side wall portion 299. The first leg 304 angles rearwardly from the cylindrical portion 299 to terminate with a pawl tooth 307. The second leg 305 extends rearwardly from the wall section 306 at a slightly obtuse angle to form a boss 308.

As best understood from FIG. 5N, the boss 308 includes a first cord engagement surface 309 that is generally vertically oriented and arcuately transitions from an orientation that is generally parallel to the vertical planar surfaces of the wall section 306 to an orientation that is generally oblique to the vertical planar surfaces of the wall section 306 and the side wall portion 300. As can be understood from FIGS. 5D, 5U and 5V, the arcuate transition of the first cord engagement surface 309 occurs as the second leg 305 extends downwardly to form the boss 308. As best understood from FIG. 5N, the first cord engagement surface 309 faces generally rearwardly.

As illustrated in FIGS. 5D, 5E and 5N, an arm 310 extends rearwardly and generally perpendicularly from the right edge of the wall section 306. In one embodiment, as best understood from FIG. 5N, the arm 310 extends to the left to perpendicularly intersect the right vertical planar surface of the first leg 304. The arm 310 includes a second cord engagement surface 311 that faces generally forwardly and includes a first section 312 and a second section 313.

The first section 312 is adjacent the right planar surface of the first leg 304, and the second section 313 is adjacent the rearward planar surface of the wall section 306. The first section 312 is generally linear as it extends from the first leg 304 to the second section 313. The first section forms an acute angle with the right vertical planar surface of the first leg 304. The second section 313 arcuately transitions from the first section 312 to extend generally perpendicularly into the rearward vertical planar surface of the wall section 306.

n. Shift Arm Operation

To begin an operational sequence, a pull force upon the operating cord 124 causes the pulley 184 to rotate. However, pulling the operating cord 124 downward to the right or left determines which direction the shift arm 182 will pivot and whether the pawl tooth 307 will engage or not engage the teeth 314 of the planet carrier 272. As indicated in FIG. 6AAA, when a user pulls on the pull cord, the operating cord 124 is unwound from the cord spool 190, which turns the cord spool in a counterclockwise direction. The operating cord 124 feeds off the cord spool 190 to pass over the pulley 184 between the first cord barrier wall 298 and the pulley 184 and down between the cord engagement surfaces 309, 311 of the shift arm 182.

As can be understood from FIGS. 3, 5N, 5O, 5Q, 5S, 5U, 6B, 6BB and 6BBB, when the operating cord 124 is displaced downwardly and to the left (i.e., in the downward operating pull direction 132) as shown in FIGS. 3 and 6BB, the operating cord 124 engages the first cord engagement surface 309 on the boss 308. This causes the shift arm 182 to pivot counterclockwise (as viewed in FIG. 6B) about the second end cap shaft 239 such that the operating cord 124 ends up residing between the first section 312 of the second cord engagement surface 311 and the right vertical planar surface of the wall portion 300 (i.e., the area indicated by arrow A in FIG. 5N). As a result, the pawl tooth 307 does not engage the teeth 314 on the planet carrier 272 as depicted in FIG. 6B.

As can be understood from FIGS. 2, 5N, 5R, 5T, 5V, 7A, 7AA and 7AAA, when the operating cord 124 is displaced downwardly and to the right (i.e., in the upward operating pull direction 130) as shown in FIGS. 2 and 7AA, the operating cord 124 engages the second cord engagement surface 311 on the arm 310. This causes the shift arm 182 to pivot clockwise (as viewed in FIG. 7A) about the second end cap shaft 239 such that the operating cord 124 ends up residing between the second section 313 of the second cord engagement surface 311 and the rearward vertical planar surface of the wall section 306 (i.e., the area indicated by arrow B in FIG. 5N). As a result, the pawl tooth 307 is forced into engagement with the teeth 314 on the planet carrier 272 as depicted in FIG. 7A.

As can be understood from FIG. 5E, the mass of the wall portion 300, which is offset from the axis of the cylindrical hole 303, causes the shift arm 182 to rotate clockwise about said axis as viewed in FIG. 5E. As a result, the pawl tooth 307 is biased rearwardly and into engagement with the teeth 314 of the planet carrier 272, even without pulling the operating cord 124 in the upward operating pull direction 130.

o. Cord Guide Arm

As shown in FIGS. 5C, 5C', 5H, and 5J the cord guide arm 180 is an elongate element having a right side 322 (depicted in FIG. 5J) and a left side 324 (depicted in FIG. 5H). As shown in FIG. 5H, the left side 324 includes a rib 326 disposed longitudinally thereon to add structural strength along the length of the cord guide arm. In one embodiment, a cylindrical hole 296 is located at the upper end of the cord guide arm. The cylindrical hole 296 is adapted to receive the female end of a cylindrical spacer 294 as shown in FIG. 6BB. In another embodiment, the cylindrical spacer 294 is an integral part of the cord guide arm 180 and the cylindrical hole 296 does not exist. As discussed below, when assembled, the cord guide arm is held in a fixed position relative to the right end cap 116.

As shown in FIGS. 5J and 6BB, the cylindrical spacer 294 extends perpendicularly from the right side 322 and includes a cylindrical hole 297, which receives the second end cap shaft 238 and provides outboard support therefor. The second end cap shaft 238 is received within the center opening 292 of the pulley 184 and serves as a support surface about which the pulley 184 may rotate.

Many points of engagement between the cord guide arm 180 and the right end cap 116 are provided to fix the cord guide arm in proper alignment with the shift arm 182. As shown in FIGS. 5C, 5C', 5H and 5J, the cord guide arm 180 includes two fingers 330 adapted to engage with corresponding slots 332 on the right end cap 116. The fingers 330 are configured to "snap fit" into the slots 332 for fixedly retaining the cord guide arm in a fixed position relative to the right end cap. A brace 334 is located between the fingers 330 on the cord guide arm. The brace helps to further retain the cord guide arm in a fixed relationship with respect to the right end cap upon assembly of the components. The brace 334 includes a notch 336 for engagement with an extended edge rib (not shown) on the right end cap 116.

As shown in FIGS. 4, 5C, 5C', 5H, 5J and 6AA, a filler 338 and a snap 340 project from the right side 322. The filler and the snap also maintain the cord guide arm in a fixed relationship with right end cap. The filler 338 is adapted to substantially fit within a recess 342 on the right end cap 116, and the snap 340 is adapted to engage a ledge 344 on the right end cap 116. As will be appreciated, as the cord guide arm is assembled into its operational position, the snap is brought to a forced engagement with the ledge by sliding over the ledge and snapping into position.

p. Parked Position

As shown in FIGS. 5C, 5C', 5H and 5J, a horn 346 is located at the lower end of the cord guide arm 180. A horn opening 348 is located at the lower end of the horn 346. The horn opening 348 is a curved and flared opening formed by horn walls 350. The horn opening 348 is adapted to stop and retain the releasable clasp 126 in a "parked" position (see FIGS. 6BBBB and 7F).

As mentioned above, when the pull cord 120 is not being pulled, the stopper or coupler 126 is drawn against the cord guide arm 180, or more particularly, the horn opening 348, and is held in place by tension in the operating cord 124 generated by the clock spring 186. In one embodiment, the parked position of the stopper or coupler 126 urges the operating cord to directly overlay the first cord engagement surface 309 of the boss 308 on or near the extreme tip of the boss 308, as shown in FIG. 6BBBB. As a result, when the pull cord 120 is not being pulled, the shift arm 182 is maintained in a position wherein the pawl tooth 307 does not engage the teeth 314 of the planet carrier 272.

As previously discussed, when a user pulls on the pull cord 120, the cord engagement surfaces 309, 311 of the shift arm 182 cooperate with the operating cord 124 such that the shift arm 182 is enabled to pivot and engage the pawl tooth 304 with the transmission, or the shift arm 182 is prevented from pivoting to engage the pawl tooth 304 with the transmission. However, in one embodiment, when the pull cord 120 is not being pulled and the releasable clasp 126 is in the parked position depicted in FIGS. 6BBBB and 7F, the flared opening 348 is configured to urge the operating cord 124 to directly overlay the first cord engagement surface 309 of the boss 308 on or near the extreme tip of the boss 308, as shown in FIG. 6BBBB. When the pull cord 120 is being pulled, the flared opening 348 of the cord guide arm 180 urges the user to pull on the pull cord and operating cord in either the upward operating pull direction 130 or the downward operating pull direction 132, as shown in FIGS. 2 and 3.

If the pull direction is in the upward operating pull direction 130 (see FIG. 2), the operating cord 124 moves from the parked position and contacts the second cord engagement surface 311 of the shift arm 182 as discussed above and shown in FIGS. 6BBBB, 7A, 7AA and 7AAA. However, as shown in FIGS. 6B, 6BB, 6BBB and 6BBBB, if the pull direction is in the downward operating pull direction 132 (see FIG. 3), the operating cord 124 remains in contact with the first cord engagement surface 309 of the boss because the parked position already had the operating cord 124 in contact with the tip of the boss 309.

q. Final Summary of Input Assembly

To summarize the operational description of the input assembly, as a user pulls on the pull cord 120 to move the covering 100 in the desired direction, the operating cord 124 is unwound from the cord spool 190, causing the cord spool to rotate in a counterclockwise direction. The operating cord passes over the pulley 184 and between the cord engagement surfaces 309, 311 of the shift arm 182. Pulling the operating cord 124 downwardly right or left determines the direction of the pivot for the shift arm and whether the pawl tooth 307 will engage the teeth of the planet carrier 272.

If the user pulls the pull cord in the upward operating direction 130, the shift arm is allowed to pivot such that the pawl tooth 307 on the shift arm engages the transmission, causing the head roller 108 to rotate in a direction to wrap the covering 100 onto the head roller, as will be explained more fully later. Alternatively, if the user pulls the pull cord in the downward operating direction 132, the shift arm is prevented from pivoting to engage the pawl tooth with the transmission 176, causing the head roller to rotate in a direction to unwrap the covering from the head roller.

Rotation of the cord spool 190 operates as an input to the transmission, which imparts rotational movement to the output assembly 178 and the head roller 108. After the user releases tension from the pull cord and operating cord, the clock spring 186 causes the cord spool to automatically wind the operating cord back onto the cord spool. As the operating cord winds back onto the cord spool, the operating cord is automatically retracted until the stopper or coupler 126 engages the horn opening 348 of the cord guide arm 180, placing the operating cord back into the parked position over the first cord engagement surface 309.

r. Transmission Overview

The structure and operation of the transmission 176 will now be discussed in detail. As shown in FIGS. 5C and 5C', the transmission includes a sun gear 266 integrally connected with the second side 262 of the cord spool 190, a planet carrier 272, four planet gears 352, a spider 354, and a ring gear 356 (see FIG. 5B). These components all cooperatively engaging to convert rotational movement of the cord spool into rotational movement of the ring gear, which imparts rotational movement to the output assembly 178.

As discussed in more detail below, a user pulling on the pull cord 120 causes the cord spool to rotate counterclockwise (see FIG. 6AAA). Because the sun gear is integral with the cord spool, the sun gear also rotates in a counterclockwise direction.

If the user pulls the pull cord in the upward operating direction 130 (see FIG. 2), the shift arm 182 pivots until the pawl tooth 307 engages ratchet teeth 314 on the planet carrier 272, which prevents the planet carrier from rotating (see FIG. 7A). Counterclockwise rotation of the sun gear causes clockwise rotation of the four planet gears 352 about their respective axes (see FIG. 7B). The four planet gears 353 in turn engage the ring gear 356 to turn the ring gear in a clockwise direction.

Alternatively, if the user pulls the pull cord in the downward operating direction 132 (see FIG. 3), the shift arm 182 does not pivot to engage the pawl tooth 307 with the planet carrier 272 (see FIG. 6B), allowing the planet carrier to rotate. As such, counterclockwise rotation of the sun gear initially causes clockwise rotation of the four planet gears about their respective axes as the four planet gears orbit counterclockwise about the axis of the sun gear (see FIG. 6G) due to the planet carrier 272 rotating counterclockwise as a result of frictional resistance between interfacing surfaces of the planet carrier 272 and the cord spool 190. After the planet carrier has rotated counterclockwise for a brief period, the planet carrier engages the spider 354 to turn the spider in a counterclockwise direction, which engages the ring gear 356 to turn in a counterclockwise direction (see FIG. 6C). At this time, the four planet gears cease to rotate about their respective axes and simply continue to orbit counterclockwise about the axis of the sun gear as the planet carrier rotates counterclockwise (see FIG. 6G). Adequate engagement of the planet carrier with the spider to facilitate the cord spool, planet carrier and ring gear turning counterclockwise as one integral unit is made possible by the resistance to motion of the ring gear by frictional drag associated with the wrap springs.

As discussed in more detail below, the spider acts as a part time one-way clutch activated by the planet carrier to rotate the ring gear. As such, when the spider is deactivated, the spider would not interfere with rotation of the ring gear in either the clockwise or counterclockwise directions.

s. Sun Gear, Planet Carrier & Planet Gears

As mentioned above and as shown in FIGS. 5C, 5C' and 7B, the sun gear 266 is integrally connected with the second side 262 of the cord spool 190 and is adapted to engage four planet gears 352 on the planet carrier 272. Although four planet gears are depicted and described with reference to the transmission, it is to be appreciated that the transmission can be configured to include more than or less than four planet gears. The planet carrier is disc-shaped and has a first side 358 and a second side 360 with a center circular opening 362 passing there through, as shown in FIGS. 5C, 5C' and 5K. A series of ratchet teeth 314 are located on the periphery of the planet carrier. The ratchet teeth 314 are adapted to engage with the pawl tooth 304 on the shift arm 182. The sun gear 266 is adapted to be received in the center circular opening 362 of the planet carrier 272 from the first side 358. The flange 270 inside the center circular opening includes an inner surface 364 adapted to receive the first surface 240 of the axle 188 and includes an outside surface 366 to act as a bearing surface for the sun gear 266. The length of the flange 270, the width of the sun gear 266, and the depth of the center circular opening 362 are substantially equal to allow the flange and the sun gear to fit together so as to enable the sun gear to engage the planet gears 352.

As shown in FIGS. 5C, 5C' and 7B, the second side 360 of the planet carrier includes a circular shaped raised structure 370 adapted to accept the four planet gears 352. The raised structure 370 has four sun gear openings 372 spaced at ninety-degree intervals there around. Planet gear axles 374 extending from the second side 360 of the planet carrier 272 and are radially positioned to correspond with the location of the sun gear openings 372 in the raised structure 370. The planet gears are configured with center holes 376 adapted to receive the planet gear axles 374. As such, when the planet gears are positioned on the planet carrier axles, the planet gears project geared surfaces into the sun gear openings. Moreover, upon inserting the sun gear into center circular opening of the planet carrier, the sun gear engages the planet gears. Therefore, rotation of the cord spool 190 rotates the sun gear 266, which rotates the four planet gears 352.

t. Engagement of Planet Carrier and Spider

As shown in FIGS. 5C, 5C', 5L, and 6C, two actuator tabs 378 extend from the circular raised structure 370 on the planet carrier 272. The actuator tabs 378 are trapezoidally shaped, each having a small notch 380 located thereon. The actuator tabs 378 are adapted to engage the spider 354 upon rotation of the planet carrier 272. The spider 354 includes a somewhat flexible and resilient body 382 generally oblong or "football" shape having an open center 384 with rounded ends 386. Arcuate legs 388 project from the rounded ends 386 in opposite directions with respect to each other. The legs 388 may also be flexible and resilient so as to be bendable outwardly or away from the body 382. Wedges 390 located at a distal end of each leg 388 are adapted to engage the small notches 380 on the actuator tabs 378 and the ring gear 356 upon counterclockwise rotation of the planet carrier 272, as discussed in more detail below. Opposite a point of attachment of each leg 388 is a small stop 392 adapted to engage the actuator tabs 378 upon clockwise rotation of the planet carrier 272. It is to be appreciated that the spider can be made from various suitable materials. For example, the spider in one embodiment of the present invention is made from a thermoplastic polyester elastomer, such as HYTREL® manufactured by DUPONT®. Other embodiments are made from creep resistant, low modulus, amorphous thermoplastics such as polycarbonate.

The open center 384 of the spider 354 is adapted to receive the first surface 240 of the axle 188. The engagement of the first surface of the axle and the open center of the spider is an interference fit. As such, the diameter of the open center 384 of the spider 354 is slightly smaller than the outside diameter of the first surface 240 of the axle 188. In one embodiment of the present invention, the diameter of the open center of the spider is 0.016 inches smaller than the outer diameter of the first surface of the axle. The interaction of the spider material with the axle material along with the interference fit create some friction between the spider and the first surface of the axle, but the spider can move around the first surface without binding. The friction between the body of the spider and the first surface of the axle enables engagement of the actuator tabs with the spider upon rotation of the planet carrier in a counterclockwise direction, and disengagement of the spider from the actuator tabs upon rotation of the planet carrier in a clockwise direction.

u. Ring Gear

As previously mentioned, depending upon which direction the user pulls on the pull cord, either the four planet gears 352 or the spider 354 cause the ring gear 356 to rotate in either a clockwise direction or a counterclockwise direction, respectively. As shown in FIGS. 5B and 5F, the ring gear 356 is defined by a flanged portion 394 having a first side 396 and a second side 398 with a cylindrical portion 400 extending from the second side 398. A cylindrical opening 402 passes through the flanged portion 394 and the cylindrical portion 400. As shown in FIGS. 5F and 7B, the first side 396 of the flanged portion 394 is largely open ended having a first geared lip 404 adapted to engage the four planet gears 352 on the planet carrier 272. Moreover, the first geared lip is slightly raised from the first side of the flanged portion to form a flange bearing surface 406. The flange bearing surface 406 is adapted to cooperate with a circular groove 408 on the second side 360 of the planet carrier 272 to create a bearing surface as well as an axial support between the planet carrier and the ring gear (see FIGS. 5C and 5C').

As shown in FIGS. 5F and 6C, a second geared lip 410 is located interiorly of the first geared lip 404. The second geared lip 410 has a smaller diameter than the first geared lip 404 and is adapted to engage the spider wedges 390. As previously mentioned, the legs 388 of the spider 354 are flexible. As shown in FIG. 6C, counterclockwise rotation of the planet carrier 272 moves the two actuator tabs 378 into engagement with the two legs 388 on the spider 354. More particularly, the actuator tabs engage the spider such that the actuator tabs move between the wedges 390 and the body 382 of the spider 354 until the notches 380 on the actuator tabs 378 engage the wedges, causing the legs of the spider to flex and bend outwardly from the body of the spider. As the legs 388 flex and bend outwardly, the wedges 390 are driven to engage the second geared lip 410 of the ring gear 356. Friction between the body of the spider and the first surface of the axle holds the body of the spider in a fixed position relative to the axle until the actuator tabs adequately engage the legs of the spider. The engagement of the wedges with the second geared lip surface is compressional in that the wedges are driven to fit the second geared lip by outward force of the expanded leg against the actuator tab. Continued rotation of the planet carrier and ring gear in a counterclockwise direction, enables the wedges to remain in a continued compressional engagement with the second geared lip. When the planet carrier rotates in the clockwise direction, friction between the spider body and the first surface of the axle overcomes friction between the actuator tabs and the spider legs, allowing the actuator tabs to disengage from the spider legs, which disengages the spider from the ring gear.

As shown in FIG. 5B, the cylindrical portion 400 of the ring gear 356 is defined by three elevated sleeve extensions. A first sleeve extension 412 extends from the second side 398 of the flanged portion 394. A second sleeve extension 414 extends from the first sleeve extension 412 and has a diameter smaller than the first sleeve extension. A third sleeve extension 416 extends from the second sleeve extension 414 and has a diameter smaller than the second sleeve extension. Further, the third sleeve extension includes an U-shaped channel 418 formed therein with two side walls 420 extending from the second sleeve extension to the end of the third sleeve extension 416. As discussed below, the two side walls 420 function to cooperate with the braking system.

As shown in FIG. 5F, a shoulder 422 located near the second geared lip 410 is defined by the connection of the third sleeve extension 416 and the second sleeve extension 414. The shoulder 422 is adapted to cooperate with the flange 244 of the axle 188 to create a thrust bearing between the ring gear 356 and the axle 188. When the ring gear is mounted on the second surface 242 of the axle 188, the shoulder contacts the flange 244 at an area just outside the circumference of the second surface spacer 248. As such, the second surface spacer 248 helps to maintain the alignment of the axle 188 with the ring gear 356 by maintaining the shoulder 422 in an appropriate thrust bearing position.

v. Summary of Transmission

To summarize the operational description of the transmission 176, as a user pulls on the pull cord 120 to move the covering 100 in the desired direction, the operating cord 124 is unwound from the cord spool 190, causing the cord spool and the sun gear 266 to rotate in a counterclockwise direction (see FIGS. 6A, 6AAA, 6B, and 7A). If the user pulls the pull cord in the upward operating direction 130 (see FIGS. 2 and 7A), the shift arm 182 is allowed to pivot such that the pawl tooth 307 on the shift arm engages the ratchet teeth 314 on the planet carrier, which prevents the planet carrier from rotating. As such, the counterclockwise rotation of the sun gear causes the four planet gears 352 to rotate in a clockwise rotation about their respective axles 374 (see FIG. 7B). The rotating planet gears 352 in turn engage the first geared lip 404 of the ring gear 356 to cause the ring gear to rotate in a clockwise direction. Clockwise rotation of the ring gear, which engages the output assembly (see FIGS. 7C and 7D), causes the head roller 108 to rotate in a clockwise direction to wrap the covering 100 onto the head roller.

Alternatively, if the user pulls the pull cord 120 in the downward operating direction 132 (see FIGS. 3 and 6B), the shift arm 182 is prevented from pivoting to engage the pawl tooth 307 with the ratchet teeth 314 on the planet carrier 272. This allows the planet carrier to rotate freely about the first surface 240 of the axle 188. As such, counterclockwise rotation of the sun gear 266 initially causes clockwise rotation of the four planet gears 352 about their respective axles 374 as the four planet gears 352 orbit counterclockwise about the axis of the sun gear 266 due to the planet carrier 272 rotating counterclockwise as a result of frictional resistance between interfacing surfaces of the planet carrier 272 and the cord spool 190.

After the planet carrier 272 has rotated counterclockwise for a brief period, the two actuator tabs 378 of the planet carrier 272 eventually engage the legs 388 on the spider 354 to turn the spider 354 in a counterclockwise direction. The actuator tabs 378 cause the legs 388 of the spider 354 bend outwardly away from the body 382 of the spider until the wedges 390 on the distal ends of the legs are compressed by the actuator tabs 378 against the second geared lip 410 of the ring gear 356. As a result, the spider 354 engages the ring gear 356 to turn it in a counterclockwise direction, as can be understood from FIG. 6C. At this time, the four planet gears 352 cease to rotate about their respective axles 374 and simply continue to orbit counterclockwise about the axis of the sun gear 266 as the planet carrier 272 rotates counterclockwise. Adequate engagement of the planet carrier 272 with the spider 354 to facilitate the cord spool 190, planet carrier 272 and ring gear 356 turning counterclockwise as one integral unit is made possible by the resistance to motion of the ring gear 356 by frictional drag associated with the wrap springs 424. Counterclockwise rotation of the ring gear 356, which engages the output assembly 178, causes the head roller 108 to rotate in a counterclockwise direction to unwrap the covering 100 from the head roller 108 (see FIGS. 6C and 6D).

Once the user releases tension from the pull cord 120, the clock spring 186 recoils the operating cord 124 onto the cord spool 190 in a clockwise direction. As the cord spool recoils, the planet carrier 272 moves in a clockwise direction. Rotation of the planet carrier in a clockwise direction disengages the wedges 390 on the spider legs 388 from the actuator tabs 378 on the planet carrier 272. As such, the legs contract to their original position relative to the spider body, which disengages the wedges from the second geared lip. Disengagement of the wedges from the second geared lip causes the rotation of the ring gear to cease.

w. Output Assembly Overview

The structure and operation of the output assembly 178 will now be discussed in detail. As shown in FIG. 5B, the output assembly includes the fastener 256, two wrap springs 424 rotatably supported on the second surface 242 of the axle 188, and the rotator spool 168 supported by the cylindrical portion 400 of the ring gear 356. These components engage to convert rotational movement of the ring gear into rotational movement of the head roller 108. As discussed in more detail below, a user pulling on the pull cord 124 in the upward operating direction 130 (see FIGS. 2 and 7E), causes the ring gear 356 to rotate in a clockwise direction, which causes the rotator spool 168 and the head roller 108 to rotate in a clockwise direction. Alternatively, a user pulling the pull cord in the downward operating direction 132 (see FIGS. 3 and 6E) causes the ring gear to rotate in a counterclockwise direction, which causes the rotator spool 168 and the head roller 108 to rotate in a counterclockwise direction.

As shown in FIGS. 5B, 6D, and 7D, two wrap springs 424 of a spring clutch are adapted to receive the second surface 242 of the axle 188. It is to be appreciated that the number of wrap springs used may vary for different embodiments of the present invention. The inside diameters of the wrap springs are slightly smaller than the outside diameter of the second surface of the axle, which provides a frictional engagement between the second surface and the wrap springs. This frictional engagement enables a braking action for the ring gear 356. When the ring gear 356 is mounted on the axle 188, the third sleeve extension 416 surrounds the wrap springs 424 such that wrap spring tangs 426 extend outwardly from the wrap springs 424 near the side walls inside the U-shaped channel 418.

Still referring to FIGS. 5B, 6D, and 7D, the braking effect of the wrap springs 424 is released by the side walls 420 of the U-shaped channel 418 in the third sleeve extension 416 of the ring gear 356 engaging one or a plurality of wrap spring tangs 426. As such, the rotational force of the side walls against the wrap spring tangs causes the wrap springs to expand, thereby loosening their frictional engagement on the second surface 248 of the axle 188. The reduced frictional engagement allows rotation of the ring gear 356. However, as the force imparted on the wrap spring tangs lessens, the wrap springs contract, thereby tightening their frictional engagement on the second surface of the axle, which provides a braking response. As well as holding the covering in a particular position, engagement of the side walls against the wrap spring tangs also helps to prevent the ring gear from turning too quickly when the user is pulling on the pull cord.

As previously discussed, the diameter of the shoulder 422 of the ring gear 356 is slightly larger than the diameter of the second surface spacer 248 on the axle 188. As such, the wrap spring 424 closest to the spacer is prevented from becoming lodged under the shoulder as the ring gear 356 rotates. This may be an important function when more than two wrap springs are fitted about the second surface of the axle. In addition, an end lip 428 on the interior of the third sleeve extension 416 is adapted to cooperate with a second surface shoulder 430 of the axle 188 when the axle is inserted there through, which helps to prevent the wrap springs 424 from moving in a longitudinal direction along the second surface 242 of the axle 188.

x. Rotator Spool

As shown in FIGS. 5B, 6D, and 7D, the cylindrically-shaped rotator spool 168 includes a brake housing portion 432 having a hollow interior at an open end 434. Radially spaced longitudinal fins 436 are located on the outside of the rotator spool. A first longitudinal fin 170 is adapted to fit within the longitudinal inner groove 154 of the head roller 108, as shown in FIG. 4. A longitudinal boss 438 is adapted to connect with the interior of the brake housing portion 432. Referring back to FIGS. 5B, 6D, and 7D, the brake housing portion 432 of the rotator spool 168 is adapted to be placed over the third sleeve extension 416 of the ring gear 356 so the longitudinal boss 438 fits into the U-shaped channel 418 between the wrap spring tangs 426 near the side walls 420. As such, when the ring gear rotates in either a clockwise or counterclockwise direction, the longitudinal boss of the brake housing portion of the rotator spool engages the side walls of the U-shaped channel. Thus, the rotator spool rotates in the same direction as the ring gear.

As shown in FIGS. 5B, 6, and 7, the rotator spool 168 is secured to the axle 188 by the fastener 256 to maintain a thrust connection between the components of the control system. More particularly, the fastener 256 enters an opening 440 in the rotator spool and passes through the center of the axle 188 and screws into the first end cap shaft 236. When the components of the control system are assembled on the axle and the axle is installed on the first end cap shaft, the second end 250 of the axle 188 extends a slight distance outwardly from the opening 440 of the rotator spool 168. In one embodiment, the axle extends 0.015 inches outwardly from the opening of the rotator spool. As such, when the fastener is screwed into the first end cap shaft, the screw head 442 does not press against the rotator spool 168. As a result, the rotator spool is able to freely rotate.

y. Overall Summary

The above-described control system 110 assembled on the right end cap 116 of the head rail assembly 112, as shown in FIGS. 6 and 7, allows a user to raise or lower the covering 100 by pulling on the pull cord 120 in either the upward operating pull direction 130 or the downward operating pull direction 132. The control system 110 also allows the user to pull repetitively on the pull cord in the same direction to achieve the desired position of the covering. Once the user releases the pull cord, the control system automatically retracts the operating cord back into the head rail assembly, and the braking system holds the covering in position.

II. Discussion of Second Embodiment a. General Overview of Second Embodiment

Figure 8:
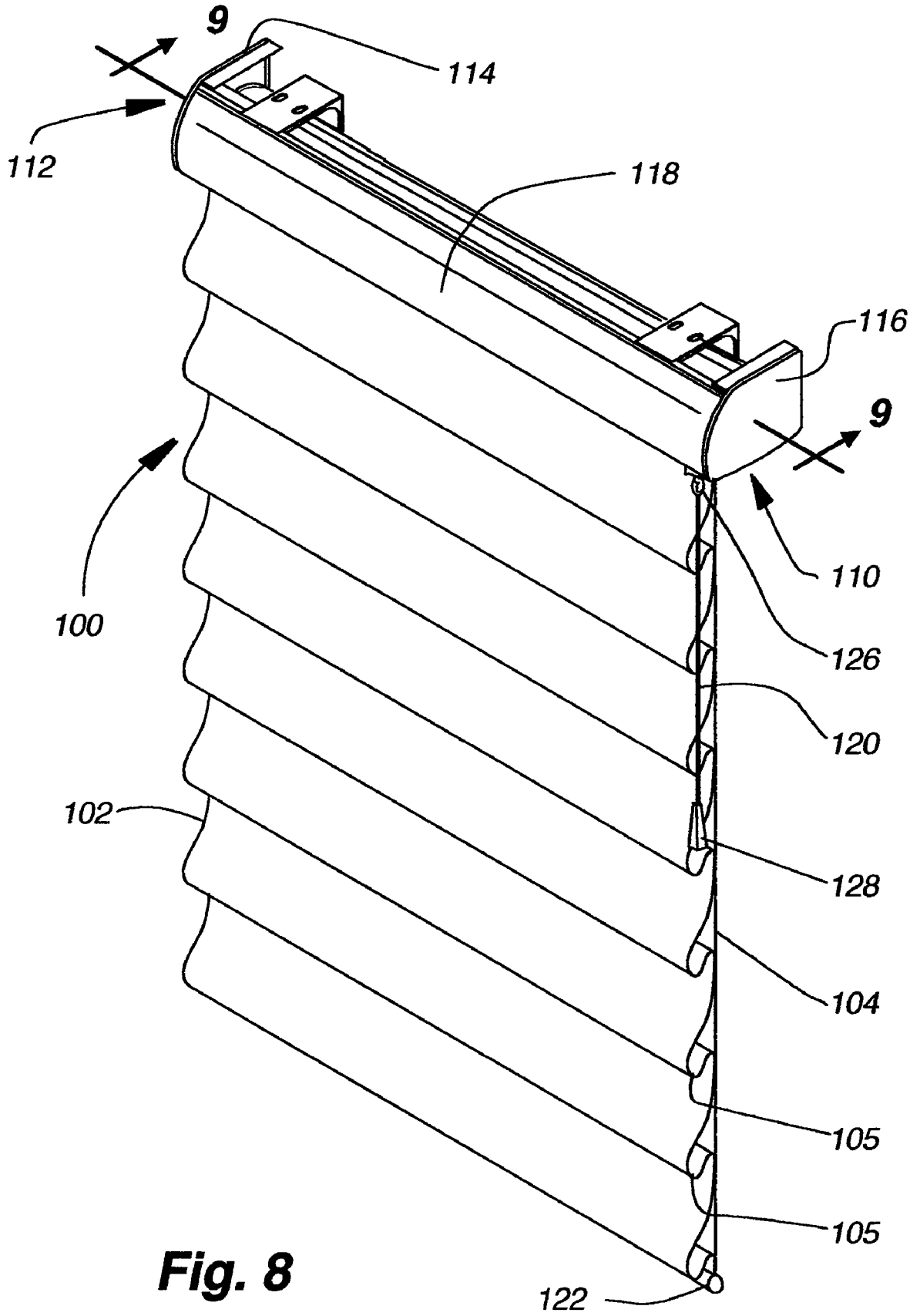
FIG. 8 is an isometric view of another covering for an architectural opening utilizing the present invention.

A second embodiment of the covering 100 and control system 110 of the present invention will now be discussed. FIG. 8 illustrates a second embodiment of the covering 100, which includes a first vertical fabric sheet 102 and a second vertical fabric sheet 104. The first fabric sheet 102 has a series of uniform horizontal folds 105 that are attached at generally uniform intervals to the second fabric sheet 104. As with the first embodiment, the covering 100 of the second embodiment is suspended from a head rail assembly 112 that includes a left end cap 114, a right end cap 116 and a control system 110 that is operated via a pull cord 120.

As will be evident to those skilled in the art, the configuration and operation of the control system 110 for the second embodiment is generally the same as the configuration and operation of the control system for the first embodiment, except, as best understood via a comparison between FIGS. 6B, 7A, 9A, 10A, 12A and 13A, the orientation of the pawl tooth 307 and the teeth 314 on the planet carrier 272 are reversed, and the operating cord 124 is wound about the 190 cord spool in a reversed direction. Specifically, as shown in FIGS. 9A, 10A, 12A and 13A, the operating cord 124 is wound counterclockwise about the cord spool 190. Because of these differences, the various rotational components of the input assembly 174, the transmission 176 and the output assembly 178 of the second embodiment rotate in directions opposite from the same components of the first embodiment.

b. Summary of Rotational Movement for Components of the Input, Transmission, and Output Assemblies of the Second Embodiment With respect to the second embodiment of the control system 110, a user pulling on the pull cord 120 causes the operating cord 124 to unwind from the cord spool 190 As a result, the cord spool 190 rotates clockwise (see FIGS. 9A and 12A). Because the sun gear 266 is integral with the cord spool 190, the sun gear 266 also rotates in a clockwise direction.

Figure 10A:
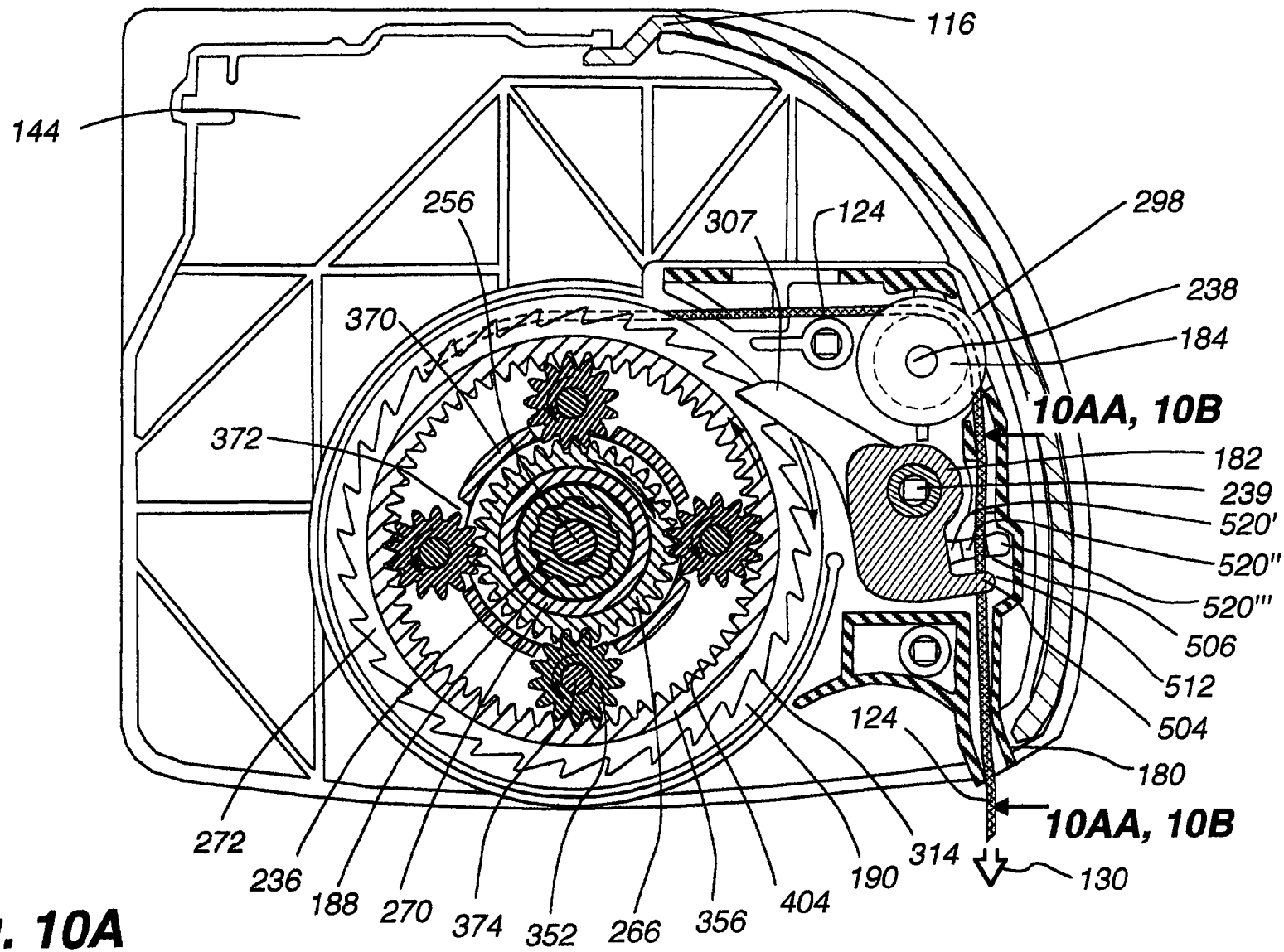
FIG. 10A is a cross-sectional view of the control system depicted in FIG. 9, taken along line 10A-10A, wherein the pawl tooth is engaged with the teeth of the planet carrier.
Figure 10A:
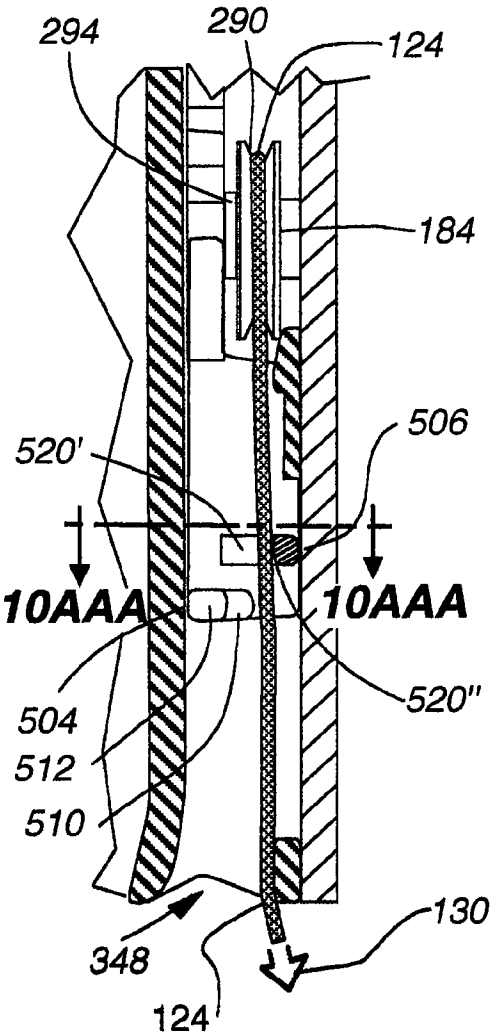
Figure 9A:
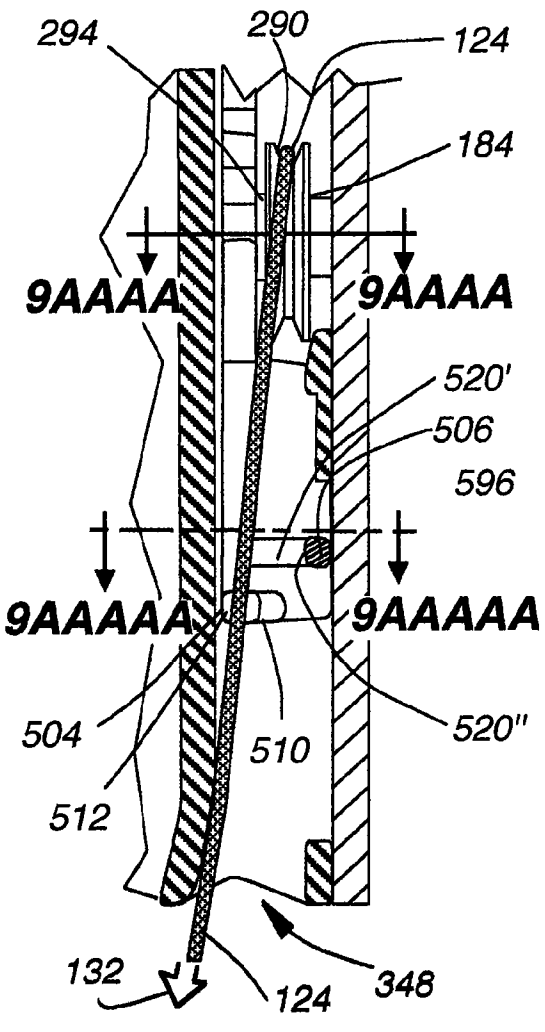
Figure 13A:
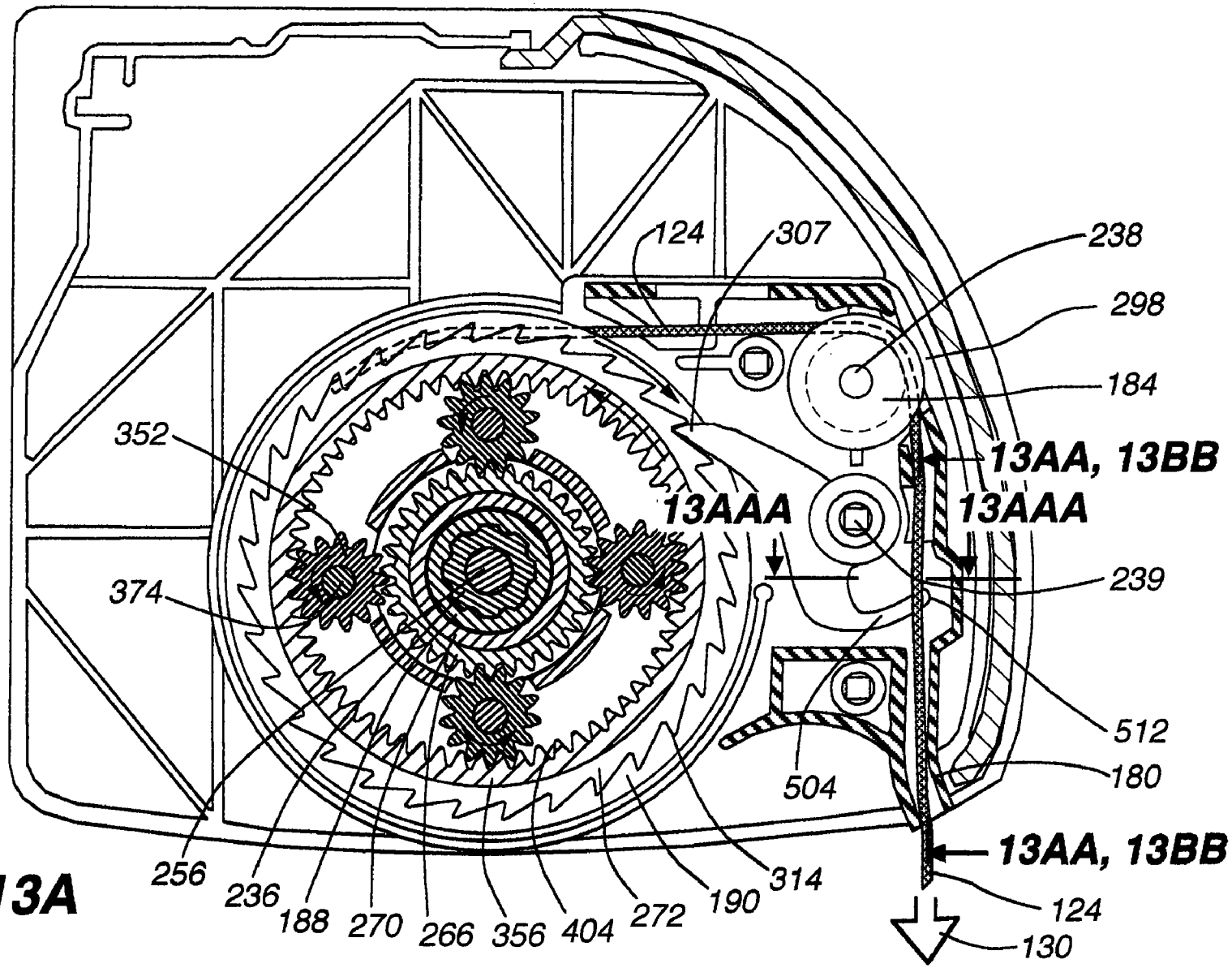
FIG. 13A is a cross-sectional view of the control system depicted in FIG. 9, taken along line 13A-13A, wherein the pawl tooth is engaged with the teeth of the planet carrier.
Figure 13A:
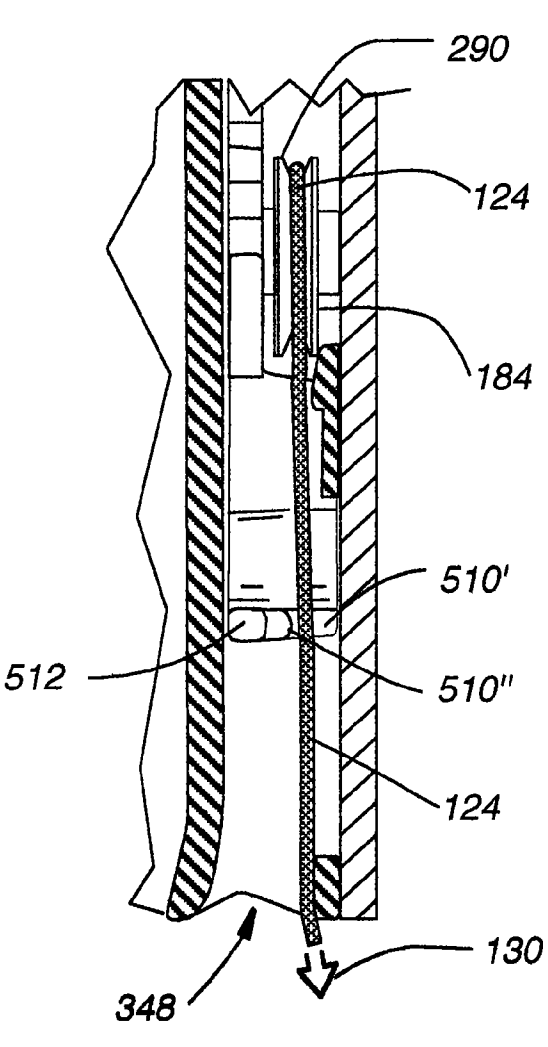
Figure 12A:
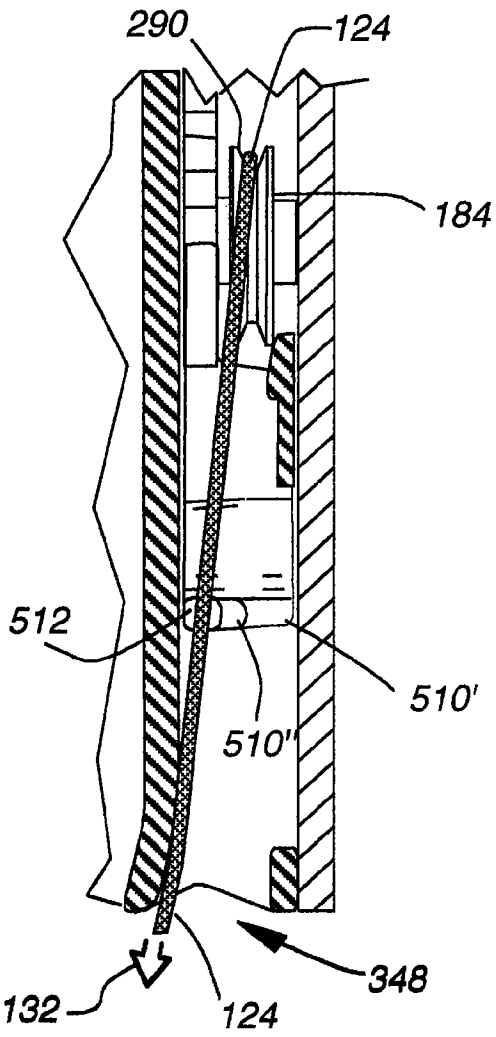

If the user pulls the pull cord 120 in the upward operating direction 130 (see FIG. 2), the shift arm 182 pivots until the pawl tooth 307 engages ratchet teeth 314 on the planet carrier 272, which prevents the planet carrier 272 from rotating (see FIGS. 10A and 13A). Clockwise rotation of the sun gear 266 causes counterclockwise rotation of the four planet gears 352 about their respective axles 374 (see FIGS. 10A and 13A). The four planet gears 353 in turn engage the ring gear 356 to turn the ring gear 356 in a counterclockwise direction. Counterclockwise rotation of the ring gear 356, which engages the output assembly 178, causes the head roller 108 to rotate in a counterclockwise direction to wrap the covering 100 onto the head roller 108.

Alternatively, if the user pulls the pull cord 120 in the downward operating direction 132 (see FIG. 3), the shift arm 182 does not pivot to engage the pawl tooth 307 with the planet carrier 272 (see FIGS. 10A and 13A), allowing the planet carrier 272 to rotate. As such, clockwise rotation of the sun gear 266 initially causes counterclockwise rotation of the four planet gears 352 about their respective axles 374 as the four planet gears 352 orbit clockwise about the axis of the sun gear 266 due to the planet carrier 272 rotating clockwise as a result of frictional resistance between interfacing surfaces of the planet carrier 272 and the cord spool 190.

After the planet carrier 272 has rotated clockwise for a brief period, the two actuator tabs 378 of the planet carrier 272 eventually engage the legs 388 on the spider 354 to turn the spider 354 in a clockwise direction. The actuator tabs 378 cause the legs 388 of the spider 354 bend outwardly away from the body 382 of the spider until the wedges 390 on the distal ends of the legs are compressed by the actuator tabs 378 against the second geared lip 410 of the ring gear 356. As a result, the spider 354 engages the ring gear 356 to turn it in a clockwise direction, as can be understood from FIG. 6C (which is the same as the second embodiment, except the legs 388 of the spider 354 point in a counterclockwise direction, the teeth of geared lip 410 are inclined in the opposite direction, and the directional arrow would be reversed to indicate clockwise rotational displacement of the ring gear 356 and head roller 108). At this time, the four planet gears 352 cease to rotate about their respective axles 374 and simply continue to orbit clockwise about the axis of the sun gear 266 as the planet carrier 272 rotates clockwise. Adequate engagement of the planet carrier 272 with the spider 354 to facilitate the cord spool 190, planet carrier 272 and ring gear 356 turning clockwise as one integral unit is made possible by the resistance to motion of the ring gear 356 by frictional drag associated with the wrap springs 424. Clockwise rotation of the ring gear 356, which engages the output assembly 178, causes the head roller 108 to rotate in a clockwise direction to unwrap the covering 100 from the head roller 108.

As in the first embodiment, the spider 354 of the second embodiment acts as a part time one-way clutch activated by the planet carrier 272 to rotate the ring gear 356. As such, when the spider 354 is deactivated, the spider 354 would not interfere with rotation of the ring gear 356 in either the clockwise or counterclockwise directions.

c. Shift Arms

Figure 9:
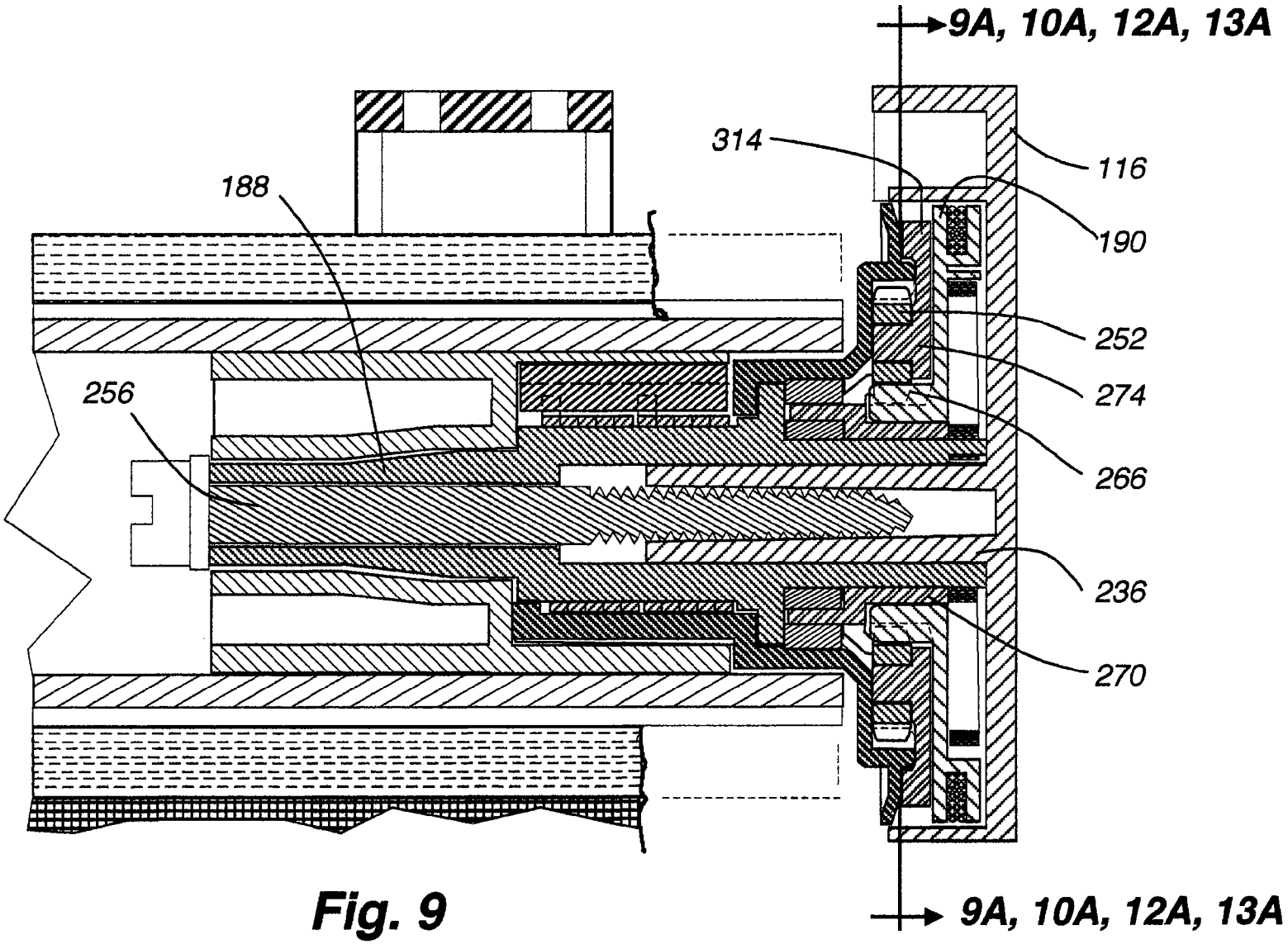
FIG. 9 is a cross-sectional view of the control system depicted in FIG. 8 taken along line 9-9.
Figure 9A:
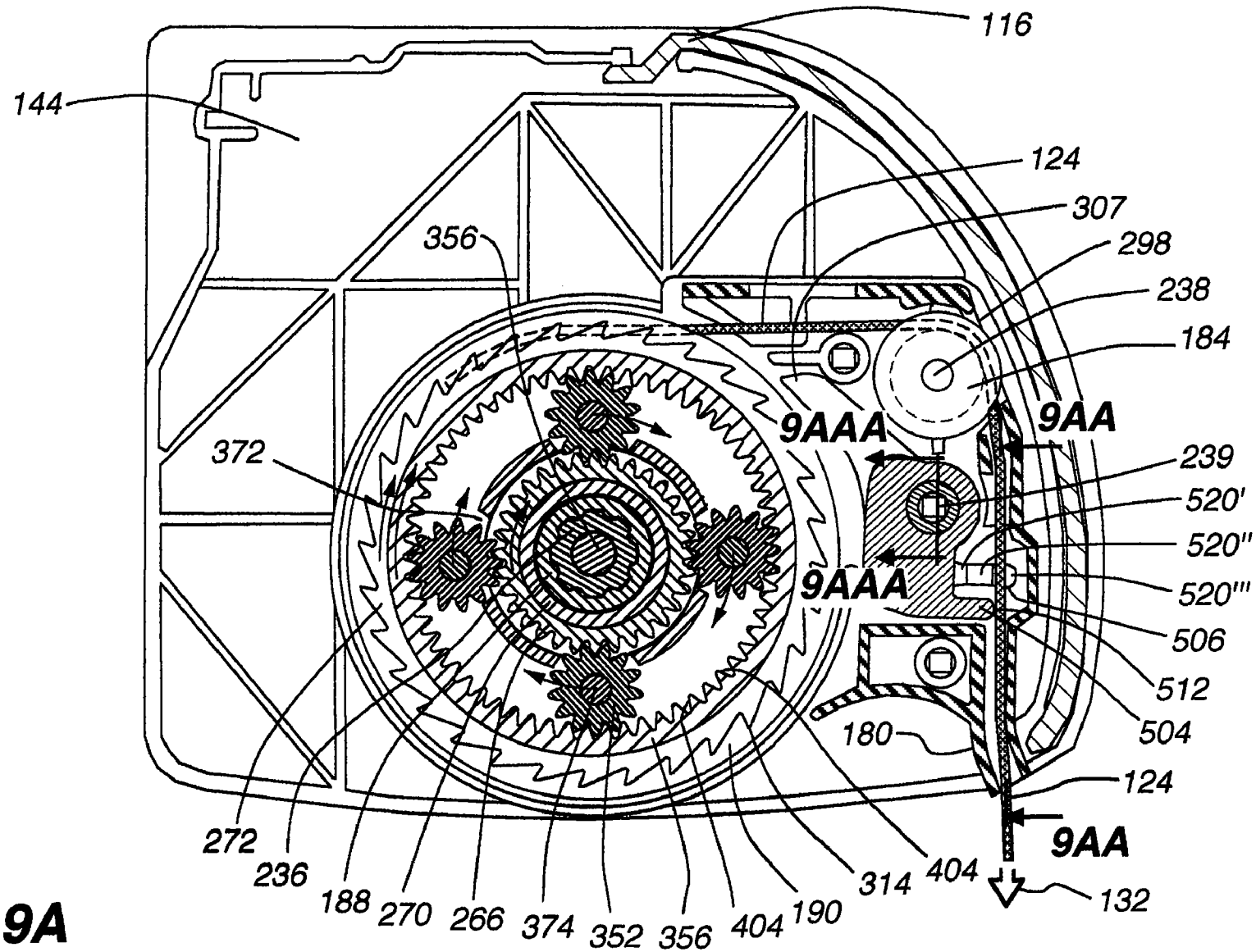
FIG. 9A is a cross-sectional view of the control system depicted in FIG. 9, taken along line 9A-9A, wherein the pawl tooth is not engaged with the teeth of the planet carrier.
Figure 12A:
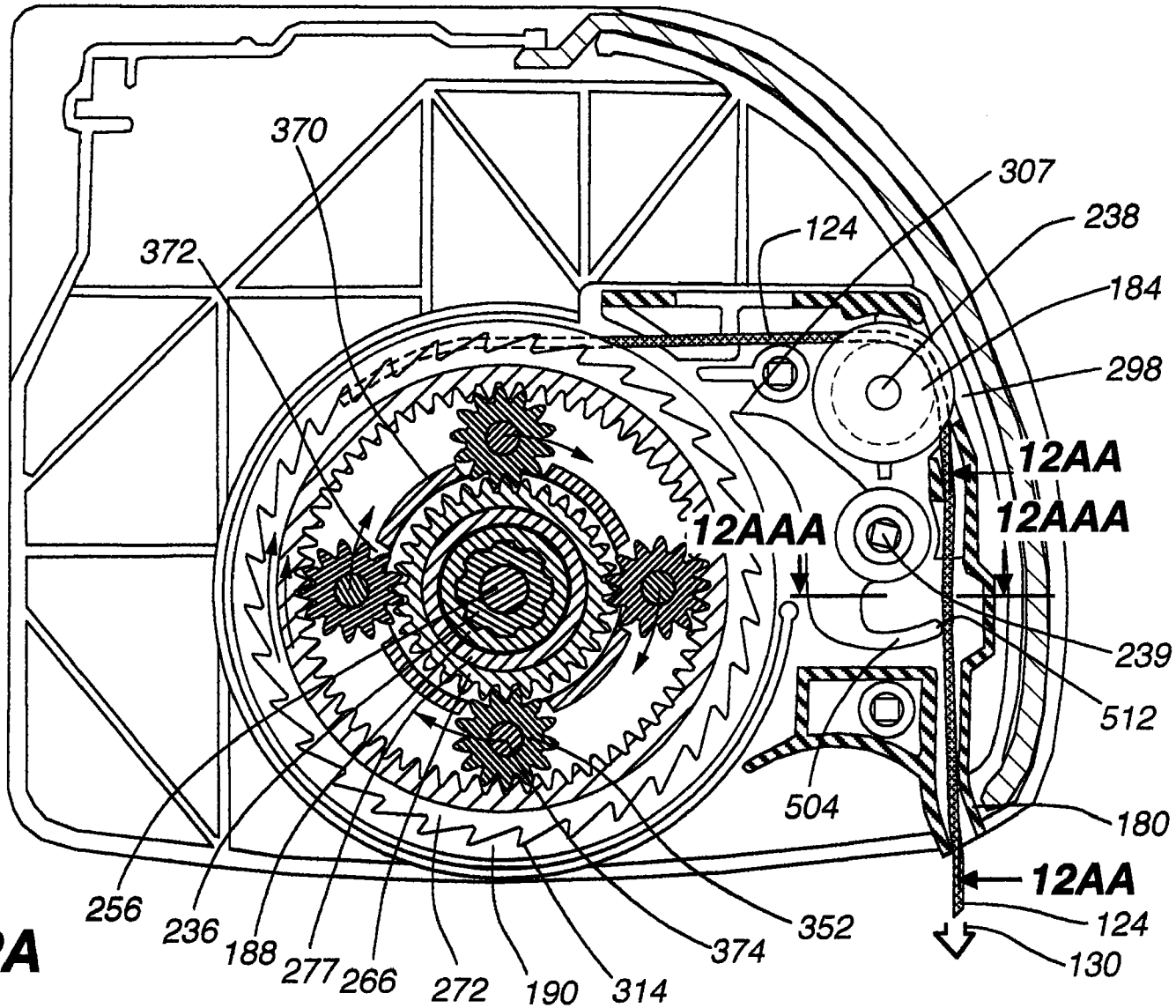
FIG. 12A is a cross-sectional view of the control system depicted in FIG. 9, taken along line 12A-12A, wherein the pawl tooth is not engaged with the teeth of the planet carrier.

Two different versions of the shift arm 182 may be employed with the second embodiment of the control system 110. The first shift arm version is depicted in FIGS. 9A-9AA, 9AAAAA, 10A-10AAA, and 11A-11E. The second shift arm version is depicted in FIGS. 12A-12AAA, 13A-13AAA, and 14A-14E.

As shown in FIGS. 11A-11E, the first version of the shift arm 182 includes a cylindrical portion 500, a block portion 502, a first arm 504, a second arm, and a pawl tooth 307. The cylindrical portion 500 includes a cylindrical hole 508, which extends through the cylindrical portion 500 and receives the third end cap shaft 239 such that the shift arm 182 may pivot about said shaft 239 (see FIGS. 9A and 10A). The block portion 502 extends downwardly and rearwardly from the cylindrical portion 500.

Figure 11B:
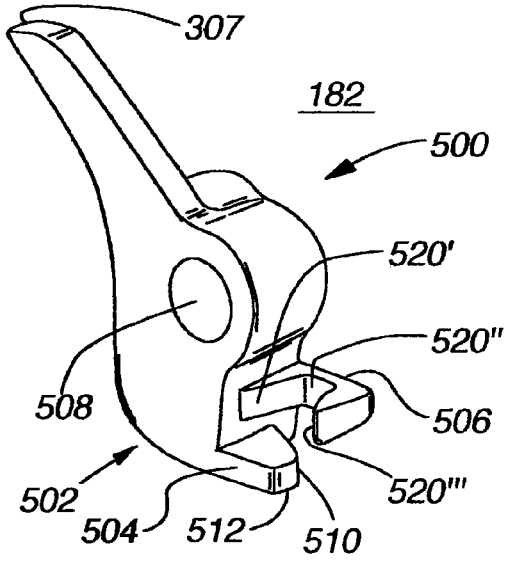
FIG. 11B is front left-side isometric view of the shift arm depicted in FIG. 11A.
Figure 11C:
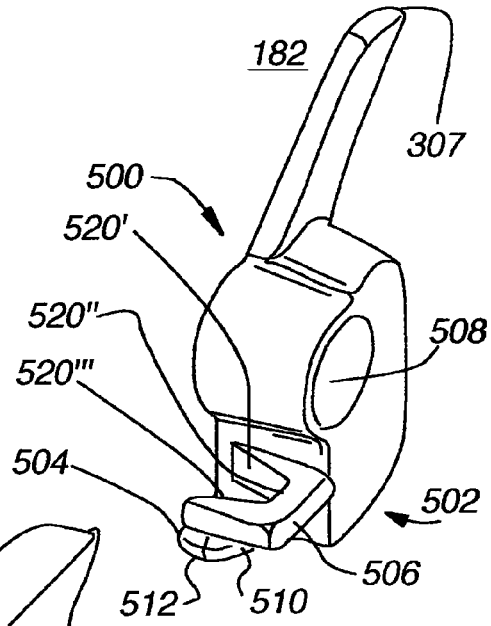
FIG. 11C is front right-side isometric view of the shift arm depicted in FIG. 11A.
Figure 11A:
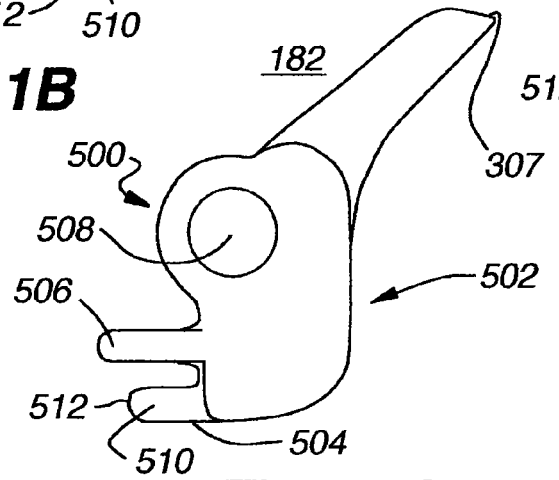
FIG. 11A is a right side elevation of one embodiment of the shift arm depicted in FIGS. 9A and 10A.
Figure 11D:
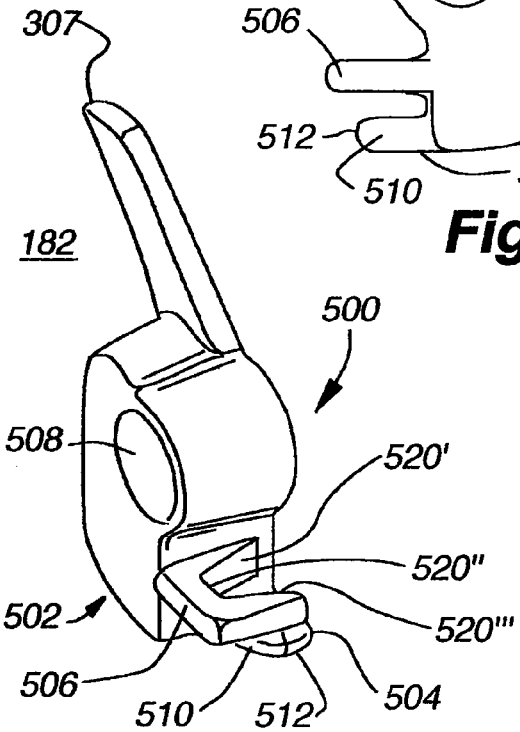
FIG. 11D is front left-side isometric view of another embodiment of a shift arm similar to the shift arm depicted in FIG. 11A.
Figure 11E:
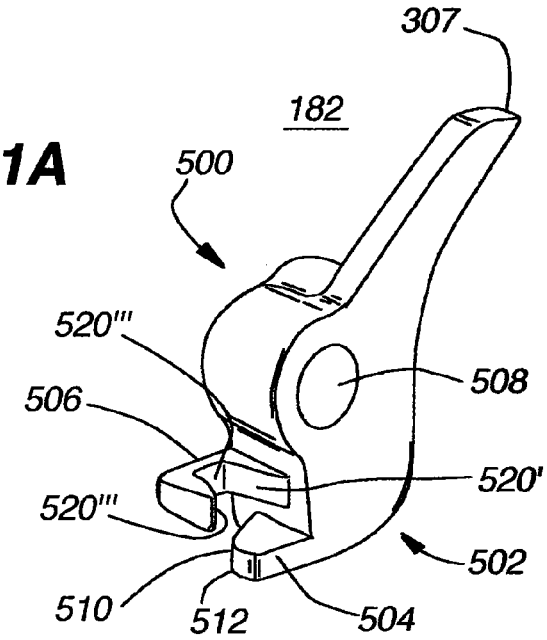
FIG. 11E is front right-side isometric view of another embodiment of a shift arm similar to the shift arm depicted in FIG. 11A.

As indicated in FIGS. 11D and 11E, in one embodiment of the first version of the shift arm 182, the first arm 504 projects generally horizontally forward from the front side of the block portion 502 and has one side that is coplanar with the right vertical planar side of the block portion 502. The second arm 506 projects generally horizontally forward from the front side of the block portion 502, has one side that is generally coplanar with the left vertical planar side of the block portion 502, generally resides in a plane that is generally parallel to the plane in which the first arm 504 resides, and is located above the first arm 504. The pawl tooth 307 extends generally upward and rearward from the top of the cylindrical and block portions 500, 502 and has one side that is coplanar with the right vertical planar side of the cylindrical and block portions 500, 502.

As shown in FIGS. 11A-11C, in one embodiment of the first version of the shift arm 182, the first arm 504 projects generally horizontally forward from the front side of the block portion 502 and has one side that is coplanar with the left vertical planar side of the block portion 502. The second arm 506 projects generally horizontally forward from the front side of the block portion 502, has one side that is generally coplanar with the right vertical planar side of the block portion 502, generally resides in a plane that is generally parallel to the plane in which the first arm 504 resides, and is located above the first arm 504. The pawl tooth 307 extends generally upward and rearward from the top of the cylindrical and block portions 500, 502 and has one side that is coplanar with the left vertical planar side of the cylindrical and block portions 500, 502.

As shown in FIGS. 11A-11E, the first arm 504 forms a boss 504 that includes a first cord engagement surface 510 that is generally vertically oriented and has an orientation generally oblique to the vertical planar surface of the front side of the block portion 502. Specifically, in one embodiment, the first cord engagement surface 510 intersects the vertical planar surface of the front side of the block portion 502 at a point along said planar surface that is approximately at the lateral midpoint of said planar surface. The first cord engagement surface 510 extends forwardly along an oblique route to intersect the tip 512 of the boss 504. At the tip 512, the first cord engagement surface 510 arcuately transitions about the tip 512 to intersect a side surface of the boss 504 that is generally co-planar with a planar side surface of the block portion 502.

As shown in FIGS. 11A-11E, the second arm 506 forms a bracket 506 that opens towards the boss 504 in a direction that is generally parallel to the axis of the cylindrical hole 508. The inside surface of the bracket 506 forms a second cord engagement surface 520 that is generally vertically oriented and includes a first oblique section 520', a perpendicular section 520", and a second oblique section 520'". The perpendicular section 520" extends perpendicularly forward away from the front vertical planar surface of the block portion 502. The first and second oblique sections 520', 520'" extend from opposite ends of the perpendicular section 520", face each other, and diverge as they extend from the perpendicular section 520" to their respective tips.

As shown in FIGS. 14A-14E, the second version of the shift arm 182 includes a cylindrical portion 500, a block portion 502, a boss arm 504, and a pawl tooth 307. The cylindrical portion 500 includes a cylindrical hole 508, which extends through the cylindrical portion 500 and receives the third end cap shaft 239 such that the shift arm 182 may pivot about said shaft 239 (see FIGS. 12A and 13A). The block portion 502 extends downwardly and rearwardly from the cylindrical portion 500.

As shown in FIGS. 14A-14E, the boss arm 504 projects generally horizontally forward from the front side of the block portion 502 and curves gradually upward. The boss arm 504 includes a first cord engagement surface 510 that is generally vertically oriented and has a parallel section 510' and an oblique section 510". The parallel section 510' has an orientation that is generally parallel to the axis of the cylindrical hole 508. The oblique section 510" has an orientation that is generally oblique to the parallel section 510'. The parallel section 510' arcuately transitions into the oblique section 510", which extends forwardly from the parallel section 510' to a tip 512 of the boss arm 504. The parallel section 510' arcuately transition to the oblique section 510" at a point that is approximately at the lateral midpoint of the shift arm 182.

Figure 14B:
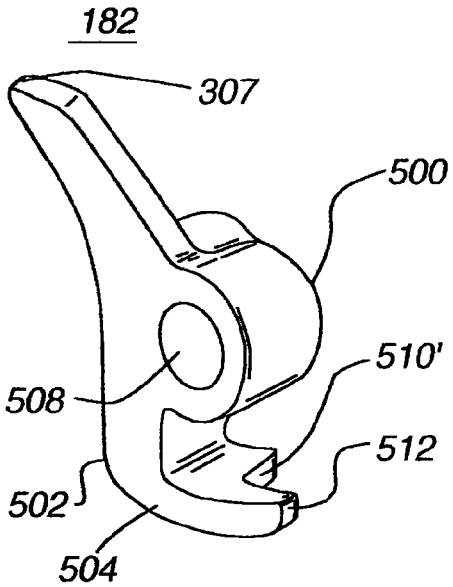
FIG. 14B is front left-side isometric view of the shift arm depicted in FIG. 14A.
Figure 14C:
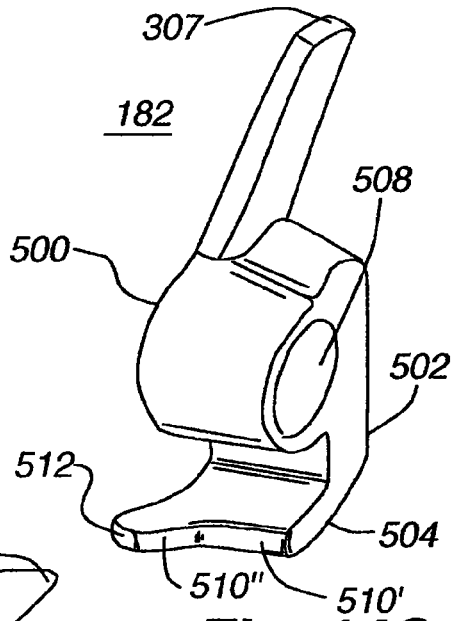
FIG. 14C is front right-side isometric view of the shift arm depicted in FIG. 14A.
Figure 14A:
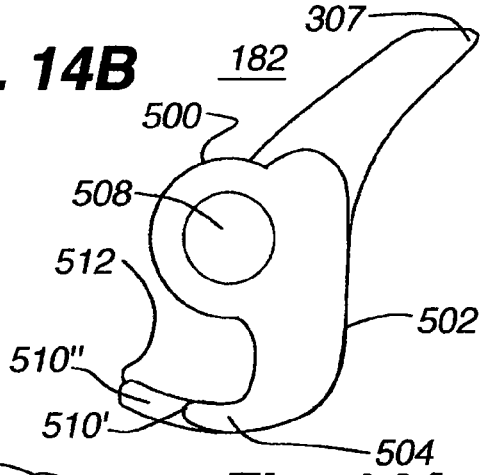
FIG. 14A is a right side elevation of one embodiment of the shift arm depicted in FIGS. 12A and 13A.

In one embodiment of the second version of the shift arm 182, as indicated in FIGS. 14A-14C, the oblique section 510" arcuately transitions about the tip 512 to a side of the boss arm 504 that is generally co-planar with the left vertical planar surface of the block portion 502. The pawl tooth 307 extends generally upward and rearward from the top of the cylindrical and block portions 500, 502 and has one side that is coplanar with the left vertical planar side of the cylindrical and block portions 500, 502.

Figure 14D:
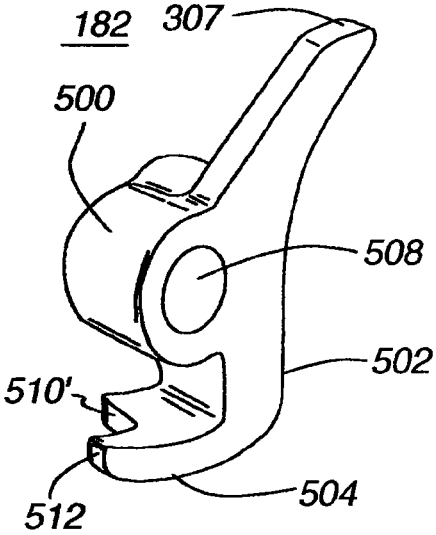
FIG. 14D is front right-side isometric view of another embodiment of a shift arm similar to the shift arm depicted in FIG. 14A.
Figure 14E:
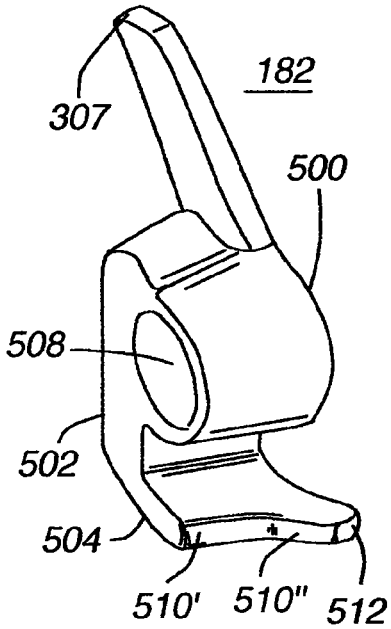
FIG. 14E is front left-side isometric view of another embodiment of a shift arm similar to the shift arm depicted in FIG. 14A.

In one embodiment of the second shift arm 182, as indicated in FIGS. 14D-14E, the oblique section 510" arcuately transitions about the tip 512 to a side of the boss arm 504 that is generally co-planar with the right vertical planar surface of the block portion 502. The pawl tooth 307 extends generally upward and rearward from the top of the cylindrical and block portions 500, 502 and has one side that is coplanar with the right vertical planar side of the cylindrical and block portions 500, 502.

d. Operation of the Shift Arms

For a discussion of the second embodiment of the control system 110 employing the first version of the shift arm 182, reference is now made to FIGS. 9A-9AA, 9AAAAA, 10A-10AAA and 11A-11E. To begin an operational sequence, a pull force upon the operating cord 124 causes the pulley 184 to rotate about the second end cap shaft 238. However, pulling the operating cord 124 downward to the right or left determines which direction the shift arm 182 will pivot and whether the pawl tooth 307 will engage or not engage the teeth 314 of the planet carrier 272. When a user pulls on the pull cord, the operating cord 124 is unwound from the cord spool 190, which turns the cord spool in a clockwise direction. The operating cord 124 feeds off the cord spool 190 to pass over the pulley 184 between the first cord barrier wall 298 and the pulley 184 and down between the cord engagement surfaces 510, 520 of the shift arm 182.

As can be understood from FIGS. 3, 9A-9AA, 9AAAAA and 11A-11C, when the operating cord 124 is displaced downwardly and to the left (i.e., in the downward operating pull direction 132), the operating cord 124 engages the first cord engagement surface 510 on the boss 504. This causes the shift arm 182 to pivot clockwise (as viewed in FIG. 9A) about the third end cap shaft 239 such that the operating cord 124 ends up residing against the first cord engagement surface 510 near or on the tip 512 of the boss 504. In one embodiment, as depicted in FIGS. 9AA and 9AAAAA, the operating cord 124 will end up residing against the first cord engagement surface 510 on the tip 512 of the boss 504 near the left planar vertical side of the shift arm 182. As a result of the operating cord 124 engaging the first cord engagement surface 510 near or on the tip 512 of the boss 504, the pawl tooth 307 does not engage the teeth 314 on the planet carrier 272, as depicted in FIG. 9A.

As can be understood from FIGS. 2, 10A-10AAA and 11A-11C, when the operating cord 124 is displaced downwardly and to the right (i.e., in the upward operating pull direction 130), the operating cord 124 engages the second oblique section 520'" of the second cord engagement surface 520 on the second arm 506. This causes the shift arm 182 to pivot counterclockwise (as viewed in FIG. 10A) about the third end cap shaft 239 such that the operating cord 124 ends up residing against the perpendicular section 520" of the second cord engagement surface 520. As a result, the pawl tooth 307 is forced into engagement with the teeth 314 on the planet carrier 272 as depicted in FIG. 10A.

As can be understood from FIG. 10A, the mass of the block portion 502, which is offset from the axis of the cylindrical hole 508, causes the shift arm 182 to rotate counterclockwise about said axis as viewed in FIG. 9A. As a result, the pawl tooth 307 is biased rearwardly and into engagement with the teeth 314 of the planet carrier 272, even without pulling the operating cord 124 in the upward operating pull direction 130.

For a discussion of the second embodiment of the control system 110 employing the second version of the shift arm 182, reference is now made to FIGS. 12A-12AAA, 13A-13AAA and 14A-14E. To begin an operational sequence, a pull force upon the operating cord 124 causes the pulley 184 to rotate about the second end cap shaft 238. However, pulling the operating cord 124 downward to the right or left determines which direction the shift arm 182 will pivot and whether the pawl tooth 307 will engage or not engage the teeth 314 of the planet carrier 272. When a user pulls on the pull cord, the operating cord 124 is unwound from the cord spool 190, which turns the cord spool in a clockwise direction. The operating cord 124 feeds off the cord spool 190 to pass over the pulley 184 between the first cord barrier wall 298 and the pulley 184 and down along the cord engagement surface 510 of the shift arm 182.

As can be understood from FIGS. 3, 12A-12AAA and 14A-14C, when the operating cord 124 is displaced downwardly and to the left (i.e., in the downward operating pull direction 132), the operating cord 124 engages the oblique section 510" of the first cord engagement surface 510 on the boss arm 504. This causes the shift arm 182 to pivot clockwise (as viewed in FIG. 12A) about the third end cap shaft 239 such that the operating cord 124 ends up residing against the first cord engagement surface 510 near or on the tip 512 of the boss arm 504. In one embodiment, as depicted in FIGS. 12AA and 12AAA, the operating cord 124 will end up residing against the first cord engagement surface 510 on the tip 512 of the boss 504 near the left planar vertical side of the shift arm 182. As a result of the operating cord 124 engaging the first cord engagement surface 510 near or on the tip 512 of the boss 504, the pawl tooth 307 does not engage the teeth 314 on the planet carrier 272, as depicted in FIG. 12A.

As can be understood from FIG. 12A, the mass of the block portion 502, which is offset from the axis of the cylindrical hole 508, causes the shift arm 182 to rotate counterclockwise about said axis as viewed in FIG. 13A. As a result, the pawl tooth 307 is biased rearwardly and into engagement with the teeth 314 of the planet carrier 272 when the operating cord 124 is not displaced to the left (i.e., in the upward operating pull direction 130). Thus, as can be understood from FIGS. 2, 13A-13AAA and 14A-14C, when the operating cord 124 is displaced downwardly and to the right (i.e., in the upward operating pull direction 130), the bias causes the shift arm 182 to pivot counterclockwise about the third end cap shaft 239 until the parallel section 510' of the first cord engagement surface 510 on boss arm 504 encounters the operating cord 124 and the pawl tooth 307 is in engagement with the teeth 314 on the planet carrier 272, as depicted in FIG. 13A.

e. Axle Arrangements for Shift Arm and Pulley

As shown in FIG. 9AAA, in one version of the second embodiment of the control mechanism 110, the third end cap shaft 239 includes a cylindrical hole extending along the axis of the shaft 239. Said cylindrical hole receives a pin 530 extending from the cord guide arm 180 to provide outboard support for the third end cap shaft 239.

As indicated in FIG. 9AAAA, in one version of the second embodiment of the control mechanism 110, the cylindrical spacer 294 includes a cylindrical hole extending along the axis of the spacer 294. Said cylindrical hole receives the second end cap shaft 238. As a result, the spacer 294 is able to provide outboard support for the shaft 238.

f. Parked Position

Figure 10B:
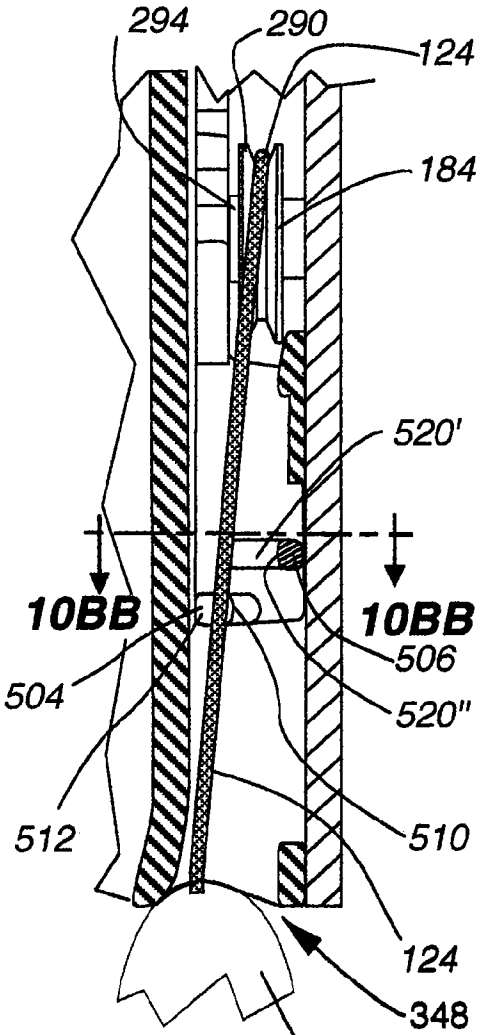
FIG. 10B is a cross-sectional view of the control system depicted in FIG. 10A taken along line 10B-10B.
Figure 10B:
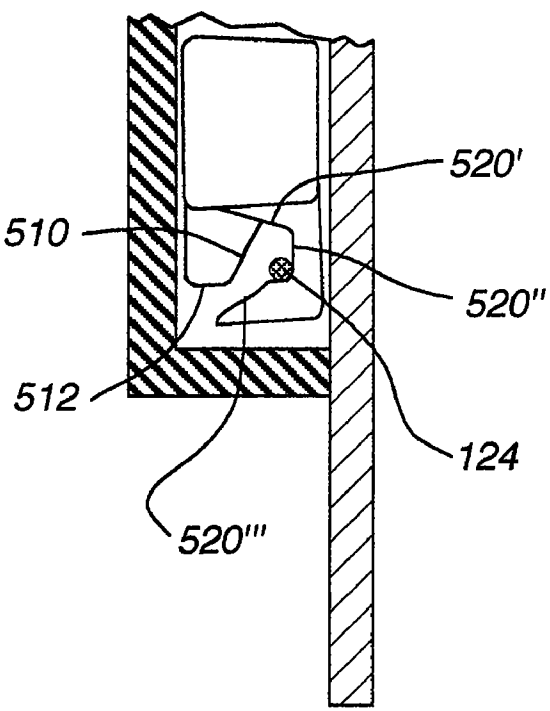
Figure 10B:
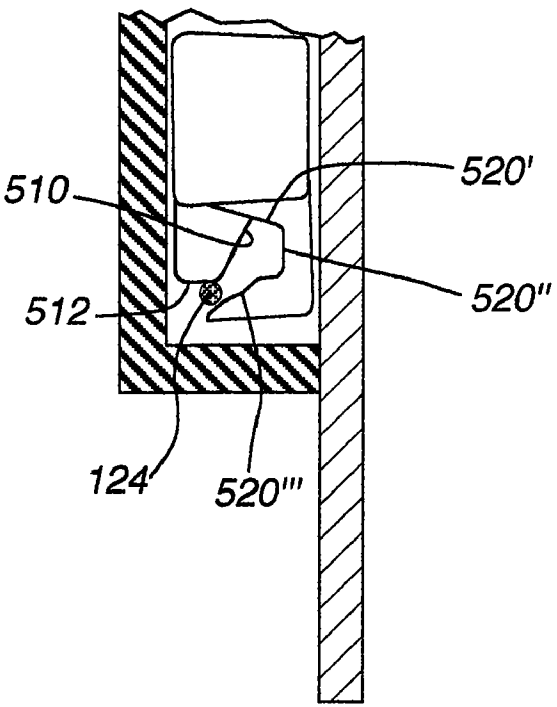
Figure 10B:
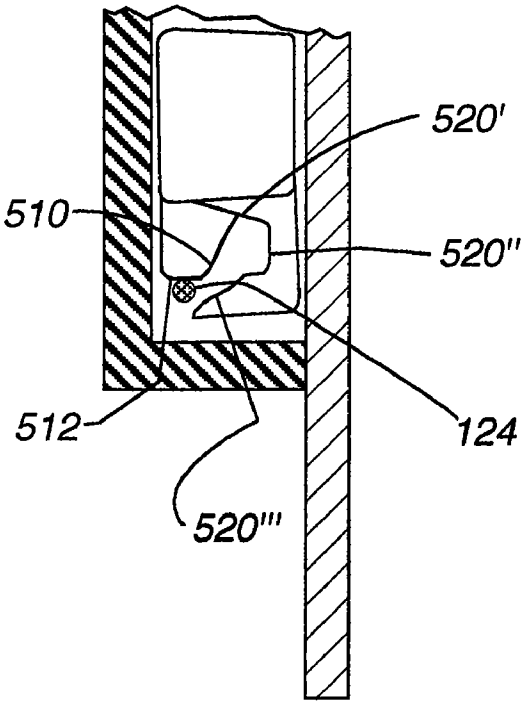

As discussed in detail with respect to the first embodiment of the control system 110, the second embodiment of the control system 110 has a cord guide arm 180 with a horn opening 348 adapted to matingly receive the clasp 126 in a "parked" position, as depicted in FIGS. 10B, 10BB, 13B and 13BB. As can be understood from FIGS. 10B and 10BB, when the clasp 126 is in the "parked" position for the first version of the shift arm 182, the operating cord 124 abuts against the first cord engagement surface 510 on or near the tip 512 of the boss 504. As a result, when the pull cord 120 is not being pulled, the shift arm 182 is maintained in a position wherein the pawl tooth 307 does not engage the teeth 314 of the planet carrier 272.

Figure 13B:
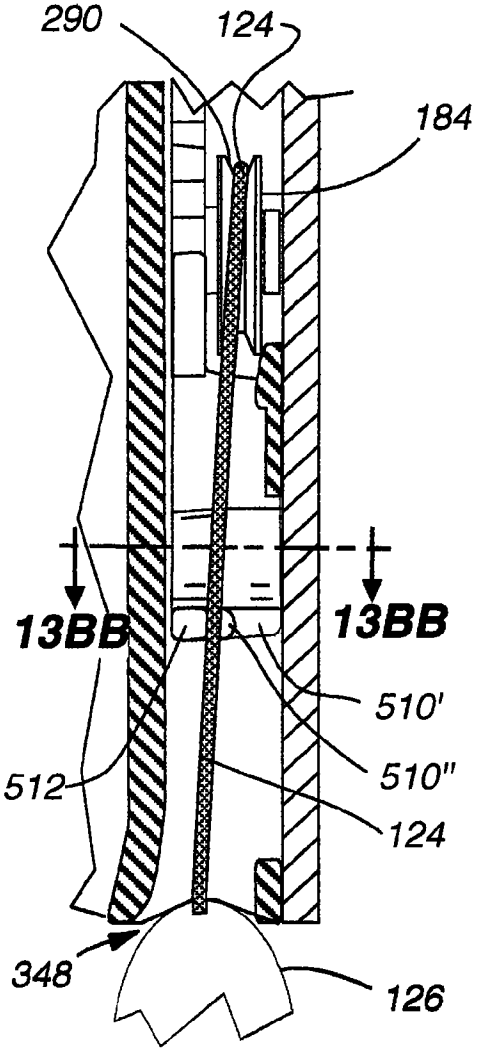
FIG. 13B is a cross-sectional view of the control system depicted in FIG. 13A taken along line 13B-13B.
Figure 13B:
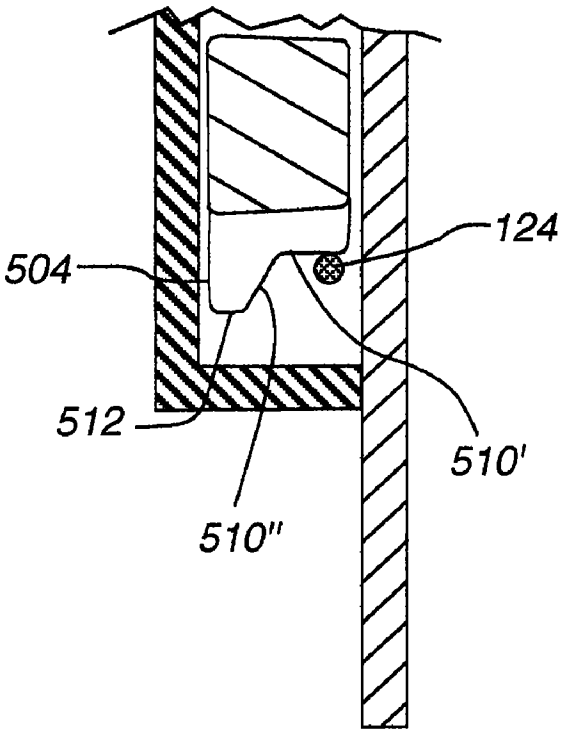
Figure 13B:
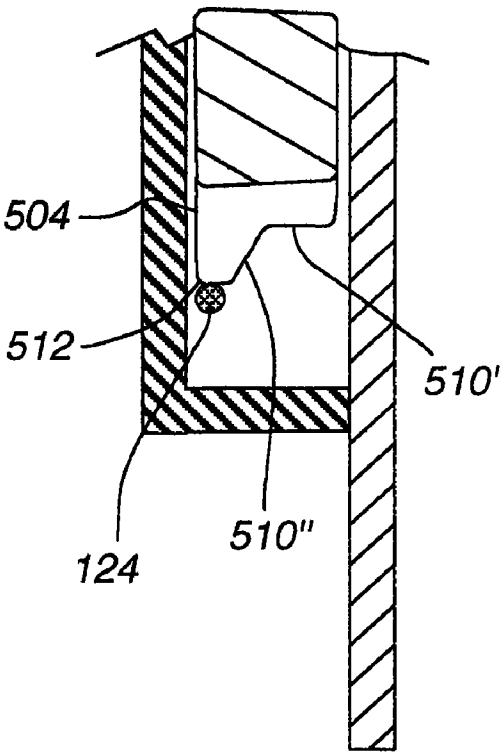
Figure 13B:
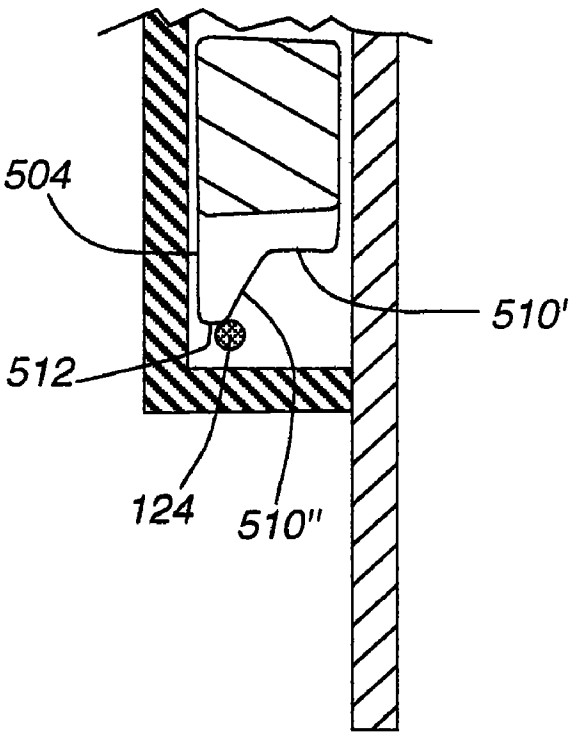

As depicted in FIGS. 13B and 13BB, when clasp 126 is in the "parked" position for the second version of the shift arm 182, the operating cord 124 abuts against the oblique section 510" of the first cord engagement surface 510 on or near the tip 512 of the boss 504. As a result, when the pull cord 120 is not being pulled, the shift arm 182 is maintained in a position wherein the pawl tooth 307 does not engage the teeth 314 of the planet carrier 272.

As discussed in detail with respect to the first embodiment of the control system 110, as the operating cord 124 travels laterally relative to the shift arm 182, the position of the operating cord relative to cord engagement surface(s) 510, 520 determines whether the shift arm 182 pivots to engage or disengage with the transmission 176. The position of the operating cord 124 relative to the cord engagement surface(s) 510, 520 is determined by the pull direction in which the user is placing force on the pull cord and operating cord.

When the pull cord 120 is not being pulled and the releasable clasp 126 is in the parked position depicted in FIGS. 10B, 13B and 7F, the flared opening 348 is configured to urge the operating cord 124 to directly overlay the first cord engagement surface 510 of the boss 308 on or near the extreme tip 312 of the boss 308, as shown in FIGS. 10B, 10BB, 13B, 13BB. When the pull cord 120 is being pulled, the flared opening 348 of the cord guide arm 180 urges the user to pull on the pull cord and operating cord in either the upward operating pull direction 130 or the downward operating pull direction 132, as shown in FIGS. 2 and 3.

With respect to the first version of the second embodiment, as depicted in FIGS. 9A and 10A, if the pull direction is in the upward operating pull direction 130 (see FIG. 2), the operating cord 124 moves from the parked position and contacts the second cord engagement surface 520 of the shift arm 182 as discussed above and shown in FIGS. 10A, 10AA and 10AAA. With respect to the second version of the second embodiment, as depicted in FIGS. 12A and 13A, if the pull direction is in the downward operating pull direction 132 (see FIG. 3), the natural bias of the shift arm configuration causes the shift arm 182 to pivot counterclockwise until the parallel section 510' of the first cord engagement surface 510 encounters the operating cord 124 as discussed above and shown in FIGS. 13A, 13AA and 13AAA. However, with respect to both the first and second version of the second embodiment, as shown in FIGS. 9A, 9AA, 10B, 10BB, 12A, 12AA, 13B and 13BB, if the pull direction is in the downward operating pull direction 132 (see FIG. 3), the operating cord 124 remains in contact with the first cord engagement surface 309 of the boss because the parked position already had the operating cord 124 in contact with the tip of the boss 309.

It will be appreciated from the above noted description of various arrangements and embodiments of the present invention that a control system for a covering for an architectural opening has been described, which includes an input assembly, a transmission, and an output assembly. The control system can be formed in various ways and operated in various manners depending upon whether covering is to be rolled up along the front or rear side of the head roller. It will be appreciated that the features described in connection with each arrangement and embodiment of the invention are interchangeable to some degree so that many variations beyond those specifically described are possible. For example, the control system can be assembled and supported by various portions of the head rail assembly, such as an end cap, or the control system can be disengaged from the head rail assembly.

Although various embodiments of this invention have been described above with a certain degree of particularity or with reference to one or more individual embodiments, those skilled in the art could make numerous alterations to those disclosed embodiments without departing from the spirit or scope of this invention. It is intended that all matter contained in the above description and shown in the accompanying drawings shall be interpreted as illustrative only of particular embodiments, and not limiting. Changes in detail or structure may be made without departing from the basic elements of the invention as defined in the following claims.

What is claimed is:

1. An input assembly for a control system adapted to selectively extend and retract a covering for an architectural opening, wherein the control system has a transmission configured to receive a rotational input in a first rotational direction and selectively provide a rotational output in the first rotational direction or in a second rotational direction, the input assembly comprising:

an operating element;

a spool rotatably mounted on a first axle and adapted to storably receive the operating element;

a biasing element coupled to the spool and adapted to cause the spool to retract the operating element from an extended state onto the spool;

a pulley rotatably mounted on a second axle and adapted to receive the operating element; and an unbiased shift arm pivotally mounted on a third axle and including a pawl tooth and a first surface for engaging the operating element.

2. The input assembly of claim 1, wherein the operating element extends from the spool, about the pulley and adjacent the first surface of the shift arm.

3. The input assembly of claim 2, wherein displacement of the operating element in a first direction brings the operating element into contact with the first surface and causes the shift arm to pivot such that the pawl tooth is prevented from engaging the transmission.

4. The input assembly of claim 3, wherein displacement of the operating element in a second direction allows the shift arm to pivot such that the pawl tooth engages the transmission.

5. The input assembly of claim 3, wherein the shift arm further includes a second surface for engaging the operating element and displacement of the operating element in a second direction brings the operating element into contact with the second surface and causes the shift arm to pivot such that the pawl tooth engages the transmission.

6. The input assembly of claim 1, wherein pawl tooth engagement with the transmission causes the transmission to provide rotational output in the second rotational direction, and failure of the pawl tooth to engage with the transmission causes the transmission to provide rotational output in the first rotational direction.

7. An input assembly for a control system adapted to selectively extend and retract a covering for an architectural opening, the input assembly comprising:

a transmission rotationally mounted on a first axle and including a spool;

a pulley rotationally mounted on a second axle;

an unbiased shift arm pivotally mounted on a third axle and including a pawl tooth; and an operating element retractably extending from the spool, about the pulley and adjacent the shift arm, wherein extending the operating element from the spool in an extending direction provides the transmission with a rotational input in a first rotational direction.

8. The input assembly of claim 7, wherein, when the shift arm is pivoted in the first rotational direction, extending the operating element causes the transmission to have a rotational output in the first rotational direction.

9. The input assembly of claim 8, wherein pivoting the shift arm in the first rotational direction prevents the pawl tooth from engaging the transmission.

10. The input assembly of claim 7, wherein, when the shift arm is pivoted in a second rotational direction opposite the first rotational direction, extending the operating element causes the transmission to have a rotational output in a second rotational direction opposite the first rotational direction.

11. The input assembly of claim 10, wherein pivoting the shift arm in the second rotational direction causes the pawl tooth to engage the transmission.

12. The input assembly of claim 7, wherein displacing the operating element in a first lateral direction generally lateral or transverse to the extending direction brings the operating element into contact with a first surface on the shift arm and prevents the pawl tooth from engaging the transmission.

13. The input assembly of claim 11, wherein, when the pawl tooth does not engage the transmission as the operating element is extended in the extending direction, the transmission has a rotational output in the first rotational direction.

14. The input assembly of claim 13, wherein displacing the operating element in a second lateral direction generally opposite the first lateral direction brings the operating element into contact with a second surface on the shift arm and causes the pawl tooth to engage the transmission.

15. The input assembly of claim 14, wherein, when the pawl tooth engages the transmission as the operating element is extended in the extending direction, the transmission has a rotational output in a second rotational direction opposite the first rotational direction.

16. The input assembly of claim 13, wherein displacing the operating element in a second lateral direction generally opposite the first lateral direction places the operating element out of contact with the shift arm and allows the weight of the shift arm to bias the pawl tooth into engagement with the transmission.

17. The input assembly of claim 16, wherein, when the pawl tooth engages the transmission as the operating element is extended in the extending direction, the transmission has a rotational output in a second rotational direction opposite the first rotational direction.

18. The input assembly of claim 7, wherein the pawl tooth is oriented generally in the same direction as the extending direction.

19. The input assembly of claim 18, wherein operating element extends through an opening in the shift arm.

20. The input assembly of claim 7, wherein the pawl tooth is oriented generally opposite the extending direction.

21. A method of selectively extending and retracting a covering for an architectural opening, the method comprising:

routing an operating element from a spool, about a pulley and adjacent a shift arm, wherein the spool drives a transmission rotationally mounted on a first axle, the pulley is rotationally mounted on a second axle, and the unbiased shift arm includes a pawl tooth for engaging the transmission and is pivotally mounted on a third axle; and extending the operating element in an extension direction to create a rotational input for the transmission in a first rotational direction.

22. The method of claim 21, further comprising displacing the operating element in a first lateral direction generally lateral or transverse to the extension direction and thereby causing the shift arm to pivot in the first rotational direction and the transmission to rotate in the first rotational direction.

23. The method of claim 22, wherein the shift arm pivoting in the first rotational direction prevents the pawl tooth from engaging the transmission.

24. The method of claim 22, further comprising displacing the operating element in a second lateral direction generally opposite the first lateral direction and thereby causing the shift arm to pivot in a second rotational opposite the first rotational direction and the transmission to rotate in the second rotational direction.

25. The method of claim 24, wherein the shift arm pivoting in the second rotational direction causes the pawl tooth to engage the transmission.

* * * * *

UNITED STATES PATENT AND TRADEMARK OFFICE

CERTIFICATE OF CORRECTION

PATENT NO. : 7,578,334 B2
APPLICATION NO. : 11/420274
DATED : August 25, 2009
INVENTOR(S) : Stephen P. Smith et al.

It is certified that error appears in the above-identified patent and that said Letters Patent is hereby corrected as shown below:

Column 34, claim 21, line 5, before "shift" insert --unbiased--; and
Column 34, claim 21, line 8, delete "unbiased".

Signed and Sealed this

Twenty-seventh Day of October, 2009

David J. Kappos

David J. Kappos
*Director of the United States Patent and Trademark Office*